US008550308B2

(12) United States Patent
Py et al.

(10) Patent No.: US 8,550,308 B2
(45) Date of Patent: Oct. 8, 2013

(54) APPARATUS FOR DISPENSING FLUIDS

(75) Inventors: Daniel Py, Larchmont, NY (US); Brian Tulley, Naughatuck, CT (US); Jeff Willey, Brookfield, CT (US); Norbert Assion, Shelton, CT (US); Nathaniel Houle, New York, NY (US); Julian Chan, New Milford, CT (US); Bing He, Ridgewood, NY (US)

(73) Assignee: Medical Instill Technologies, Inc., New Milford, CT (US)

( * ) Notice: Subject to any disclaimer, the term of this patent is extended or adjusted under 35 U.S.C. 154(b) by 184 days.

(21) Appl. No.: 11/949,104

(22) Filed: Dec. 3, 2007

(65) Prior Publication Data

US 2008/0116226 A1 May 22, 2008

Related U.S. Application Data

(62) Division of application No. 11/900,335, filed on Sep. 10, 2007.

(60) Provisional application No. 60/843,131, filed on Sep. 8, 2006.

(51) Int. Cl.
*B65D 37/00* (2006.01)

(52) U.S. Cl.
USPC ..... 222/207; 222/212; 222/82

(58) Field of Classification Search
USPC ..... 222/494, 207, 209, 211–213, 95, 222/105–107, 81, 83, 83.5; 137/853
See application file for complete search history.

(56) References Cited

U.S. PATENT DOCUMENTS

| | | | | |
|---|---|---|---|---|
| 1,392,600 | A | 10/1921 | Rose | |
| 2,014,881 | A | 9/1935 | Carlstrom | |
| 2,317,270 | A | 4/1943 | Harris | |
| 2,471,852 | A | 5/1949 | Bau | |
| 2,715,980 | A | 8/1955 | Frick | |
| 3,160,329 | A * | 12/1964 | Radic et al. | 222/494 |
| 3,173,579 | A | 3/1965 | Curie et al. | |
| 3,180,374 | A | 4/1965 | Muller | |
| 3,211,340 | A * | 10/1965 | Zander et al. | 222/95 |
| 3,220,611 | A * | 11/1965 | Zander et al. | 222/95 |
| 3,231,149 | A * | 1/1966 | Yuza | 222/494 |

(Continued)

FOREIGN PATENT DOCUMENTS

| | | |
|---|---|---|
| CN | 2436454 | 6/2001 |
| EP | 0172711 | 2/1986 |

(Continued)

*Primary Examiner* — Lien Ngo
(74) *Attorney, Agent, or Firm* — McCarter & English, LLP

(57) ABSTRACT

An apparatus for storing fluid and dispensing multiple portions of a stored fluid therefrom. The apparatus comprises a container defining a variable-volume storage chamber for receiving therein the fluid and a dispensing valve including a valve inlet coupled in fluid communication with the variable volume storage chamber, and a valve member in fluid communication with the valve inlet and defining a normally-closed valve opening. The valve member is responsive to fluid at the valve inlet exceeding a valve opening pressure to move between (i) a normally closed position, and (ii) an open position permitting fluid flow through the valve opening. The dispensing valve defines a dispensing axis defining a direction substantially along which fluid is dispensed from the valve, and further includes an outlet surface over which dispensed fluid flows oriented at an acute angle relative to the dispensing axis for preventing the collection of residual dispensed fluid thereon.

26 Claims, 62 Drawing Sheets

(56) References Cited

U.S. PATENT DOCUMENTS

| | | | | |
|---|---|---|---|---|
| 3,499,582 | A | 3/1970 | Berney | |
| 3,507,568 | A | 4/1970 | Gordeev | |
| 3,820,689 | A * | 6/1974 | Cocita | 222/207 |
| 3,987,938 | A | 10/1976 | Cooprider et al. | |
| 4,015,752 | A | 4/1977 | Meuresch et al. | |
| 4,078,705 | A | 3/1978 | Butcher | |
| 4,099,651 | A | 7/1978 | Von Wickelmann | |
| 4,168,020 | A | 9/1979 | Benson | |
| 4,216,236 | A | 8/1980 | Mueller et al. | |
| 4,239,132 | A | 12/1980 | Mueller et al. | |
| 4,249,675 | A | 2/1981 | Nilson | |
| 4,256,242 | A | 3/1981 | Christine | |
| 4,314,654 | A | 2/1982 | Gaubert | |
| 4,349,133 | A | 9/1982 | Christine | |
| 4,401,239 | A | 8/1983 | Thomassen | |
| 4,416,395 | A | 11/1983 | Gaubert | |
| 4,420,100 | A | 12/1983 | Mueller | |
| 4,425,366 | A | 1/1984 | Sozzi et al. | |
| 4,425,698 | A | 1/1984 | Petrie | |
| 4,457,454 | A | 7/1984 | Meshberg | |
| 4,520,948 | A | 6/1985 | Hampel et al. | |
| 4,526,294 | A | 7/1985 | Hirschmann et al. | |
| 4,561,571 | A | 12/1985 | Chen | |
| 4,607,764 | A | 8/1986 | Christine | |
| 4,660,737 | A | 4/1987 | Green et al. | |
| 4,667,854 | A | 5/1987 | McDermott et al. | |
| 4,722,459 | A | 2/1988 | Goncalves | |
| 4,776,495 | A | 10/1988 | Vignot | |
| 4,795,063 | A | 1/1989 | Sekiguchi et al. | |
| 4,823,990 | A | 4/1989 | Roggenburg et al. | |
| 4,830,229 | A | 5/1989 | Ball | |
| 4,854,483 | A | 8/1989 | Haggart | |
| 4,981,479 | A * | 1/1991 | Py | 604/302 |
| 5,033,647 | A | 7/1991 | Smith et al. | |
| 5,074,440 | A | 12/1991 | Clements et al. | |
| 5,099,885 | A | 3/1992 | Nilsson | |
| 5,100,027 | A * | 3/1992 | Gueret | 222/105 |
| 5,108,007 | A | 4/1992 | Smith et al. | |
| 5,145,083 | A | 9/1992 | Takahashi | |
| 5,176,510 | A | 1/1993 | Nilsson | |
| 5,178,300 | A | 1/1993 | Haviv et al. | |
| 5,226,568 | A | 7/1993 | Newton et al. | |
| 5,238,153 | A | 8/1993 | Castillo et al. | |
| 5,267,986 | A | 12/1993 | Py | |
| 5,271,513 | A | 12/1993 | Crosner et al. | |
| 5,303,851 | A | 4/1994 | Libit et al. | |
| 5,332,121 | A | 7/1994 | Schmidt et al. | |
| 5,339,972 | A * | 8/1994 | Crosnier et al. | 215/320 |
| 5,360,145 | A | 11/1994 | Gueret | |
| 5,401,259 | A | 3/1995 | Py | |
| 5,409,146 | A | 4/1995 | Hazard et al. | |
| 5,429,254 | A | 7/1995 | Christine | |
| 5,435,463 | A | 7/1995 | Hodgson | |
| 5,452,826 | A | 9/1995 | Stern | |
| 5,453,096 | A | 9/1995 | Lataix | |
| 5,454,488 | A | 10/1995 | Geier | |
| 5,464,125 | A | 11/1995 | Daansen | |
| 5,492,252 | A | 2/1996 | Gueret | |
| RE35,187 | E | 3/1996 | Gortz | |
| 5,499,758 | A | 3/1996 | McCann et al. | |
| 5,505,341 | A * | 4/1996 | Gueret | 222/207 |
| 5,613,517 | A | 3/1997 | Handler | |
| 5,617,976 | A | 4/1997 | Gueret | |
| 5,641,004 | A | 6/1997 | Py | |
| 5,642,838 | A | 7/1997 | Stoody | |
| 5,685,869 | A | 11/1997 | Py | |
| 5,687,882 | A | 11/1997 | Mueller | |
| 5,697,532 | A | 12/1997 | Wilde et al. | |
| 5,772,079 | A | 6/1998 | Gueret | |
| 5,803,311 | A | 9/1998 | Fuchs | |
| 5,836,484 | A | 11/1998 | Gerber | |
| 5,857,595 | A * | 1/1999 | Nilson | 222/494 |
| 5,875,931 | A | 3/1999 | Py | |
| 5,875,936 | A * | 3/1999 | Turbett et al. | 222/207 |
| 5,931,386 | A | 8/1999 | Jouillat | |
| 5,944,702 | A | 8/1999 | Py | |
| 5,971,224 | A | 10/1999 | Garibaldi | |
| RE36,410 | E | 11/1999 | Meshberg | |
| 5,996,845 | A | 12/1999 | Chan | |
| 6,003,733 | A | 12/1999 | Wheeler | |
| 6,024,252 | A | 2/2000 | Clyde | |
| 6,033,384 | A | 3/2000 | Py | |
| 6,062,430 | A | 5/2000 | Fuchs | |
| 6,092,695 | A | 7/2000 | Loeffler | |
| 6,149,957 | A | 11/2000 | Mandralis et al. | |
| 6,170,715 | B1 | 1/2001 | Evans | |
| 6,182,698 | B1 | 2/2001 | Barak | |
| 6,216,916 | B1 | 4/2001 | Maddox et al. | |
| 6,254,579 | B1 | 7/2001 | Cogger et al. | |
| 6,325,253 | B1 | 12/2001 | Robinson | |
| 6,386,395 | B1 | 5/2002 | Lunghetti | |
| 6,450,994 | B1 | 9/2002 | Boyles et al. | |
| 6,455,093 | B1 | 9/2002 | Furrer et al. | |
| 6,471,095 | B1 | 10/2002 | Cann | |
| 6,491,189 | B2 | 12/2002 | Friedman | |
| 6,524,287 | B1 | 2/2003 | Cogger | |
| 6,547,108 | B2 * | 4/2003 | Johanson | 222/494 |
| 6,561,383 | B1 | 5/2003 | Reddy et al. | |
| 6,592,918 | B2 | 7/2003 | Kaeser | |
| 6,592,922 | B2 | 7/2003 | Furrer et al. | |
| 6,662,977 | B2 | 12/2003 | Gerber et al. | |
| 6,695,173 | B1 | 2/2004 | Fontana | |
| 6,698,628 | B2 * | 3/2004 | Mascitelli | 222/494 |
| 6,742,680 | B2 | 6/2004 | Friedman | |
| 6,755,327 | B1 | 6/2004 | Hazard et al. | |
| D493,366 | S | 7/2004 | Rackwitz | |
| 6,761,286 | B2 | 7/2004 | Py et al. | |
| 6,769,627 | B2 | 8/2004 | Carhuff et al. | |
| 6,802,436 | B2 | 10/2004 | Drennow et al. | |
| 6,883,222 | B2 | 4/2005 | Landau | |
| 6,892,906 | B2 | 5/2005 | Py et al. | |
| 6,971,553 | B2 | 12/2005 | Brennan et al. | |
| 7,011,233 | B2 | 3/2006 | Drennow | |
| 7,278,553 | B2 | 10/2007 | Py | |
| 7,322,491 | B2 | 1/2008 | Py et al. | |
| 7,357,335 | B2 | 4/2008 | Laidler et al. | |
| 7,513,395 | B2 | 4/2009 | Labinski et al. | |
| 7,789,269 | B2 | 9/2010 | Pritchard | |
| 7,806,301 | B1 | 10/2010 | Ciavarella et al. | |
| 2001/0027827 | A1 | 10/2001 | Jeannin et al. | |
| 2002/0050301 | A1 | 5/2002 | Jeannin et al. | |
| 2002/0074362 | A1 | 6/2002 | Py et al. | |
| 2002/0121527 | A1 | 9/2002 | Good | |
| 2002/0124907 | A1 | 9/2002 | Crossdale et al. | |
| 2003/0012858 | A1 | 1/2003 | Furrer et al. | |
| 2003/0082070 | A1 | 5/2003 | Liberto et al. | |
| 2004/0011820 | A1 | 1/2004 | Abergel et al. | |
| 2004/0118291 | A1 | 6/2004 | Carhuff et al. | |
| 2004/0194811 | A1 | 10/2004 | Carhuff et al. | |
| 2005/0029307 | A1 | 2/2005 | Py et al. | |
| 2005/0072480 | A1 * | 4/2005 | Brandes | 137/853 |
| 2005/0089358 | A1 | 4/2005 | Py et al. | |
| 2005/0165368 | A1 | 7/2005 | Py et al. | |
| 2005/0260090 | A1 | 11/2005 | Stark et al. | |
| 2006/0169722 | A1 | 8/2006 | Py et al. | |
| 2006/0186139 | A1 | 8/2006 | Laidler et al. | |

FOREIGN PATENT DOCUMENTS

| | | |
|---|---|---|
| EP | 172711 A2 * | 2/1986 |
| EP | 0616141 | 9/1994 |
| EP | 0649795 | 4/1995 |
| EP | 0 733 559 | 9/1996 |
| EP | 0733559 | 9/1996 |
| EP | 0743263 | 11/1996 |
| EP | 0802827 | 10/1997 |
| EP | 1546021 | 2/2004 |
| FR | 2709733 | 3/1995 |
| JP | S59-10986 | 4/1984 |
| JP | 63-156978 | 10/1988 |
| JP | H2-21078 | 6/1990 |
| JP | 2-97427 | 8/1990 |
| JP | 06-239379 | 8/1994 |
| JP | 07-125799 | 5/1995 |

| | | |
|---|---|---|
| JP | 10-156269 | 6/1998 |
| JP | 2002 347812 | 4/2002 |
| JP | 05-016950 | 1/2003 |
| JP | 2005-535530 | 11/2005 |
| WO | WO 93 16955 A1 | 9/1993 |
| WO | WO99/32185 | 1/1999 |
| WO | WO 99/41158 | 8/1999 |
| WO | WO 00/29192 | 5/2000 |
| WO | WO 02/40122 | 5/2002 |
| WO | WO 03/033363 | 4/2003 |

* cited by examiner

APPARATUS FOR DISPENSING FLUIDS

CROSS REFERENCE TO RELATED PATENT APPLICATIONS

This application is a divisional of U.S. patent application Ser. No. 11/900,335, filed Sep. 10, 2007, which claims priority to U.S. Provisional Patent Application Ser. No. 60/843,131, filed Sep. 8, 2006, both of which are hereby incorporated by reference in their entireties as part of the present disclosure.

FIELD OF THE INVENTION

The present invention relates to apparatus for storing and dispensing fluids, and more particularly, to such apparatus employing dispensing valves, pumps and/or variable-volume storage chambers.

BACKGROUND INFORMATION

Aseptic packaging is widely used to prolong the shelf life of food and drink products. With conventional aseptic packaging, the product is filled and sealed in the package under sterile or bacteria-free conditions. In order to maximize shelf life prior to opening, the product and the packaging material may be sterilized prior to filling, and the filling of the product in the packaging is performed under conditions that prevent re-contamination of the product. One such prior art dispenser system that employs an aseptically filled package is shown in U.S. Pat. No. 6,024,242. The package includes a pouch that holds the food or beverage, and a flexible, open-ended tube connected to the pouch for dispensing the product therethrough. A pinch valve is used in the dispenser to pinch the open end of the tube and thereby close the tube from the ambient atmosphere. In order to dispense product, the pinch valve is released from the tube, and the product is in turn allowed to flow from the pouch and through the open end of the tube.

In the field of baby formula, for example, various packaging schemes are available. The formula may be purchased in powder form and mixed with a fluid to reconstitute the formula. This provides a significant risk of contamination, as the conditions and/or water involved in preparing the formula are generally not sterile. Formula also may be purchased in cans. However, the heat and pressure used in canning may affect the flavor, nutrition and/or overall quality of the product.

Aseptic packages also are available. However, in many cases such packaging is only aseptic until the packaging is opened. Once opened, the contents of such packages not immediately used must be refrigerated to avoid contamination. Even with refrigeration, the chances of contamination are elevated because the package is no longer hermetically sealed.

It is an object of the present invention to overcome one or more of the above-described drawbacks and/or disadvantages of the prior art.

SUMMARY OF THE INVENTION

In accordance with a first aspect, the present invention is directed to an apparatus for storing fluid and dispensing multiple portions of the stored fluid therefrom. The apparatus comprises a container defining a variable-volume storage chamber for receiving therein the fluid and a dispensing valve including a valve inlet coupled in fluid communication with the variable volume storage chamber, and a valve member in fluid communication with the valve inlet and defining a normally-closed valve opening. The valve member is responsive to fluid at the valve inlet exceeding a valve opening pressure to move between (i) a normally closed position, and (ii) an open position permitting fluid flow through the valve opening. The dispensing valve defines a dispensing axis defining a direction substantially along which fluid is dispensed from the valve, and further includes an outlet surface over which dispensed fluid flows oriented at an acute angle relative to the dispensing axis for preventing the collection of residual dispensed fluid thereon. The apparatus further comprises a pump coupled between the variable-volume storage chamber and one-way valve for pumping fluid from the variable-volume storage chamber through the one-way valve.

In some embodiments, the pump includes a compressible member defining a compression chamber coupled in fluid communication with the variable-volume storage chamber and the dispensing valve and movable between (i) a first position wherein the compression chamber defines a first volume, and (ii) a second position wherein the compression chamber defines a second volume less than the first volume. Movement of the compressible member from the first position to the second position pressurizes fluid in the compression chamber above the valve opening pressure and moves the valve member to the open position to dispense fluid therethrough. In some such embodiments, the compressible member stores sufficient energy when moving from the first position to the second position to drive the compressible member from the second position back to the first position.

In some embodiments, the apparatus further comprising a housing receiving therein the variable-volume storage chamber. In some such embodiments, the dispensing valve is disposable outside of the housing, and is movable between (i) a storage position located at least partially within the housing, and (ii) a dispensing position located at least partially outside of the housing.

In some embodiments, the dispensing valve includes a valve body defining an axially-extending valve seat and at least one flow aperture extending through at least one of the valve body and valve seat. The valve member overlies the valve seat, and is movable radially between the normally closed position with the valve member engaging the valve seat, and the open position with at least a segment of the valve member spaced radially away from the valve seat to connect the valve opening in fluid communication with the at least one flow aperture and thereby allow the passage of fluid from the at least one flow aperture through the valve opening. In some such embodiments, the valve body defines the outlet surface oriented at an acute angle relative to the dispensing axis. In some embodiments, the dispensing valve includes a dispensing tip defining the outlet surface oriented at an acute angle relative to the dispensing axis.

In accordance with another aspect, the present invention is directed to an apparatus for storing fluid and dispensing multiple portions of the stored fluid therefrom. The apparatus comprises first means defining a variable-volume storage chamber for receiving therein the fluid; second means for controlling the flow of fluid dispensed from the first means, the second means includes an inlet coupled in fluid communication with the variable volume storage chamber; and third means in fluid communication with the inlet and defining a normally-closed opening. The third means is responsive to fluid at the valve inlet exceeding an opening pressure to move between (i) a normally closed position, and (ii) an open position permitting fluid flow through the third means. The second means defines a dispensing axis defining a direction substantially along which fluid is dispensed from the second means.

Fourth means are oriented at an acute angle relative to the dispensing axis for preventing the collection of residual dispensed fluid thereon. The apparatus further comprises fifth means coupled between the variable-volume storage chamber and the second means for moving fluid from the variable volume storage chamber through the second means.

In some embodiments, the apparatus further comprises sixth means for operatively engaging the fifth means. The fifth means includes a compressible member defining a compression chamber coupled in fluid communication with the variable-volume storage chamber and the second means and movable in response to movement of the sixth means between (i) a first position wherein the compression chamber defines a first volume, and (ii) a second position wherein the compression chamber defines a second volume less than the first volume. Movement of the compressible member from the first position to the second position pressurizes fluid in the compression chamber above the opening pressure and moves the third means to the open position to dispense fluid therethrough.

In some embodiments, the first means is a container, the second means is a one-way valve, the third means is an elastic valve member, the fourth means is an outlet surface of the one-way valve over which dispensed fluid flows, the fifth means is a pump, and the sixth means is a manually engageable actuator.

In accordance with another aspect, the present disclosure is directed to an apparatus for storing fluid and dispensing multiple portions of the stored fluid therefrom. The apparatus comprises a container defining a variable-volume storage chamber for hermetically sealing and storing therein multiple portions of the fluid. A dispensing valve of the apparatus includes a valve inlet coupled in fluid communication with the variable-volume storage chamber, and an elastic valve member in fluid communication with the valve inlet and defining a normally-closed valve opening. The elastic valve member is responsive to fluid at the valve inlet exceeding a valve opening pressure to move between (i) a normally closed position hermetically sealing the one-way valve and variable-volume storage chamber with respect to ambient atmosphere, and (ii) an open position permitting the flow of fluid through the valve opening. The apparatus further comprises a manually engageable actuator, and a pump including a compressible member defining a compression chamber coupled in fluid communication with the variable-volume storage chamber and the one-way valve. The compressible member is movable in response to movement of the actuator between (i) a first position wherein the compression chamber defines a first volume, and (ii) a second position wherein the compression chamber defines a second volume less than the first volume. Movement of the compressible member from the first position to the second position pressurizes fluid in the compression chamber above the valve opening pressure and, in turn, moves the elastic valve member to the open position to dispense fluid therethrough.

In some embodiments, the apparatus further comprises a check valve coupled in fluid communication between the compression chamber and the variable-volume storage chamber. The check valve allows the flow of fluid therethrough in the direction from the variable-volume storage chamber into the compression chamber.

In some embodiments, the apparatus further comprises a housing receiving therein the variable-volume storage chamber. In some such embodiments, the dispensing valve is disposable outside of the housing. In some such embodiments, the dispensing valve is movable between (i) a storage position located at least partially within the housing, and (ii) a dispensing position located at least partially outside of the housing. In some such embodiments, the dispensing valve is pivotally mounted on the housing and movable between the storage and dispensing positions. In some such embodiments, the compressible member is mounted within the housing, and the apparatus further comprises a flexible tube coupled in fluid communication between the compressible member and the dispensing valve. In some embodiments, the compressible member stores sufficient energy when moving from the first position to the second position to drive the compressible member from the second position back to the first position. In some embodiments the compressible member is elastic.

In some embodiments, the manually engageable actuator is mounted on the housing, drivingly coupled to the compressible member, and movable with the compressible member between the first and second positions. In some such embodiments, the manually engageable actuator is pivotally mounted on the housing and movable between the first and second positions. In some embodiments, the manually engageable actuator is movable between (i) a storage position located at least partially within the housing, and (ii) a dispensing position located at least partially outside of the housing. In some embodiments, the housing includes a shroud defining a recess receiving therein the dispensing valve to protect the valve during at least one of transport and storage. In some embodiments, the container is disposable, and the housing is configured to receive at least one fresh container after disposing of a used container. In some embodiments, the housing is a box and the variable-volume storage chamber is defined by a flexible pouch received within the box.

In some embodiments, the housing includes a base defining a chamber for receiving therein the variable-volume storage chamber, and a cover mounted on the base and movable relative thereto for installing and/or removing the variable-volume storage chamber. Preferably, the manually engageable actuator is movably mounted on the cover. In some such embodiments, the actuator includes a first lever arm located outside the cover, and at least one second lever arm located inside the cover and drivingly coupled between the first lever arm and the compressible member. In some such embodiments, the first and second lever arms are pivotally mounted on the cover.

In some embodiments, the dispensing valve includes a valve body defining an axially-extending valve seat and at least one flow aperture extending through at least one of the valve body and valve seat. The elastic valve member overlies the valve seat, and is movable radially between the normally closed position with the valve member engaging the valve seat, and the open position with at least a segment of the valve member spaced radially away from the valve seat to connect the valve opening in fluid communication with the at least one flow aperture and thereby allow the passage of fluid from the at least one flow aperture through the valve opening.

Some embodiments further comprise a sterile fluid received within the storage chamber. In these embodiments, the variable-volume storage chamber and dispensing valve maintain the fluid within the storage chamber sterile and hermetically sealed with respect to ambient atmosphere throughout storage and dispensing of fluid through the dispensing valve. In some embodiments, the fluid is selected from the group including a milk-containing fluid, soy-containing fluid, non-dairy creamer, baby formula, low-acid fluid, and dairy-based fluid.

In some embodiments, the apparatus comprises a sealing surface located between the pump or dispensing valve and the variable-volume storage chamber. In these embodiments, the sealing surface and/or the dispensing valve or pump is movable relative to the other between (i) a sealing position hermetically sealing the pump and/or dispensing valve relative to the variable-volume storage chamber to thereby prevent fluid flow therebetween, and (ii) a non-sealing position allowing fluid flow therebetween. In some such embodiments, the container defines a sterile variable-volume storage chamber on one side of the sealing surface, and a sterile chamber in fluid communication with at least one of the pump and dispensing valve on an opposite side of the sealing surface.

In accordance with another aspect, the present disclosure is directed to an apparatus for storing fluid and dispensing multiple portions of the stored fluid therefrom. The apparatus comprises first means defining a variable-volume storage chamber for hermetically sealing and storing therein multiple portions of the fluid and second means for controlling the flow of fluid dispensed from the first means. The second means includes an inlet coupled in fluid communication with the variable-volume storage chamber, and third means in fluid communication with the inlet. The third means defines a normally-closed opening and is responsive to fluid at the inlet exceeding a threshold pressure for moving between (i) a normally closed position hermetically sealing the second means and variable-volume storage chamber with respect to ambient atmosphere, and (ii) an open position permitting fluid flow through the opening. The apparatus further comprises fourth means for forming a compression chamber coupled in fluid communication with the variable-volume storage chamber and the second means for moving between (i) a first position wherein the compression chamber defines a first volume, and (ii) a second position wherein the compression chamber defines a second volume less than the first volume. Movement of the fourth means from the first position to the second position pressurizes fluid in the compression chamber above the threshold pressure and moves the third means to the open position to dispense fluid therethrough. Fifth means are provided for manually moving the fourth means from the first position to the second position. In some embodiments, the first means is a container, the second means is a one-way valve, the third means is an elastic valve member, the fourth means is a pump, and the fifth means is a manually engageable actuator.

In accordance with another aspect, the present disclosure is directed to an apparatus for storing fluid and dispensing multiple portions of the stored fluid therefrom. The apparatus comprises a container defining a variable-volume storage chamber for hermetically sealing and storing therein multiple portions of the fluid. A dispensing valve of the apparatus includes a valve inlet coupled in fluid communication with the variable-volume storage chamber and an elastic valve member in fluid communication with the valve inlet and defining a normally-closed valve opening. The elastic valve member is responsive to fluid at the valve inlet exceeding a valve opening pressure to move between (i) a normally closed position hermetically sealing the one-way valve and variable-volume storage chamber with respect to ambient atmosphere, and (ii) an open position permitting fluid flow through the valve opening. A compressible member of the apparatus defines a palm engaging surface engageable with the palm of a user's hand, and a compression chamber coupled in fluid communication with the variable-volume storage chamber and one-way valve. The palm engaging surface is depressible by the user's palm between (i) a first position wherein the compression chamber defines a first volume, and (ii) a second position wherein the compression chamber defines a second volume less than the first volume. Movement of the compressible member from the first position to the second position pressurizes fluid received through the inlet of the dispensing valve above the valve opening pressure and moves the elastic valve member to the open position to dispense fluid therethrough.

In some embodiments, the apparatus further comprises a frame supporting thereon the compressible member and positioned relative thereto such that the palm engaging surface is engageable with a user's palm. The frame is engageable with a plurality of fingers of the same hand to allow simultaneous gripping of the frame and depressing of the palm engaging surface between the first and second positions.

In accordance with another aspect, the present disclosure is directed to an apparatus comprising a hermetically sealed, sterile storage chamber, a dispensing valve including a hermetically sealed, sterile inlet; a pump coupled between the dispensing valve and storage chamber; and a sealing surface located between the dispensing valve and storage chamber. The sealing surface and/or the dispensing valve is movable relative to the other between (i) a sealing position hermetically sealing the dispensing valve relative to the variable-volume storage chamber to thereby prevent fluid flow therebetween, and (ii) a non-sealing position allowing fluid flow therebetween.

In some embodiments, the dispensing valve is at least one of pullable, pushable and rotatable relative to the storage chamber to move the sealing surface between the sealing and non-sealing positions. In some embodiments, the sealing surface is defined by a pierceable wall, and the apparatus further comprises at least one piercing portion engageable with the pierceable wall. The piercing portion and/or the pierceable wall is movable relative to the other between a first position wherein the pierceable portion is not piercing the pierceable wall, and a second position wherein the pierceable portion is piercing the pierceable wall and the storage chamber is in fluid communication with the dispensing valve for allowing fluid flow from the storage chamber therethrough.

In accordance with another aspect, the present disclosure is directed to a method comprising the following steps:

(i) providing a container defining a variable-volume storage chamber; a dispensing valve including a valve inlet coupled in fluid communication with the variable-volume storage chamber and an elastic valve member in fluid communication with the valve inlet and defining a normally-closed valve opening, a manually engageable actuator; and a pump including a compressible member defining a compression chamber coupled in fluid communication with the variable-volume storage chamber;

(ii) hermetically sealing and storing multiple portions of a fluid in the variable-volume storage chamber, and (iii) manually engaging and moving the actuator between (i) a first position wherein the compression chamber defines a first volume, and (ii) a second position wherein the compression chamber defines a second volume less than the first volume, pressurizing fluid in the compression chamber to a pressure exceeding a valve opening pressure and, in turn, moving with the pressurized fluid the elastic valve member between (i) a normally closed position hermetically sealing the one-way valve and variable-volume storage chamber with respect to ambient atmosphere, and (ii) an open position permitting fluid flow through the valve opening.

In some embodiments, the method further comprises the step of storing sufficient energy in the compressible member when moving from the first position to the second position, and using the stored energy to drive the compressible member from the second position back to the first position. In some embodiments, the method further comprises providing a housing receiving therein the variable-volume storage chamber, and moving the dispensing valve between (i) a storage position located at least partially within the housing, and (ii) a dispensing position located at least partially outside of the housing. In some embodiments, the method further comprises the steps of providing a housing receiving therein the variable-volume storage chamber, and moving the manually engageable actuator between (i) a storage position located at least partially within the housing, and (ii) a dispensing position located at least partially outside of the housing.

Some embodiments further comprise the steps of providing a dispensing valve defining a dispensing axis extending in a direction substantially along which fluid is dispensed from the valve, and an outlet surface over which dispensed fluid flows; and orienting the outlet surface at an acute angle relative to the dispensing axis and substantially preventing the collection of residual dispensed fluid thereon.

In some embodiments, the method further comprises the steps of storing a sterile fluid in the variable-volume storage chamber, and maintaining the fluid within the storage chamber sterile and hermetically sealed with respect to ambient atmosphere throughout storage and dispensing of fluid through the dispensing valve. In some embodiments, the fluid is selected from the group including a milk-containing fluid, soy-containing fluid, non-dairy creamer, baby formula, low-acid fluid, and dairy-based fluid.

In some embodiments, the method further comprises the steps of providing a sealing surface located between (i) the pump and/or dispensing valve, and (ii) the variable-volume storage chamber; and moving (i) the sealing surface and/or (ii) the dispensing valve and/or pump relative to the other between (i) a sealing position hermetically sealing the pump and/or dispensing valve relative to the variable-volume storage chamber and preventing fluid flow therebetween, and (ii) a non-sealing position allowing fluid flow therebetween. Some such embodiments further comprise the steps of providing a sterile variable-volume storage chamber on one side of the sealing surface, and a sterile chamber in fluid communication with the pump and/or dispensing valve on an opposite side of the sealing surface. Some embodiments further comprise the steps of pulling, pushing and/or rotating the dispensing valve relative to the container to move the sealing surface between the sealing and non-sealing positions.

In some embodiments, the method further comprises the steps of providing an actuator defined by a palm engaging surface located on the compressible member, engaging the palm engaging surface with the palm of a user's hand, and depressing the palm engaging surface and compressible member between the first and second positions. Some such embodiments further comprise the steps of providing a frame supporting thereon the compressible member and positioned relative thereto such that the palm engaging surface is engageable with a user's palm, and gripping with a plurality of fingers the frame and simultaneously engaging with the palm of the same hand the palm engaging surface and depressing the palm engaging surface between the first and second positions.

One advantage of the apparatus and method of the present invention is that the dispensing valve can hermetically seal the product in the variable-volume storage chamber throughout the shelf life and multiple dispensing of the product. As a result, non-acid products, such as milk-based products, do not require refrigeration during shelf life or usage of the product.

Other advantages of the apparatus and method of the present invention will become readily apparent in view of the following detailed description and accompanying drawings.

DETAILED DESCRIPTION OF PREFERRED EMBODIMENTS

Figure 1:
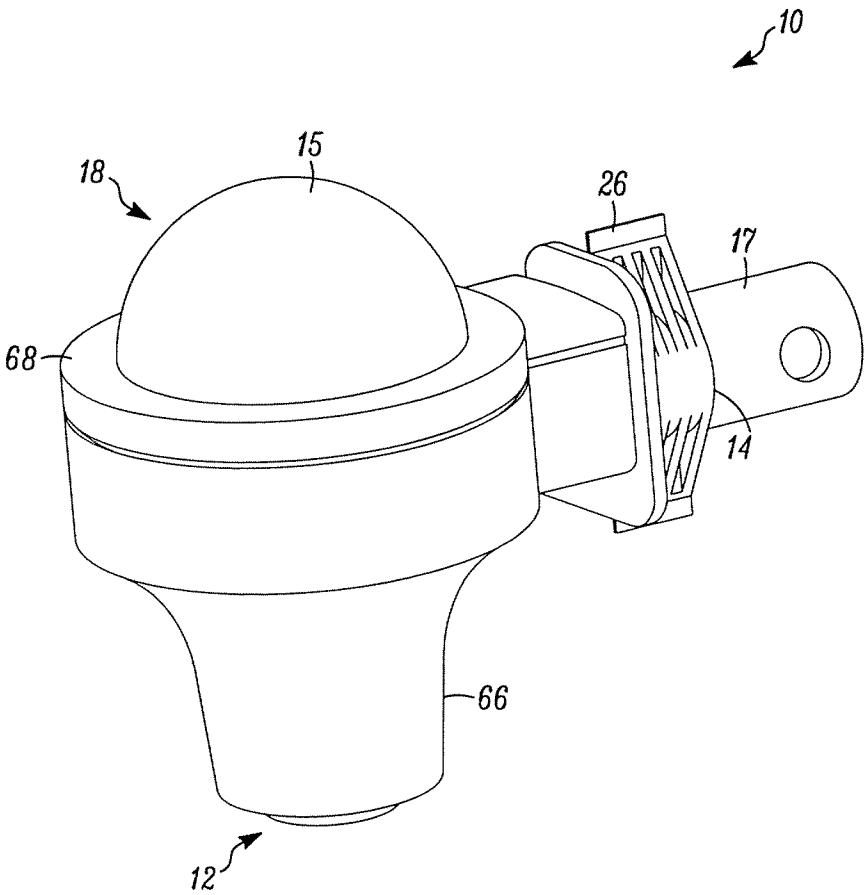
FIG. 1 is a perspective view of a first embodiment of a dispensing valve and pump of an apparatus for storing and dispensing multiple portions of fluid.

In FIGS. 1 through 4, a first embodiment of an apparatus is indicated generally by the reference numeral 10. The apparatus 10 comprises a one-way dispensing valve 12, a manually-engageable pump 18, a reservoir in the form of a flexible pouch 22 (FIG. 4) defining a variable volume storage chamber 24, and a tube 14 connected in fluid communication between the variable-volume storage chamber and the pump and dispensing valve. The apparatus 10 is used to hermetically seal with respect to ambient atmosphere a substance within the pouch 22 and to dispense the substance through the one-way valve 12. The substance may take the form of any of numerous different products that are currently known, or that later become known, including without limitation any of numerous different food and beverage products, such as milk or dairy-based products, including milk, evaporated milk, condensed milk, cream, half-and-half, baby formula growing up milk, yogurt, soup, low-acid fluids, no-acid fluids, and any of numerous other liquid nutrition products, ice cream (including dairy and non-diary, such as soy-based ice cream), juice, syrup, coffee, condiments, such as ketchup, mustard, and mayonnaise, aromas, such as coffee aroma, flavors, such as cocoa, vanilla, cappuccino, and/or fruit flavors, and biological or biopharmaceutical products, such as vaccines, monoclonal antibodies and gene therapies.

The reservoir 24 includes a fitting 26 connected to the end of the tube 14 opposite the one-way valve 12 and coupled in fluid communication between the tube and variable-volume storage chamber 24 for allowing the passage of substance from the storage chamber into the tube. Alternatively, the tube may be heat sealed, welded, adhesively attached, or otherwise connected to the reservoir, or material forming the reservoir, such as a plastic or laminated pouch, in any of numerous different ways that are currently known, or that later become known. As described further below, the apparatus 10 may be mounted within a dispenser including a housing for enclosing the components as illustrated, and that includes access panels or other openings in a manner known to those of ordinary skill in the pertinent art to allow access to the interior of the housing to install a fresh reservoir when the reservoir is emptied.

Figure 2:
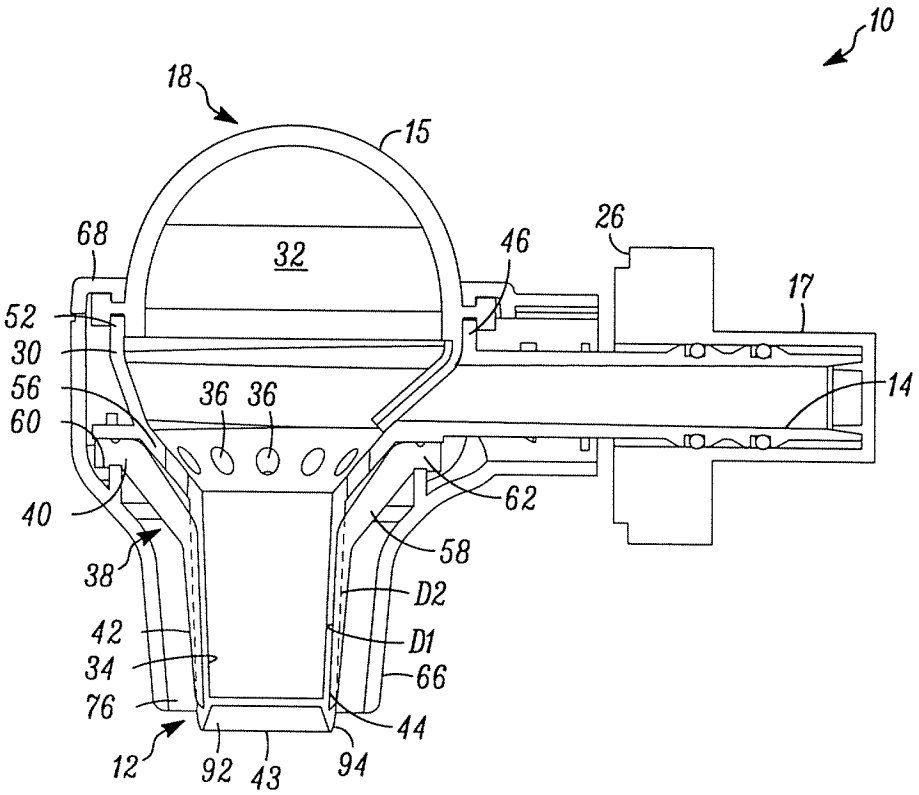
FIG. 2 is a cross-sectional view of the dispensing valve and pump of FIG. 1.
Figure 3:
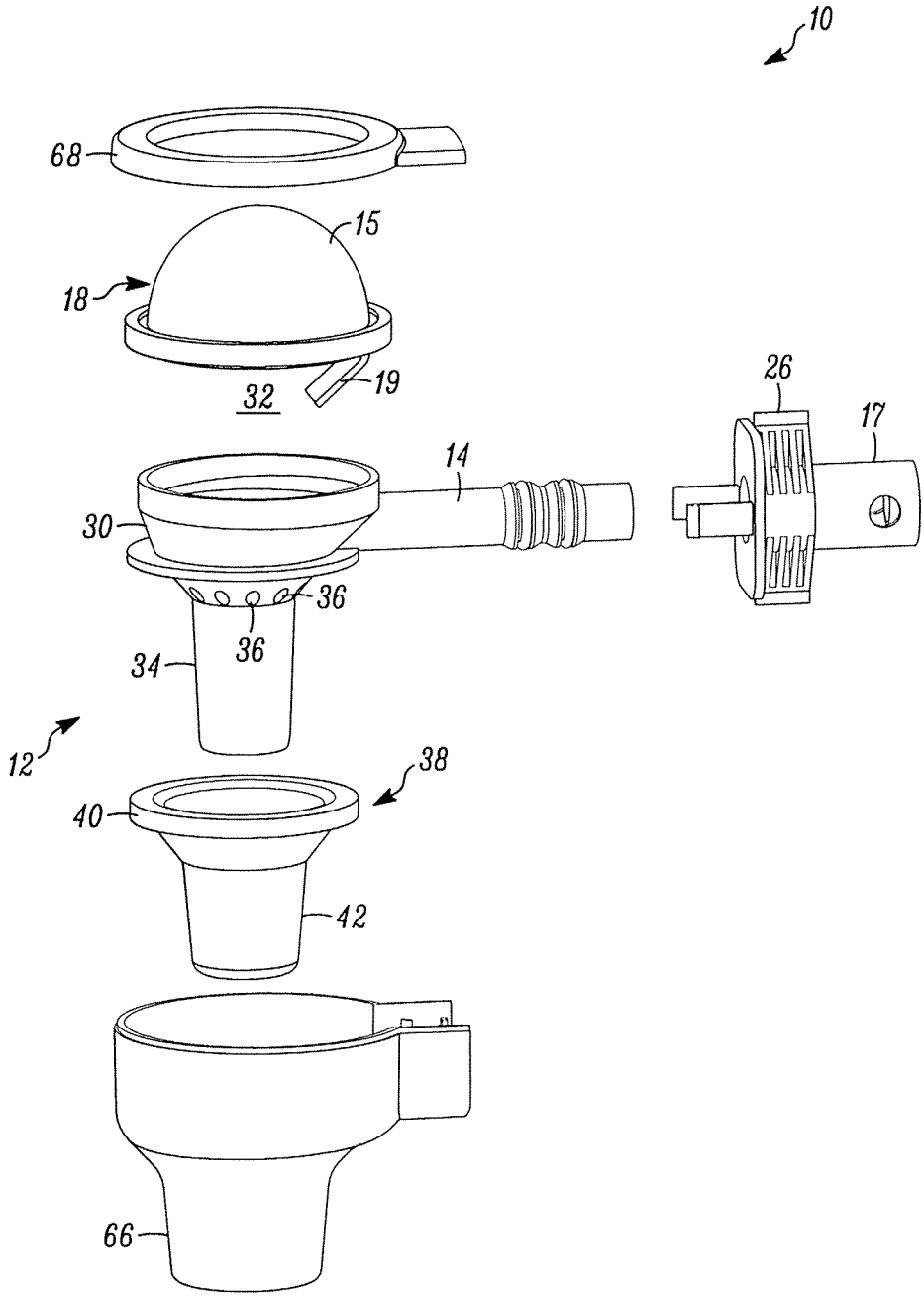
FIG. 3 is an exploded view of the dispensing valve and pump of FIG. 1.

As shown in FIGS. 2 and 3, the one-way valve 12 includes a valve body 30 defining an inlet 32, an axially-extending valve seat 34, a plurality of flow apertures 36 axially extending through the valve body 30 adjacent to the valve seat 34 and coupled in fluid communication with the inlet 32. The one-way valve 12 further includes a valve cover 38 formed of an elastic material and including a cover base 40 mounted on the valve body 30 and fixedly secured against axial movement relative thereto, and a valve portion 42 overlying the valve seat. The valve portion 42 defines a predetermined radial thickness and an inner diameter D1 less than the outer diameter D2 of the valve seat 34 to thereby form an interference fit therebetween, as indicated by the overlapping lines in FIG. 2. As can be seen, the valve portion 42 and the valve seat 34 define a normally closed, axially-extending valve opening or seam 44 therebetween. As described further below, the valve portion 42 is movable radially between a normally closed position, as shown in FIG. 2, with the valve portion 42 engaging the valve seat 34, and an open position (not shown) with at least a segment of the valve portion 42 spaced radially away from the valve seat 34 to connect the valve opening 44 in fluid communication with the flow apertures 36 to thereby allow the passage of substance from the flow apertures 36 through the valve opening 44. As also shown in FIG. 2, a fitting 46 is fixedly secured to the valve body 30 and forms a hermetic seal therebetween. The fitting 46 is hermetically connected to the inlet tube 14 to thereby allow the passage of substance from the tube 14, through the valve inlet 32 and, in turn, through the flow apertures 36 and valve opening 44 as described further below.

As shown in FIG. 2, the valve body 30 further includes a body base 52 fixedly secured to the pump 18. The valve body 30 also defines a first substantially frusto-conical portion 56 extending between the body base 52 and the valve seat 34. As can be seen, the flow apertures 36 extend axially through the first substantially frusto-conical portion 56 such that the radially inner edges of the flow apertures 36 are substantially contiguous to the valve seat 34. The valve cover 38 includes a second substantially frusto-conical shaped portion 58 extending between the cover base 40 and valve portion 42, overlying the first substantially frusto-conical shaped portion 56 of the valve body 30, and forming an interference fit therebetween.

As can be seen in FIG. 2, the substantially frusto-conical and valve portions 58 and 42, respectively, of the valve cover 38 each define a progressively decreasing radial thickness when moving axially in a direction from the substantially frusto-conical portion 58 toward the valve portion 42. As a result, progressively less energy is required to open the valve when moving axially in the direction from the interior toward the exterior of the valve. Substance is dispensed through the valve by pumping the substance at a sufficient pressure through the flow apertures 36 to open the valve opening or seam 44 (the "valve opening pressure"). Once the pressurized substance enters the valve opening or seam 44, progressively less energy is required to radially open respective axial segments of the valve cover when moving axially in the direction from the interior toward the exterior of the valve. As a result, the valve itself operates as a pump to force the substance through the normally-closed valve opening 44. Preferably, a substantially annular segment of the valve portion 42 engages the valve seat 34 substantially throughout any period of dispensing substance through the valve opening 44 to maintain a hermetic seal between the valve opening 44 and ambient atmosphere. If desired, the valve can be configured in other ways in order to require progressively less energy to open the valve (i.e., to decrease the valve opening pressure) when moving in the axial direction from the interior toward the exterior of the valve. For example, the valve cover 38 and valve body 30 may define a decreasing degree of interference therebetween when moving in a direction from the interior toward the exterior of the valve assembly. Alternatively, the valve seat 34 may define a progressively increasing diameter when moving axially in a direction from an inner end toward a distal end of the valve seat (or from the interior end toward the exterior end of the valve seat). If desired, the valve assembly may include only one of these features, or may include any desired combination of these features in order to achieve the desired performance characteristics.

The valve assembly 12 otherwise is preferably constructed in accordance with the teachings of the following commonly assigned, co-pending patent applications which are hereby incorporated by reference in their entireties as part of the present disclosure: U.S. patent application Ser. No. 11/295,274, filed Dec. 5, 2005, entitled "One-Way Valve And Apparatus Using The Valve", U.S. patent application Ser. No. 11/295,251, filed Dec. 5, 2005, entitled "Method Of Using One-Way Valve And Related Apparatus", U.S. Provisional Patent Application Ser. No. 60/633,332, filed Dec. 4, 2004, and U.S. Provisional Patent Application Ser. No. 60/644,130, filed Jan. 14, 2005, both of which are entitled "One-Way Valve, Apparatus and Method of Using the Valve", and U.S. Provisional Patent Application Ser. No. 60/757,161, filed Jan. 5, 2006, and U.S. patent application Ser. No. 11/650,102, filed Jan. 5, 2007, both of which are entitled "One-Way Valve and Apparatus and Method of Using the Valve".

In accordance with such teachings, at least one of the valve seat diameter D2, the degree of interference between the valve portion 42 and valve seat 34 (as indicated by the overlapping lines in FIG. 2), the predetermined radial thickness of the valve portion 42, and/or a predetermined modulus of elasticity of the valve cover 38 material, is selected to (1) define a predetermined valve opening pressure generated upon actuating the pump 18 that allows passage of the substance from the tube through the normally-closed valve opening 44, and (2) hermetically seal the valve 12 and prevent the ingress of bacteria or contamination through the valve opening 44 and into the valve interior in the normally closed position. In the illustrated embodiment, each of the valve seat diameter D2, the degree of interference between the valve portion 42 and valve seat 34, the predetermined radial thickness of the valve portion 42, and the predetermined modulus of elasticity of the valve cover 38 material, is selected to (i) define a predetermined valve opening pressure generated upon manually engaging and actuating the pump 18 that allows passage of the substance from the variable-volume storage chamber 24 through the valve opening 44, and (2) hermetically seal the valve opening 44 and prevent the ingress of bacteria through the valve opening and into the variable-volume storage chamber in the normally-closed position.

In the illustrated embodiment, the valve body defines a plurality of substantially circular flow apertures 36 angularly spaced relative to each other about the valve seat 34. However, as may be recognized by those of ordinary skill in the pertinent art based on the teachings herein, this flow aperture configuration is only exemplary, and may be changed as desired, or otherwise required. For example, the dispensing valve 12 may incorporate more of fewer flow apertures, and/or the flow apertures each may extend angularly about the valve seat.

As shown in FIG. 2, the valve body 30 defines an annular recess 60 and the valve cover 38 includes a corresponding annular flange 62 that is received within the annular recess 60 of the valve body 30 to secure the valve cover to the valve body and form a hermetic seal therebetween. The valve assembly 12 further includes a protective cover or shield 66 that extends annularly about the flexible valve cover 38, and extends axially from the base of the valve cover 38 to a point adjacent to the dispensing tip of the valve but spaced axially inwardly therefrom. The valve shield 66 is spaced radially relative to the second frusto-conical portion 58 and valve portion 42 of the valve cover 38 to form an annular, axially extending gap 76 therebetween. The gap 76 allows the valve cover to freely expand or move radially outwardly during dispensing of substance through the normally closed valve opening or seam 44.

As shown in FIG. 2, the dispensing tip of the valve seat 34 defines a recess 92 therein, and a very thin, annular, chamfered edge 94 formed between the recess 92 and the distal edge of the valve seat 34. As can be seen, the radial width of the chamfered edge 94 is substantially less than the axial depth of the recess 92 and the diameter of the valve seat 34 (by a magnitude in both instances of at least about 5 and preferably of at least about 10). In one embodiment, the radial width of the edge portion is within the range of about 5 mm to about 25 mm. One advantage of this configuration is that the thin, annular edge 94 substantially prevents any substance from collecting at the dispensing tip after being dispensed from the valve. Preferably, the valve 112 is mounted in a substantially vertical or upright orientation (as shown typically in FIG. 2) such that the dispensing tip is facing downwardly (either such that the axis of the valve is oriented substantially perpendicular to, or at an acute angle relative to, the horizontal). The slight surface area of the annular edge 94 substantially prevents any fluid that flows onto the surface from having sufficient surface tension to overcome the force of gravity that pulls the fluid downwardly and away from such surface. As a result, the annular edge 94 substantially prevents any fluid or other substance from collecting thereon, and thus facilitates in maintaining a clean dispensing tip.

In one embodiment, the material of the pouch 22 (FIG. 4) is an oxygen/water barrier material. An exemplary such material is a plastic laminate with an approved food contact material layer. In one such embodiment, the material is a heat-sealable film including an oxygen/water barrier layer and, preferably, an outer layer exhibiting appropriate wear and flexibility properties. Examples of suitable outer layers are nylon, either linear or biaxially orientated, polyethylene, polypropylene, and polystyrene. Examples of oxygen/water barrier materials are ethylene vinyl alcohol (EVOH) and silicon oxide. An exemplary heat-sealable material is polyethylene, such as linear low-density, ultra linear low-density, high-density or metallocene catalyzed polyethylene. An exemplary pouch material is a laminate including a nylon co-polymer, on the outside, EVOH, and metallocene catalyzed polyethylene on the inside, wherein the layers of the laminate are adhered together in a manner known to those of ordinary skill in the pertinent art. As may be recognized by those of ordinary skill in the pertinent art, if the tube is not provided as an integral part of the pouch, anti-block additives may be added to ensure good pouch-edge/tube fusion.

The tube 14 may be made of any of numerous different materials that are currently known, or that later become known. The dimensions of the tube 14 can be adapted to the type of food material or other substance to be dispensed therethrough. In some embodiments, the internal diameter of the tube is within the range of about 5 mm to about 15 mm, and preferably is within the range of about 7 mm to about 8 mm. In some such embodiments, the thickness of the tube material is within the range of about 1 mm to about 2 mm, and in one such embodiment, the thickness is about 1.5 mm. The length of the tube 14 may be set as desired or otherwise required by a particular dispensing system. As may be recognized by those of ordinary skill in the pertinent art based on the teachings herein, the materials of construction of the pouch, tube and valve assembly, may take the form of any of numerous different materials that are currently known, or that later become known for performing the functions of the respective components. Similarly, the dimensions of these components, and the manner in which these components are connected or otherwise formed, may take any of numerous different dimensions or configurations as desired or otherwise required. The tube 14 may be formed integral with the flexible pouch forming the reservoir 24, or the tube may be connected to the pouch in any of numerous different ways that are currently known, or that later become known. In one exemplary embodiment, the inlet end of the tube 14 is built into the base of the pouch 22, such as by heat-sealing, ultrasonically welding, crimping, or adhesively attaching the tube to the pouch material.

Depending on the design of the housing 16 of the dispenser, it may not be necessary to arrange the pouch within a box or other housing. However, a box can provide a convenient mechanism for holding and transporting the flexible pouch 22, and/or for mounting the pouch 22 within a dispenser housing. As described further below, in some embodiments, the box is a cardboard box of a type known to those of ordinary skill in the pertinent art. In some such embodiments, the box may define an aperture extending through a base wall thereof that allows the dispensing valve and pump assembly to be passed therethrough. Alternatively, the box may be provided with a perforated or frangible portion allowing part of the box to be removed to access the dispensing valve and pump assembly. As may be recognized by those of ordinary skill in the pertinent art based on the teachings herein, the box may be formed of any of numerous different materials, and may define any of numerous different shapes and/or configurations, that are currently known, or that later become known. In addition, the flexible pouch, dispensing valve and/or pump may be mounted within any of numerous different containers or dispensers, and the pumps may take any of numerous different configurations, such as electrically-actuated, manually-actuated, or pedal actuated pumps.

The pouch, dispensing valve and pump assembly are preferably sterilized prior to filling, by, for example, applying radiation, such as gamma or ebeam radiation thereto, or another type of sterilant, such as vaporized hydrogen peroxide ("VHP"). Then, the hermetically sealed, sterilized, empty pouch, tube and valve assemblies are aseptically filled with a liquid food, drink or other substance to be contained therein. One advantage of this filling method and construction is that it provides for improved shelf-life of the substance within the pouch, and allows the pouch to be non-refrigerated during storage and throughout the usage of the pouch (i.e., the pouch may remain non-refrigerated from the first to the last dose dispensed from the pouch).

Figure 4:
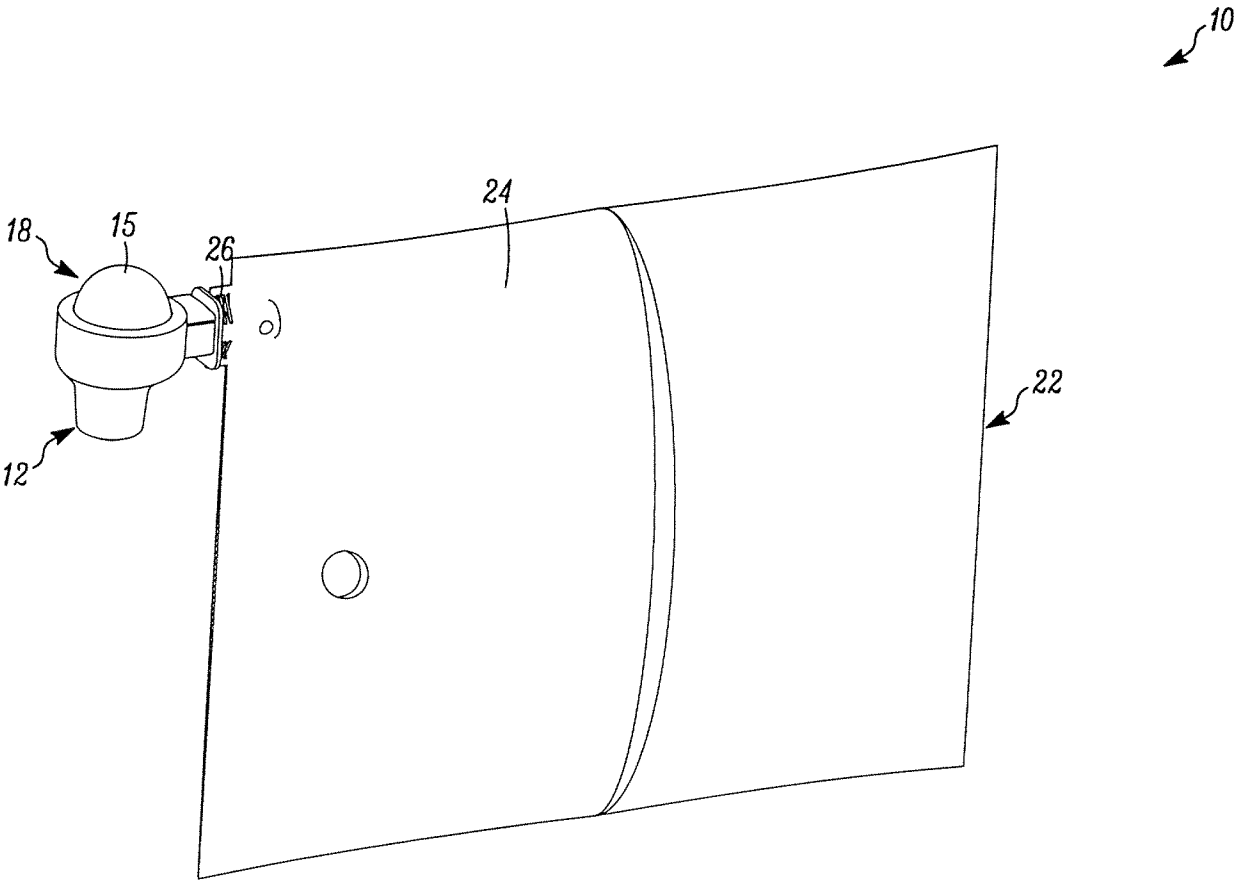
FIG. 4 is a perspective view of the dispensing valve and pump of FIG. 1 mounted on a flexible pouch defining a variable-volume storage chamber.
Figure 5:
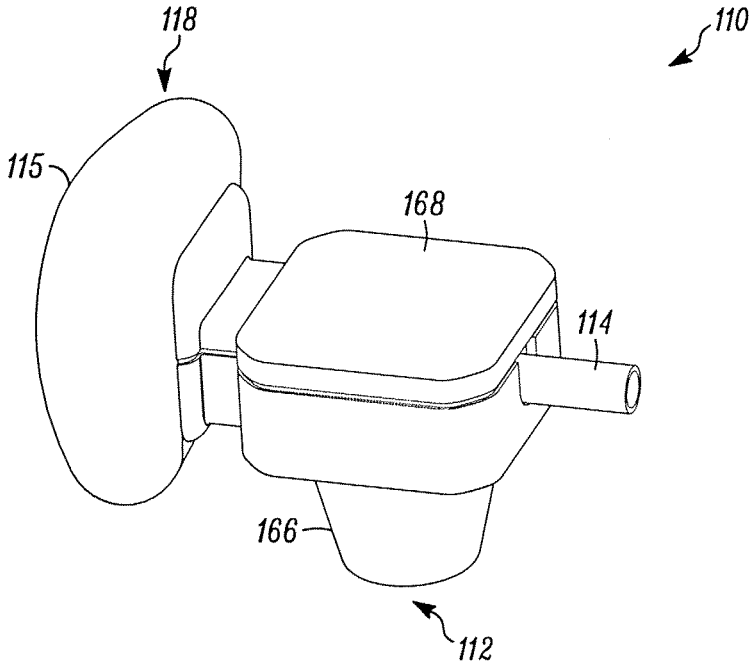
FIG. 5 is a perspective view of another embodiment of a dispensing valve and pump including a palm engaging surface for actuating the pump.
Figure 6:
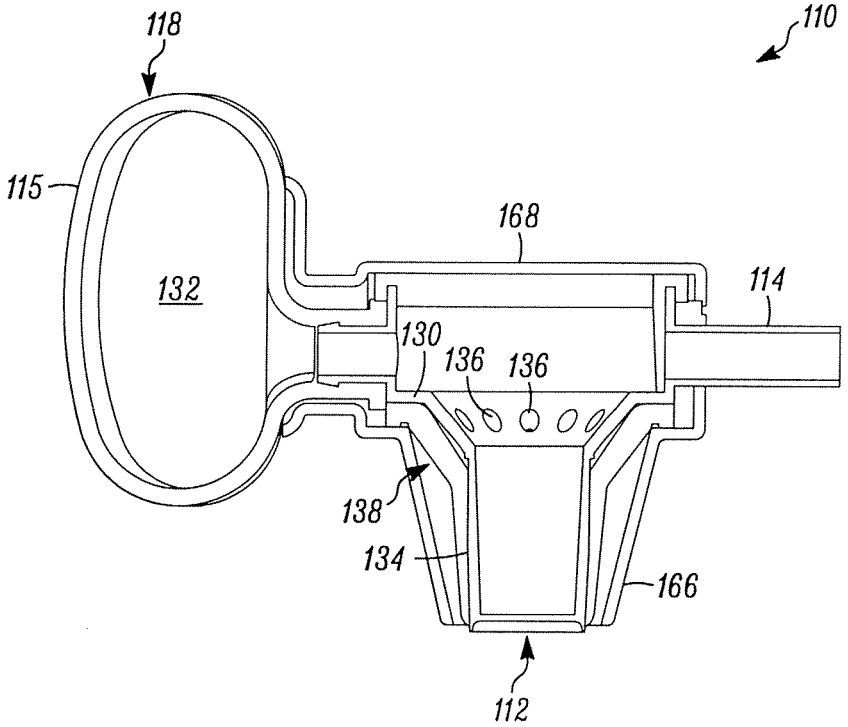
FIG. 6 is a cross-sectional view of the dispensing valve and pump of FIG. 5.
Figure 7:
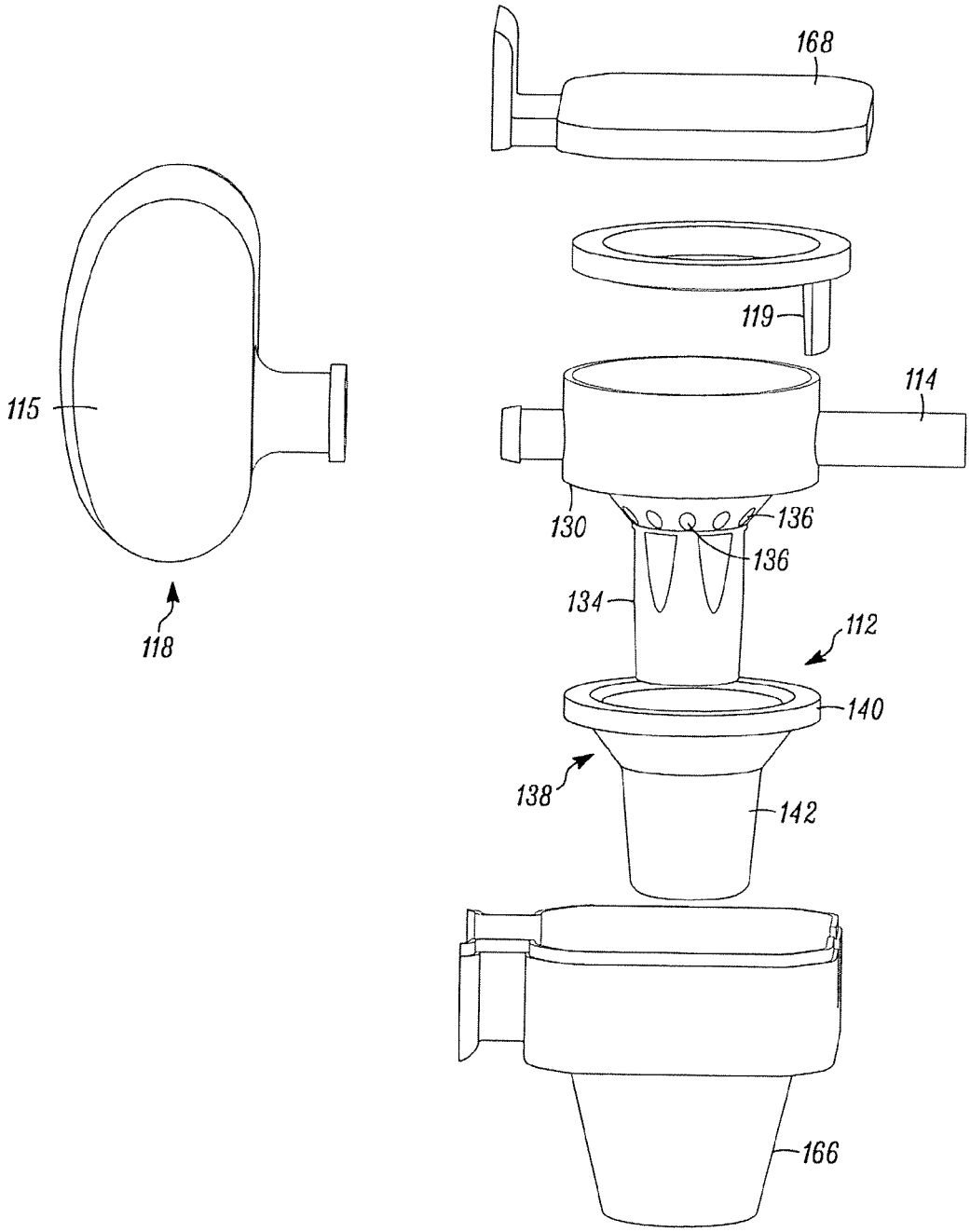
FIG. 7 is an exploded view of the dispensing valve and pump of FIG. 5.

As shown in FIGS. 1-4, the pump 18 includes a manually engageable, dome-shaped actuator 15 for dispensing substantially metered amounts of fluid from a pouch 22 (FIG. 4) defining the variable-volume storage chamber 24 through the valve. The dispensing valve and pump assembly includes an integral rigid tube 14 defining on an upstream end thereof a mounting flange 17 for mounting the tube, dispensing valve and pump assembly to a housing (illustrated below) that contains therein the flexible pouch 22 (FIG. 4). As described further below, the housing and pouch 22 may be made of any of numerous different materials, and/or may take any of numerous different shapes and/or configurations that are currently known or that later become known.

The dome-shaped actuator 15 is made of an elastomeric material that is flexible and can be manually engaged and pressed inwardly to pump fluid from the variable-volume storage chamber 24 through the one-way valve 12. As shown in FIGS. 2 and 3, the one-way valve 12 includes a check valve in the form of a flap 19 extending inwardly from the actuator 15, and the valve body 30 and actuator 15 cooperate to define a compression chamber 32 for receiving therein from the variable-volume storage chamber 24 each dosage, discrete portion or serving of fluid to be dispensed. The compression chamber 32 is in fluid communication with the flow apertures 36 to thereby allow the passage of fluid from the compression chamber 32 through the flow apertures 36 and, in turn, through the normally-closed valve opening or seam 44.

The one-way valve 12 also includes an inlet passageway 48 extending through the tube 14 and connectable in fluid communication with the variable-volume storage chamber 24 (FIG. 4). The one-way valve 12 may be connected directly to the variable-volume storage chamber 24 and then welded or otherwise sealed to the pouch 22 so as to prevent contaminants from entering the compression chamber or valve. Alternatively, the inlet passageway 48 can be coupled to a flexible tube, and the flexible tube can, in turn, connect the valve 12 to the storage chamber 24. As can be seen, in its normally-closed position, the flap 19 separates the compression chamber 32 from the inlet passageway 48 and storage chamber 24. Thus, during the downward stroke of the dome-shaped actuator 15, the flap 19 prevents the fluid within the compression chamber 32 from flowing rearwardly back into the inlet aperture 48 and variable-volume storage chamber 24, and in turn allows the manually depressed actuator to pressurize the fluid in the compression chamber sufficiently to overcome the valve opening pressure and be dispensed through the valve. Then, during the upward or return stroke of the dome-shaped actuator 15, the suction force or vacuum created within the compression chamber causes the flap 19 to flex away from the inlet aperture, to thereby place the compression chamber 32 in fluid communication with the inlet passageway 48 and allow the next dose of fluid to flow into the compression chamber.

In the operation of the dispensing valve 12 and pump 18, the dome-shaped actuator 15 is pressed downward, such as my manual engagement, to pressurize and in turn displace a substantially predetermined volume of fluid located within the compression chamber 32. The resulting fluid pressure within the compression chamber 32 causes the flap 19 to seal itself against the valve body wall surrounding the inlet passageway 48 to thereby prevent fluid communication between the inlet passageway and compression chamber. If desired, the flap 19 and/or the wall surrounding the inlet passageway 48 may be angled to assist in creating a seal between the flap and wall. A substantially predetermined volume of fluid then moves from the compression chamber 32 through the flow apertures 36, into the valve seat 34, and out through the valve opening 44. When the actuator 15 is pressed downwardly, the chamber 32 is emptied or substantially emptied. When the user releases the actuator 15, a vacuum is created within the chamber 32 and the flap 19 swings outwardly away from passageway 48 which, in turn, allows fluid to flow from the reservoir 24 into the compression chamber 32. If desired, the valve seat 34 may define a plurality of axially-extending flats positioned downstream each of a plurality of flow apertures 36 to increase the width of a portion of the seam between the valve seat and valve cover. The flats allow fluid to travel more easily into the normally-closed valve opening through the flow apertures, and thus may facilitate in reducing the force required to manually depress the actuator.

As may be recognized by those of ordinary skill in the pertinent art based on the teachings herein, the actuator 15, and the compression chamber 32 may take any of numerous different shapes and/or configurations, and/or may be formed of any of numerous different materials that are currently known, or that later become known for performing the functions of these components. For example, the compression chamber 32 may define a curvilinear shape to facilitate engagement between the underside of the dome-shaped actuator and compression chamber on the downward stroke of the actuator. Similarly, the underside of the actuator may form a more traditional piston shape, such as a cylindrical protrusion, that is slidably received within a correspondingly shaped compression chamber or bore. In addition, as described further below, the actuator may include a lever or other operator that is manually engageable to depress the actuator and, in turn, dispense metered amounts or substantially metered amounts of fluids from the variable-volume storage chamber and through the one-way valve.

As shown in FIG. 2, the fitting 26 for connecting the pump and valve assembly to the reservoir is a tubular connecting component that is hermetically connected on its inlet end to the pouch 24 and is hermetically connected on its outlet end to the pump and valve assembly. Although the fitting 26 is illustrated as a tubular structure, any of numerous other connection mechanisms or devices equally may be employed. The fitting further includes a pouch-pump engagement device described in further detail below.

Figure 8:
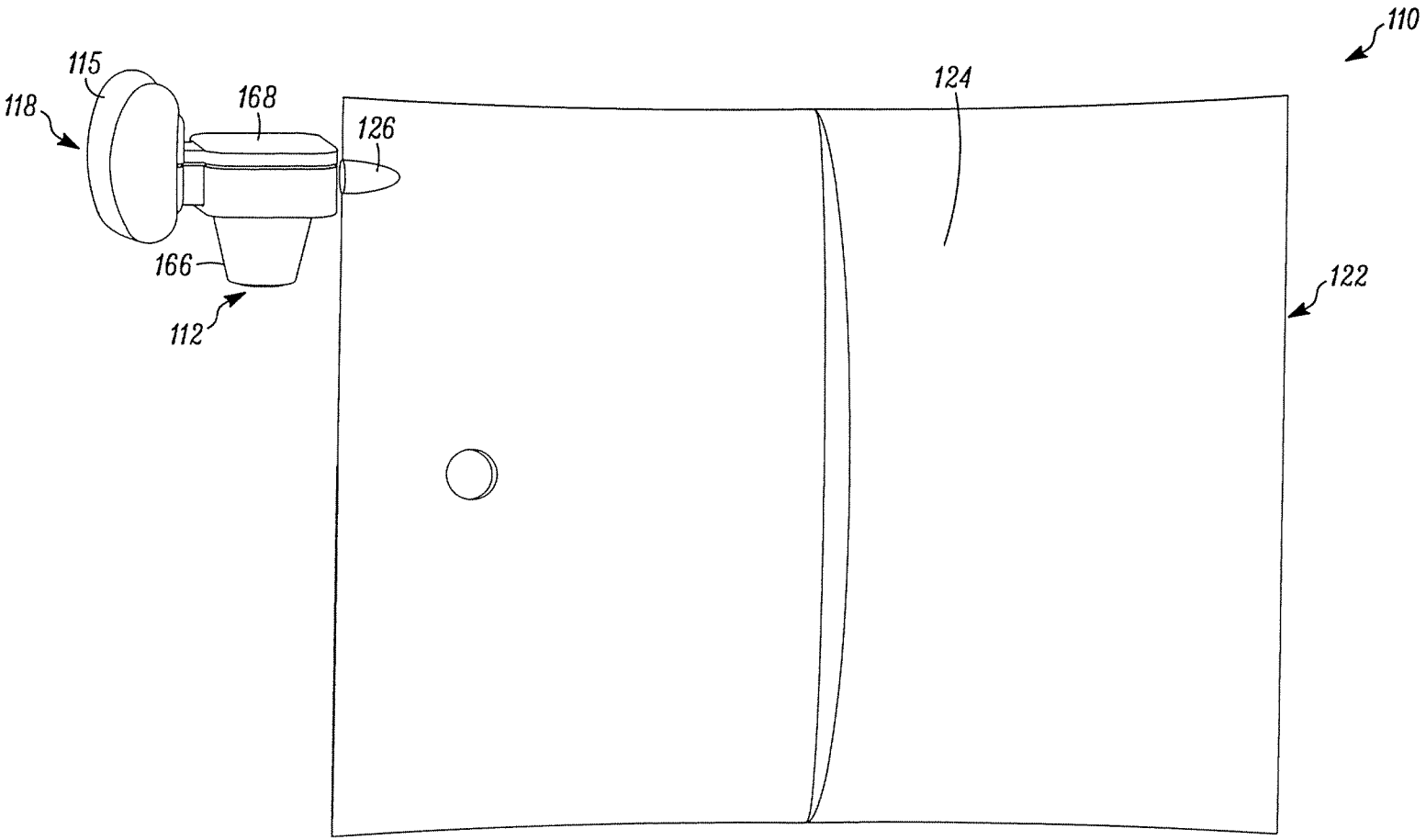
FIG. 8 is a perspective view of the dispensing valve and pump of FIG. 5 mounted on a flexible pouch defining a variable-volume storage chamber.

In FIGS. 5-8, another embodiment of an apparatus is indicated generally by the reference numeral 110. The assembly 110 is similar in many respects to assembly 10 described above with reference to FIGS. 1-4, and therefore like reference numerals preceded by the numeral "1" are used to indicate like elements. A one-way valve assembly 112 includes a manually engageable, flexible actuator 115, a valve body 130, and a valve portion 142 partially overlying the valve body 130. The actuator 115 can be compressed to dispense substantially metered amounts of fluid from a pouch 122 that defines a variable volume storage chamber (FIG. 8). The actuator 115 is hollow and forms part of a compression chamber 132 that is bounded by the interior of the actuator 115, the valve body 130 and a top cover 168. The top cover 168 is mechanically engaged with a bottom cover 166 to substantially surround and protect the valve assembly. As can be seen, the actuator 115 has a shape that is preferably ergonomically designed to be engaged by a user's palm, and may be any shape suitable for engagement with a user's hand. When the actuator 115 is pushed inwardly or otherwise depressed, the volume of the compression chamber 132 is reduced to force fluid through the seam formed between the valve body 130 and valve cover 142, and out through a nozzle 143 formed at the output end of the valve body 130. The valve assembly 112 is connected to a storage chamber defined by the pouch 122 via the tube 114, which is in fluid communication with the compression chamber 132. The valve body 130 is in fluid communication, and is preferably integrally connected to, a rigid tube 114 for providing an air-tight passageway between the variable-volume storage chamber, e.g., the chamber defined by the pouch 122, and the compression chamber 132. A check valve 119 is positioned at the interface between compression chamber 132 and the tube 114 to prevent fluid flow from compression chamber 132 toward the tube 114.

In FIGS. 9-12 another apparatus embodying the present invention is indicated generally by the reference numeral 210. The apparatus 210 is similar in many respects to the apparatus 10 and 110 described above, and therefore like reference numerals preceded by the numeral "2", or preceded by the numeral "2" instead of the numeral "1", are used to indicate like elements. The assembly 210 includes a one-way valve assembly 212 having a manually engageable, dome-shaped pump 218 and actuator 215 made of a flexible elastomeric material that can be manually engaged and pressed inwardly to operate the actuator and thereby pump fluid from the storage chamber through the valve assembly 212. In one currently preferred embodiment, the actuator 215 is integral with the tube 214 that connects the valve assembly 212 with a storage chamber defined by the collapsible pouch 222. In one such embodiment, the actuator 215 and tube 214 are molded as a single piece. However, as may be recognized by those of ordinary skill in the pertinent art based on the teachings herein, the pump 218 and actuator 215 equally may be molded or otherwise made separate from the inlet tube 214A connected between the pump 218 and the variable-volume storage chamber 224, and the outlet tube 214B connected between the pump and the dispensing valve.

Figure 12:
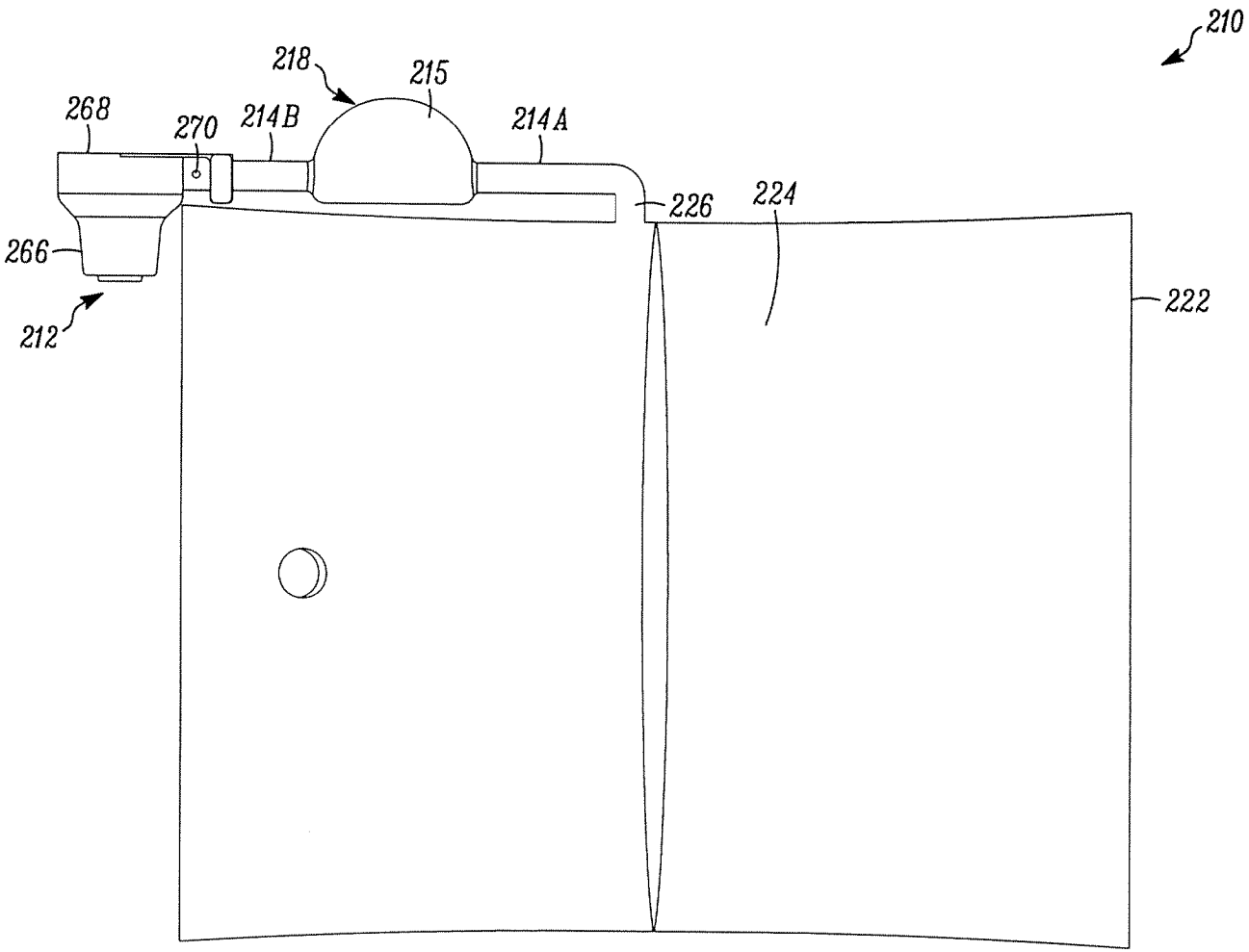
FIG. 12 is a perspective view of the dispensing valve and pump of FIG. 9 mounted on a flexible pouch defining a variable-volume storage chamber.

The dispensing valve 212 also includes a valve body 230 and a valve cover 242 partially overlying the valve body 230. A top cover 268 engages a bottom cover 266 to overlie and substantially encompass the valve body 230 and the valve portion 242. A tube fitting 211 extends from the valve body 230, and is inserted into the tube 214 to provide a hermetically sealed connection between the valve body 230 and the tube 214. The tube 214, actuator 215, and valve body 230 define a compression chamber 232 that is in fluid communication with the variable-volume storage chamber of the flexible pouch 222. A check valve 219 is inserted and sealed to the inlet end of the tube 214 so that fluid can flow only in the direction from the variable-volume storage chamber, and not from the pump or valve and back into the storage chamber. The top cover 268 includes hinges 270 to allow a portion of the valve assembly 212 to be rotated about the hinges 270 so that part of the valve assembly 212 my be folded down to reduce the size of the valve assembly 212 when not in use or when being stored. As shown in FIG. 12, the valve assembly 212 may be connected to the flexible pouch 222 so that the tube 214 is hermetically sealed to the pouch 222, thus defining an air-tight passage from the variable-volume storage chamber defined by the pouch 222 to the tube 214. In this embodiment, the tube 214 forms a curved portion, and the check valve 219 is disposed within the pouch 222.

Figure 13:
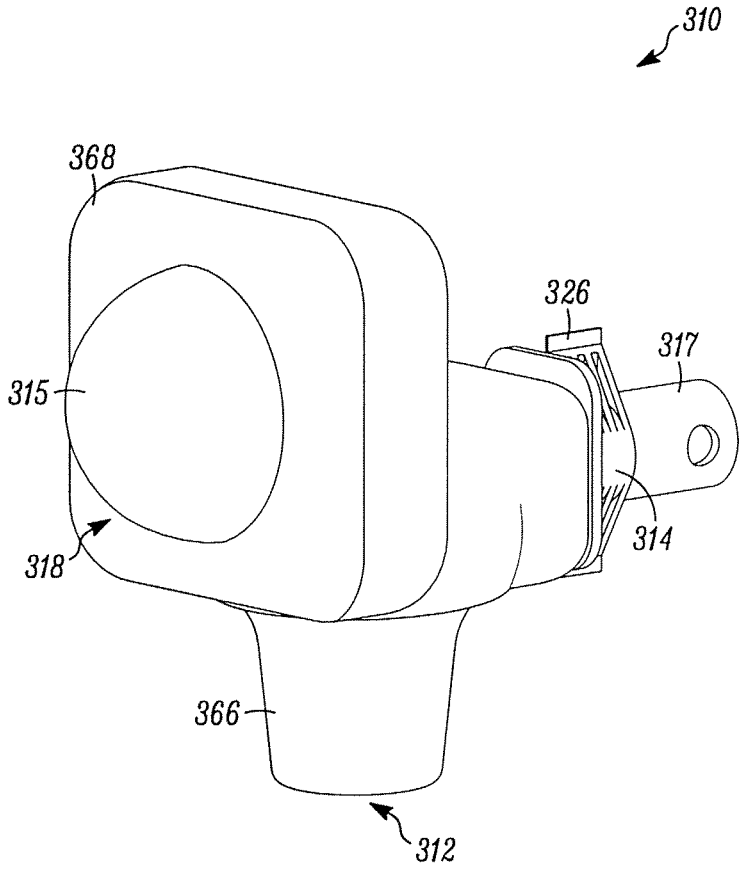
FIG. 13 is a perspective view of another embodiment of a dispensing valve and pump including a palm engaging surface for actuating the pump.
Figure 14:
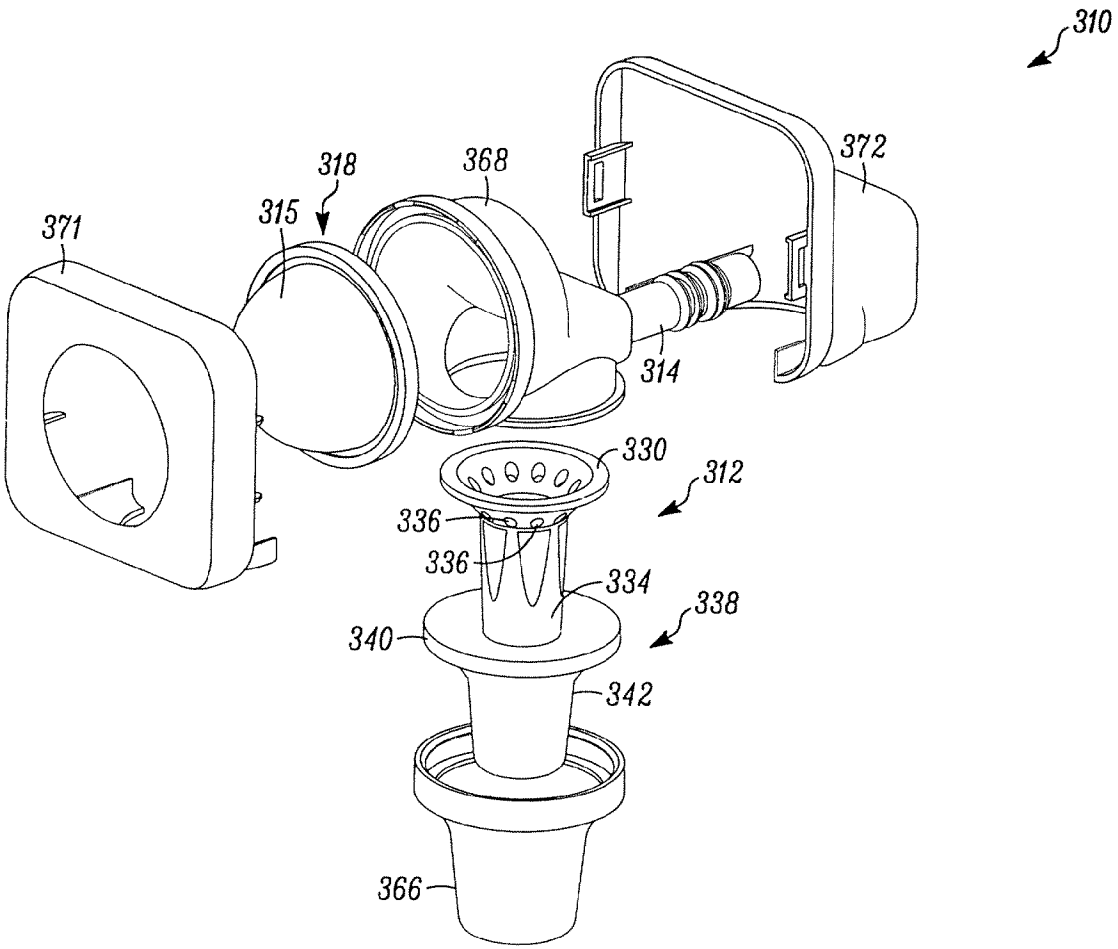
FIG. 14 is an exploded perspective view of the dispensing valve and pump of FIG. 13.

In FIGS. 13 and 14 another embodiment of an apparatus is indicated generally by the reference numeral 310. The apparatus 310 is similar in many respects to the apparatus 110 described above with reference to FIGS. 6-8, and therefore like reference numerals preceded by the numeral "3" instead of the numeral "1" are used to indicate like elements. The pump 318 includes a palm engageable, dome-shaped actuator 315, and the valve 312 includes a valve body 330 and a valve portion 342. The actuator 315 is made of a flexible elastomeric material that can be manually engaged by a user's palm to pump fluid from a storage chamber through the valve assembly. In this embodiment, an interior cover 368 engages the valve body 330 and valve portion 342, and forms a hermetically sealed compression chamber bounded by the actuator 315, the interior cover 368, the valve body 330 and the valve portion 342. The interior cover also engages and/or abuts the actuator 315, which is positioned so that the actuator 315 is facing the front of the valve assembly 312. A rigid tube 314 extends from interior cover 368 to connect to a storage chamber, e.g., via a mounting flange 317. The valve cover includes three parts: a front cover 371 that overlies a portion of the actuator 315, a rear cover 372, and a bottom cover 366. These parts are engaged together to protect and secure the components of the valve assembly 312 and pump 318.

In the above embodiments, the apparatus 10, 110, 210 and 310 include dispensing valves and pumps that are hermetically connected to flexible containers defining variable-volume storage chambers. In the following embodiments, the apparatus are provided in conjunction with outer housings for storage, transporting, dispensing, and protection. The outer housings may be made of any suitable material, such as plastic or cardboard, and may take any of numerous different configurations that are currently known, or that later become known.

In FIGS. 15-18 the dispenser 400 includes the apparatus 10 described above with reference to FIGS. 1-4 mounted within a housing 405. Although the dispenser 400 is shown in conjunction with the apparatus 10, it also may be utilized with any of apparatus 110, 210 and 310, or any of numerous other dispensing valve, pump and variable-volume storage chambers. The valve assembly 12, pump 18 and pouch 22 are disposed in a rigid housing 405 so that the pouch 22 is housed within housing 405 and the pump 15 and dispensing valve 12 are located exterior to the housing. The housing 405 includes a pouch housing 410 and a front housing or facing 415 forming a protective shroud defining a recess therein for receiving the exterior mounted dispensing valve and pump assembly. The housing 405 is preferably made of a plastic material. For example, the pouch housing 410 and the facing 415 each may be either injection molded or blow molded. Any of a variety of features may be molded directly into the housing 405 to facilitate use of the dispenser. For example, as shown in FIGS. 15-18, a handle 425 may be molded into the pouch housing 405 to facilitate carrying the dispenser 400. In another example, shown in FIG. 18, the handle 425 is disposed rearwardly on the dispenser 400. The types and number of handles or other features, such as gripping surfaces, carrying straps, hooks for hanging the dispenser, support stands, etc., that may be incorporated into the dispenser 400 are not limited to those features described herein, and any of numerous other features that are currently known, or that later become known, equally may be employed.

Figure 15:
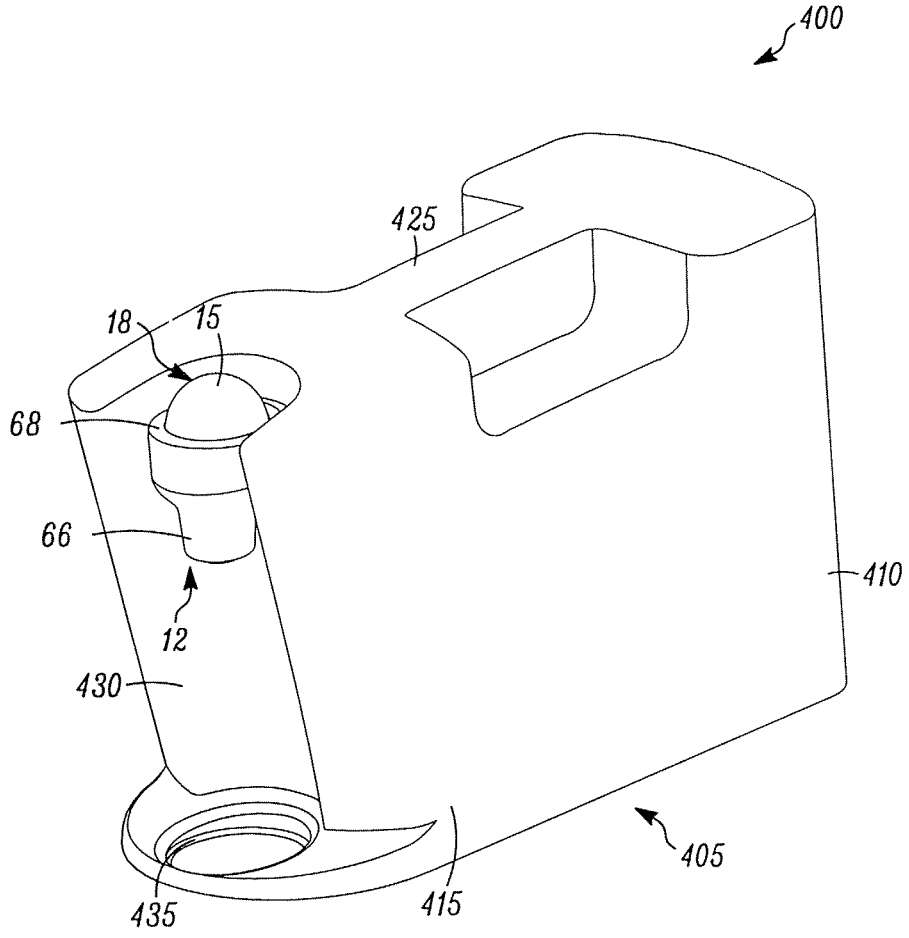
FIG. 15 is a perspective view of an apparatus for storing and dispensing multiple portions of fluids including a housing, a flexible pouch received within the housing, and a dispensing valve and pump mounted within a protective shroud on the exterior of the housing.

As indicated above, the facing 415 forms a protective shroud defining a recess 430 that receives therein the exterior mounted dispensing valve and pump assembly, and provides protection therefor during storage, transportation and/or use. The housing 405 further defines a container recess 435 located below the dispensing nozzle and pump that serves to help secure and/or to prevent sliding of a container or other receptacle during dispensing of fluid therein, and also may be used to catch excess fluid, if needed. As shown in FIG. 15, the recess 430 is substantially semi-cylindrical; however, as may be recognized by those of ordinary skill in the pertinent art based on the teachings herein, the housing and/or the protective shroud thereof may take any of numerous different shapes or configurations that are currently known, or that later become known.

Figure 17:
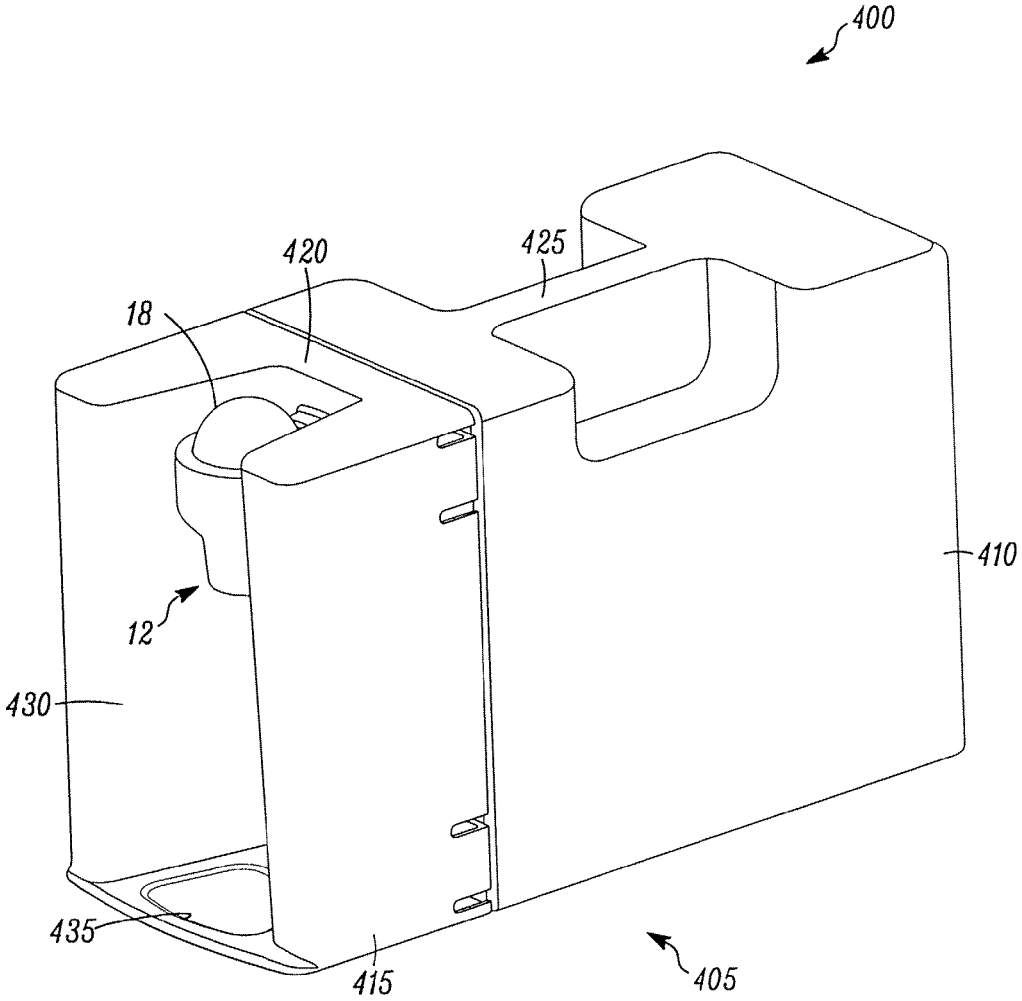
FIG. 17 is a perspective view of an alternative embodiment of an apparatus for storing and dispensing multiple portions of fluids.
Figure 18:
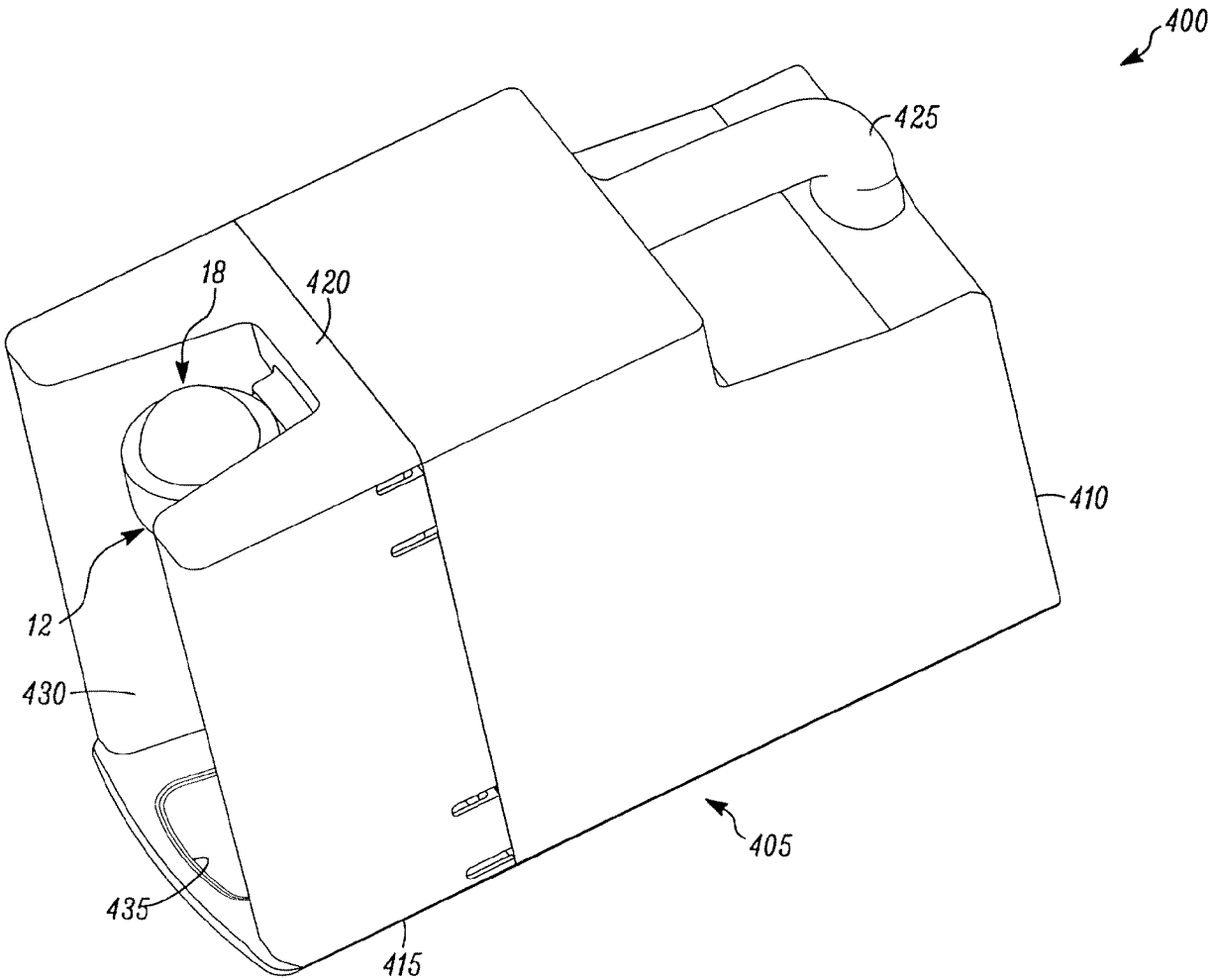
FIG. 18 is a perspective view of an apparatus of the type shown in FIG. 17 with an alternative handle configuration.

As shown in FIG. 17, the recess 430 may have a wider design, permitting larger receptacles to be used and providing a deeper recess. As also shown, the recess 430 and the container recess 435 need not be semi-cylindrical or have a circular base. In this embodiment, the recess 430 and the container recess 435 may define a substantially trapezoidal shape, although any other suitable shapes and sizes may be employed.

Figure 16:
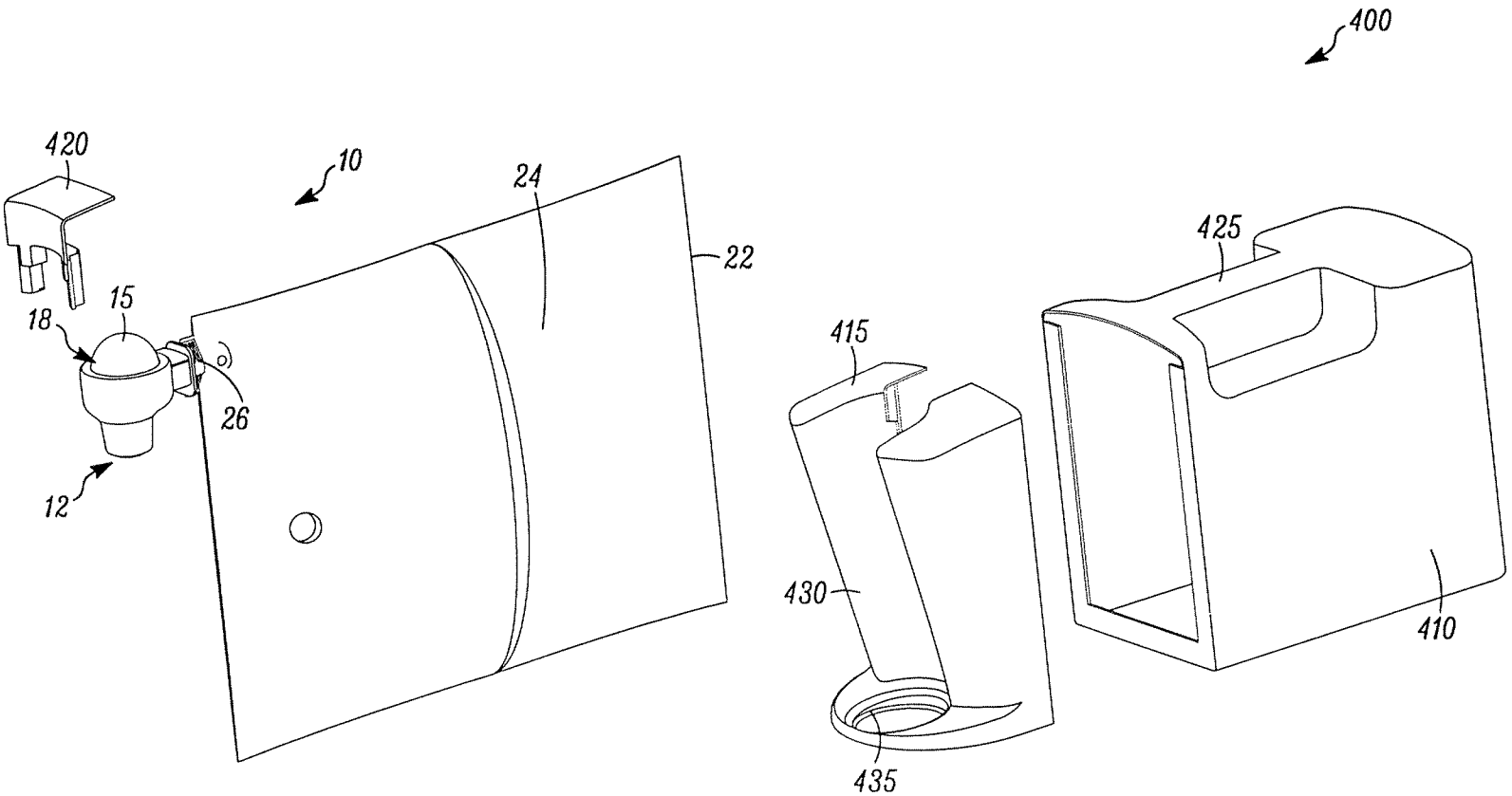
FIG. 16 is an exploded perspective view of the housing and the pouch, dispensing valve and pump assembly mounted within the housing.

FIG. 16 illustrates the assembly of the dispenser 400. As can be seen, the dispenser includes three principal components, the apparatus 10 (i.e., the pouch, dispensing valve and pump assembly), the facing 415, a locking clip 420, and a pouch housing 410. The pouch 22 is first Filled with a desired substance, such as baby formula, a dairy-based product or other fluid. The locking clip 420 is fitted over the tube 14 of the valve and pump assembly of the apparatus 10 and clipped into the facing 415 to secure the apparatus 10 to the housing 405, and to substantially prevent any movement of the dispensing valve and pump assembly relative to the housing. As indicated by the arrow in FIG. 16, the dispensing valve and pump assembly is then inserted into the facing 415. Then, the locking clip 420 is inserted into, and mechanically secured to, the facing 415 to form an aperture in the facing 415 through which the dispensing valve and pump assembly extends. The pouch housing 410 is then slid over the pouch 22 to receive the pouch within the pouch housing, and the pouch housing and facing are fixedly secured to each other, such as by a snap engagement, fasteners, or by welding, adhesive, or other suitable mechanism for securing the pouch housing to the facing in those instances in which the housing will not be reused.

Figure 19A:
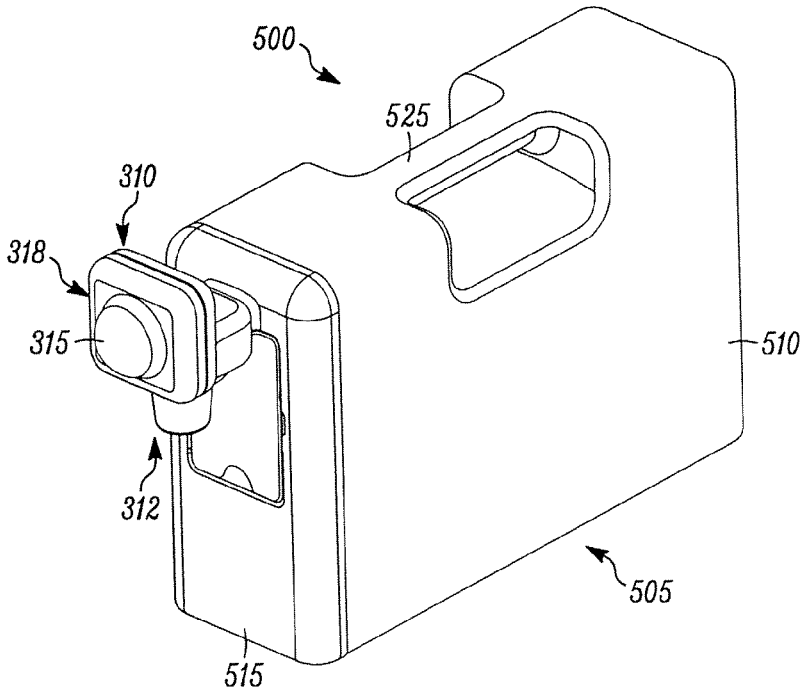
FIGS. 19A, 19B and 19C are a perspective view, a side elevational view, and an exploded perspective view, respectively, of another embodiment of an apparatus for storing and dispensing multiple portions of fluids including a dispensing valve and pump of the type shown in FIG. 13 mounted on a housing for receiving a flexible pouch therein.
Figure 19B:
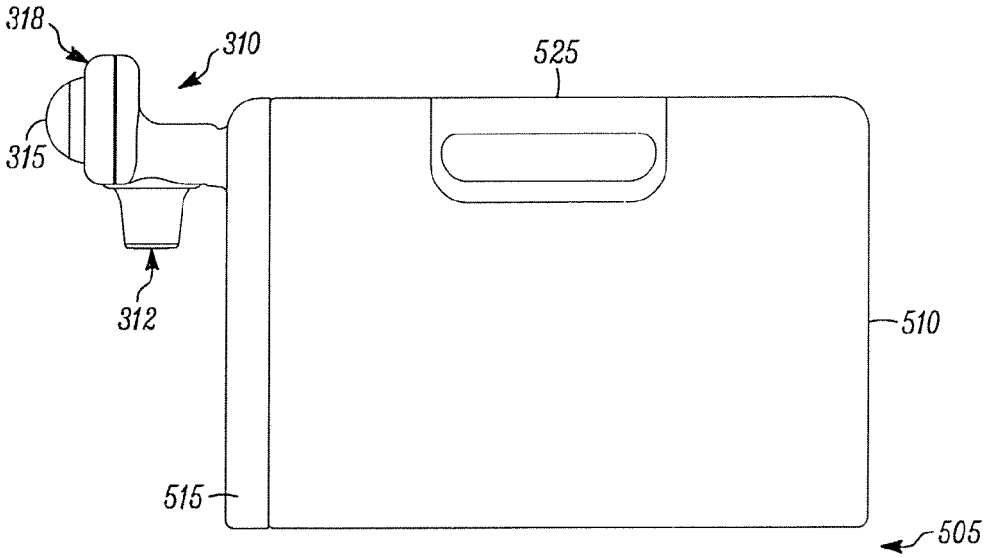
Figure 19C:
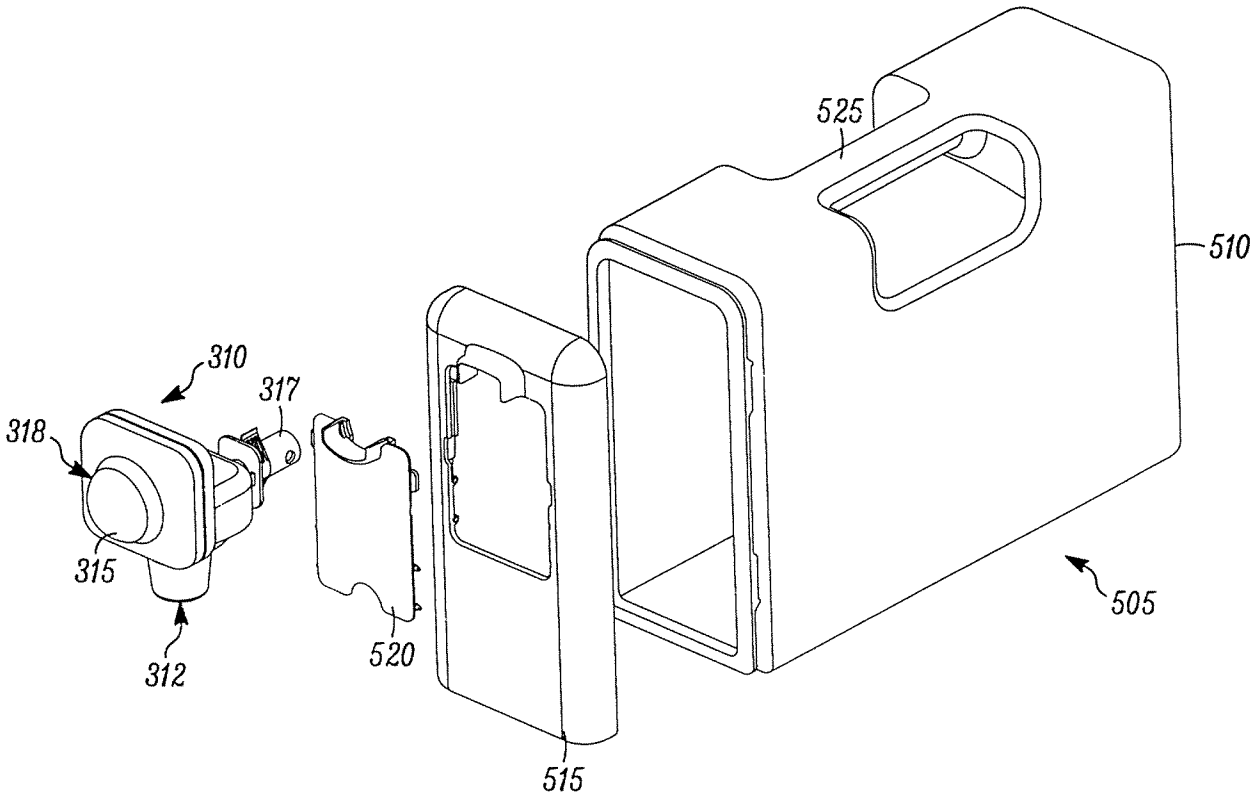

In FIGS. 19A-19C the dispenser 500 includes the assembly 310 described above in connection with FIGS. 13 and 14. The dispenser 500 is similar in many respects to the dispenser 400 described above, and therefore like reference numerals preceded by the numeral "5" instead of the numeral "4" are used to indicate like elements. The dispenser 500 includes a rigid housing 505 having a pouch housing 510 and a front housing or facing 515. The dispensing valve, pump and pouch (not shown) are received within the housing 505 so that the pouch (not shown) is received within the housing 505 and the dispensing valve 12 and pump 18 are mounted on the exterior of the housing. A handle 525 is preferably molded, or otherwise integrated into or attached to, the pouch housing 505. The facing 515 is engaged with the pouch housing 510, and a locking clip 520 is inserted into, and mechanically secured to, the facing 515 to form an aperture in the facing 515 through which the dispensing valve and pump extends and to fixedly secure same to the housing.

Figure 9:
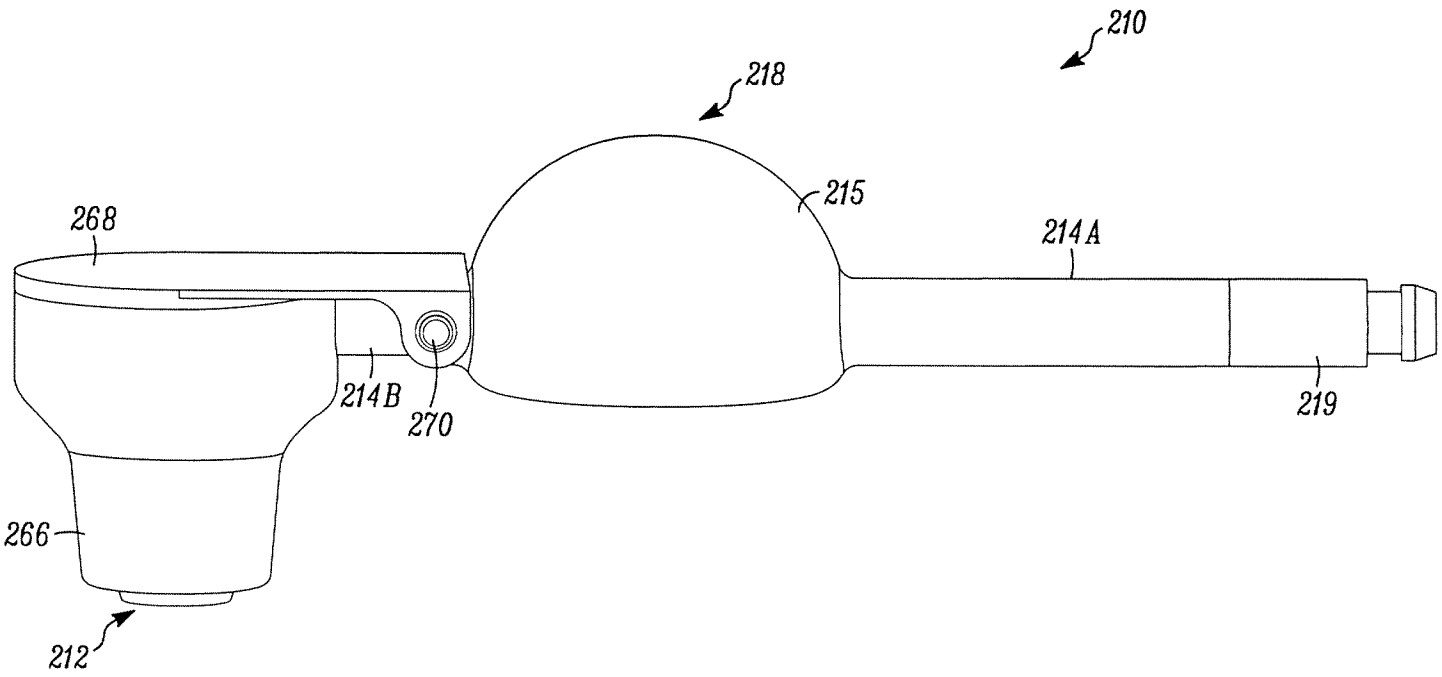
FIG. 9 is a perspective view of another embodiment of a dispensing valve and pump.
Figure 10:
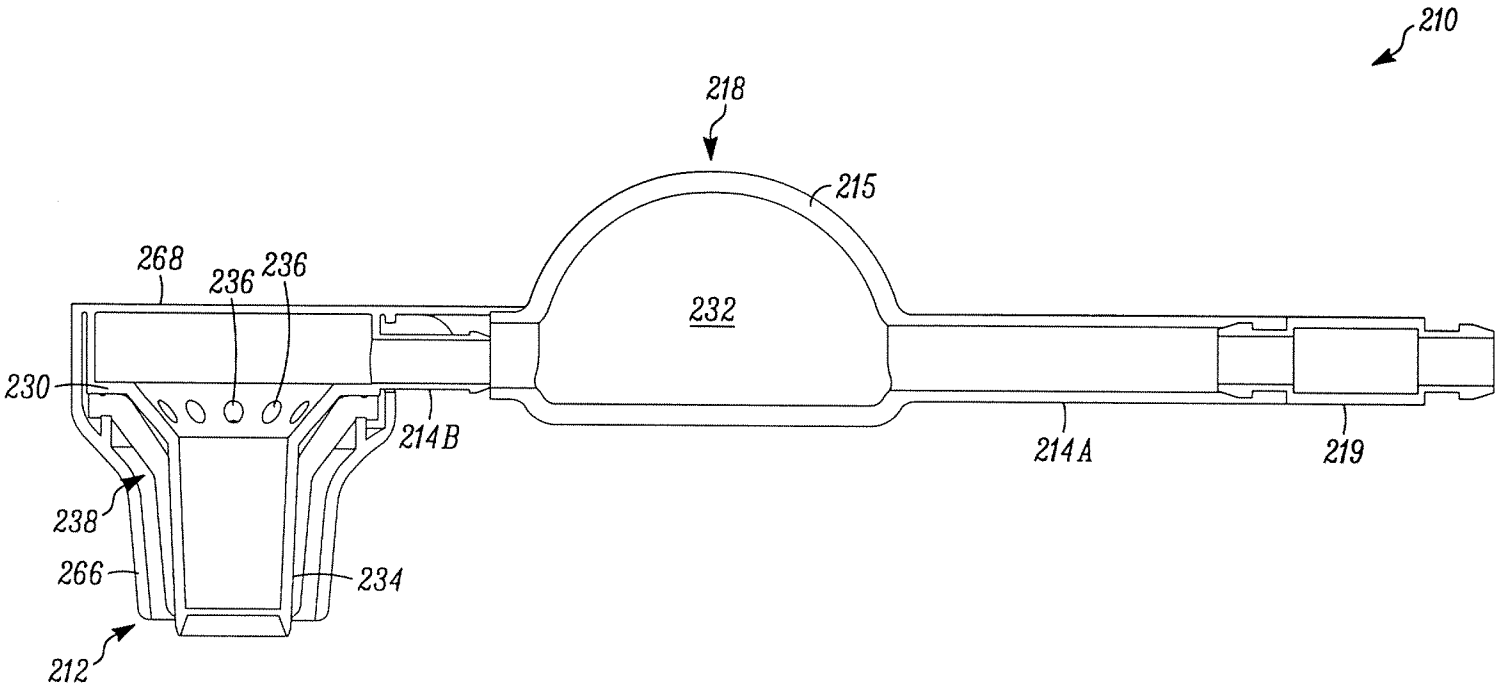
FIG. 10 is a cross-sectional view of the dispensing valve and pump of FIG. 9.
Figure 11:
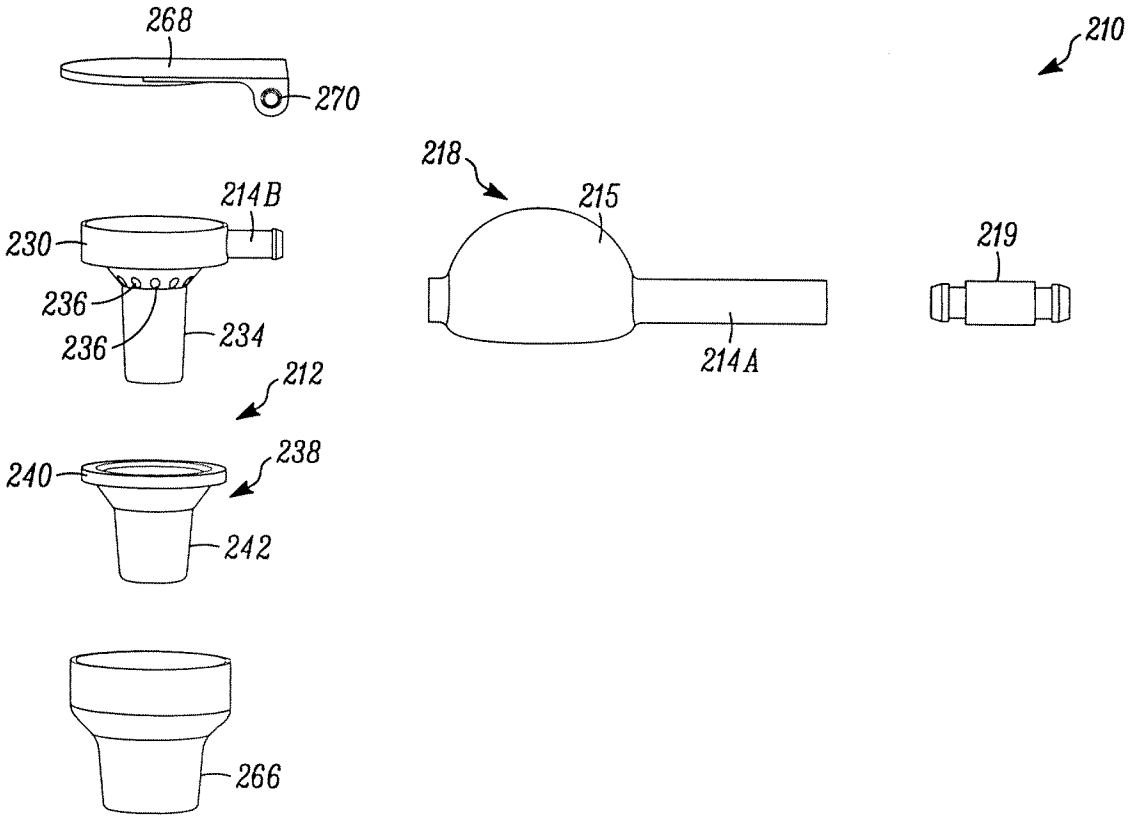
FIG. 11 is an exploded view of the dispensing valve and pump of FIG. 9.
Figure 20:
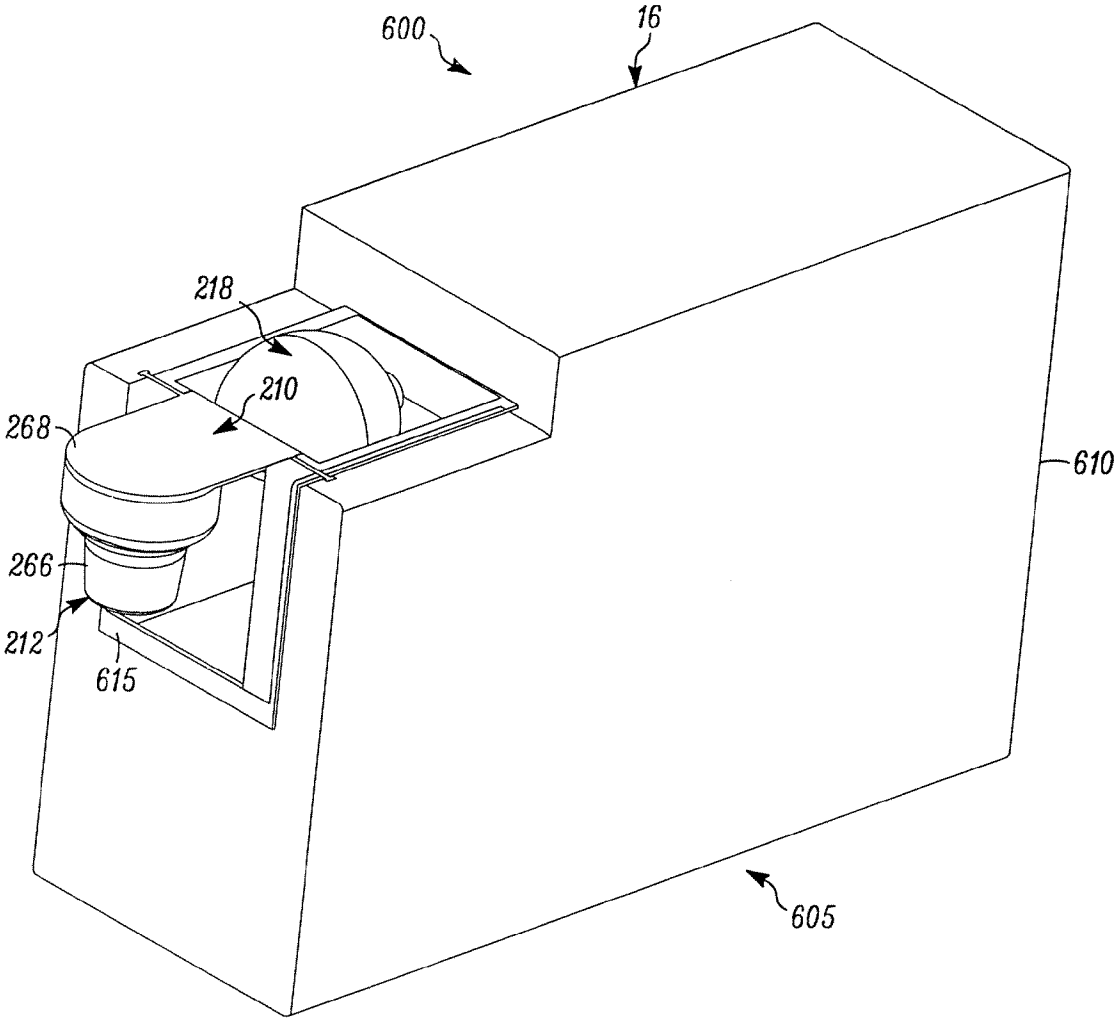
FIG. 20 is a perspective view of another embodiment of an apparatus for storing and dispensing multiple portions of fluids including a dispensing valve, pump and pouch of the type shown in FIGS. 9-13 mounted within a box.
Figure 21A:
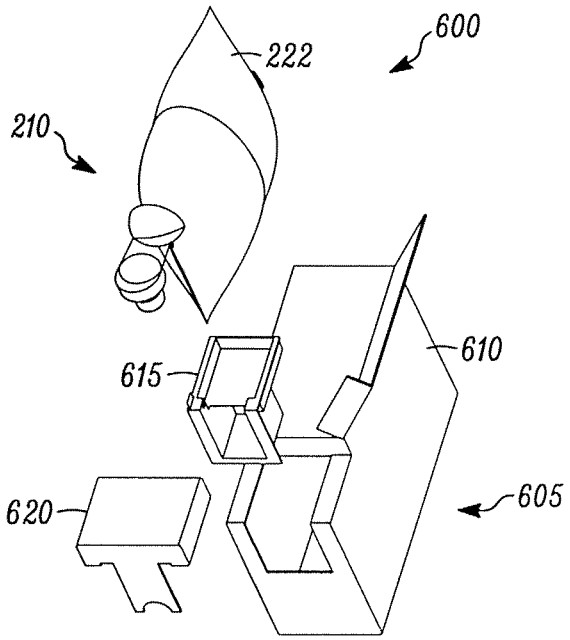
FIGS. 21A-21E are perspective views showing the assembly of the apparatus of FIG. 20.
Figure 21B:
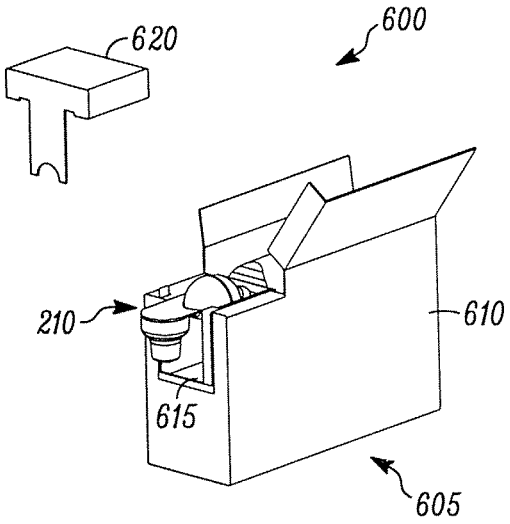
Figure 21C:
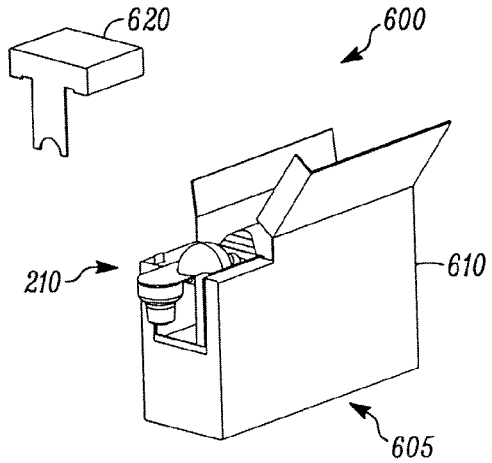
Figure 21D:
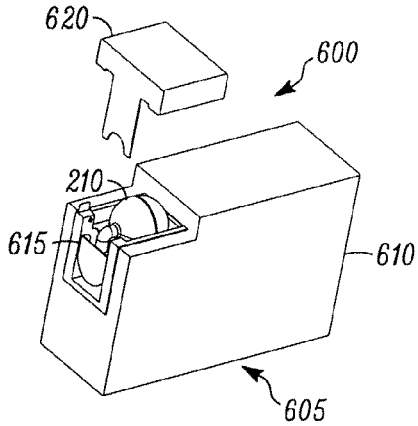
Figure 21E:
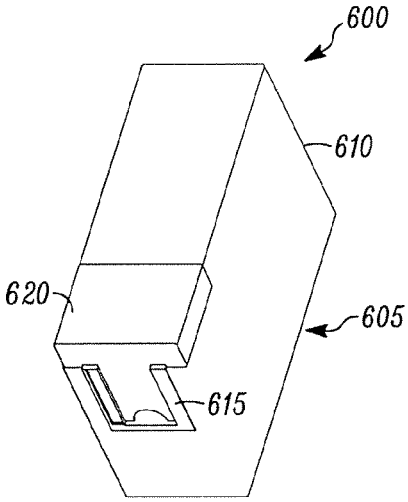
Figure 22A:
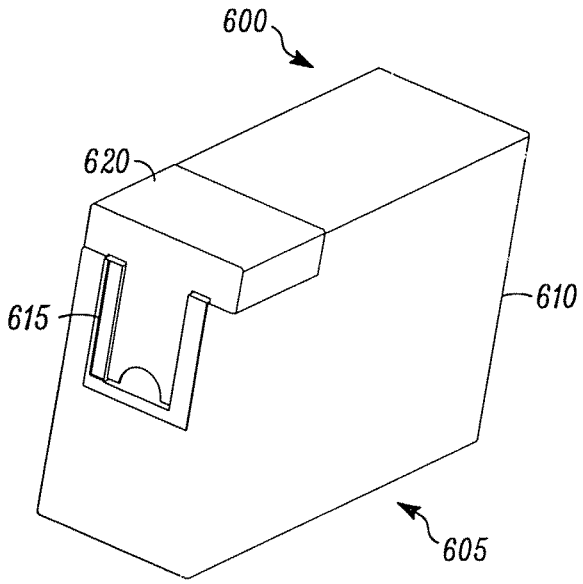
FIGS. 22A-22D are perspective views showing the opening of the assembled apparatus of FIG. 20.
Figure 22B:
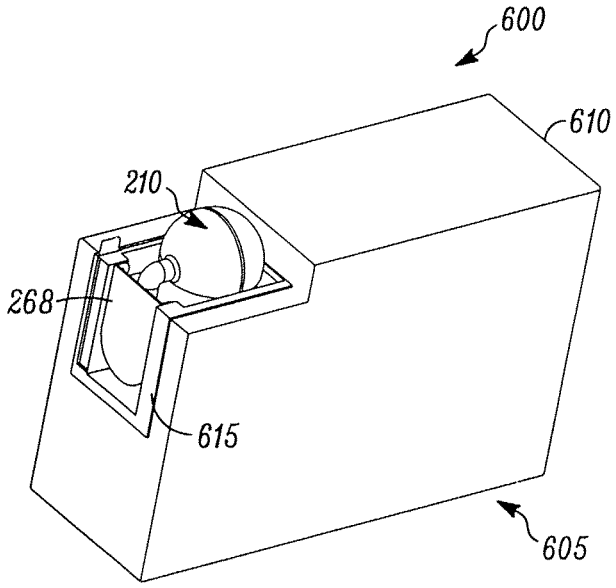
Figure 22C:
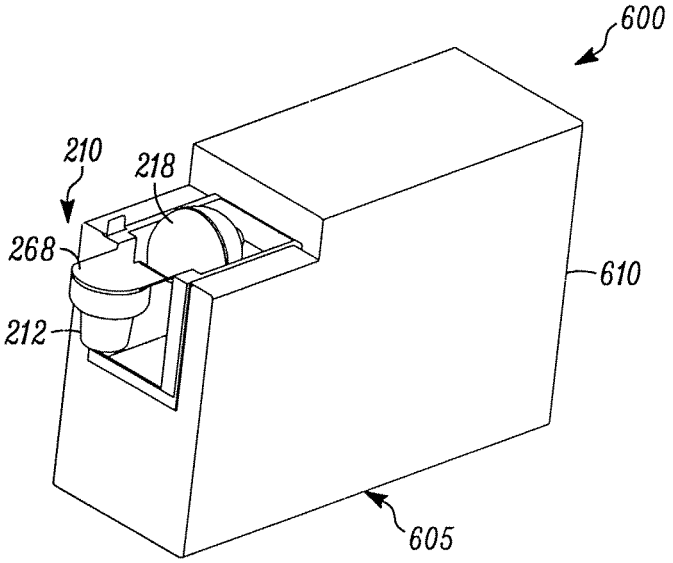
Figure 22D:
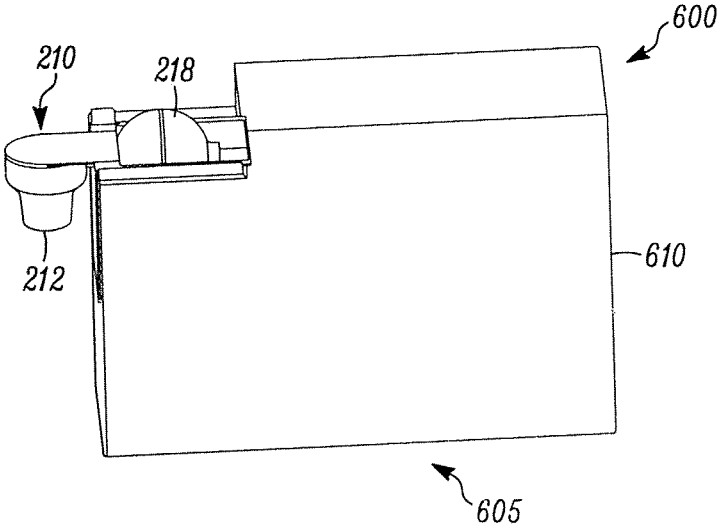

In FIGS. 20 through 22D an alternative dispenser 600 has mounted therein the apparatus 210 described above with reference to FIGS. 9-12. The dispenser 600 includes a housing 605 that has a pouch housing 610 in the form of a box, such as a cardboard box, a pump and dispensing valve support insert 615, and a protective covering 620. The tube 214 and the top cover 268 of the apparatus 10 are connected by hinges 270, as shown in FIGS. 9 and 11, so that the dispensing valve 212 can be folded into a compact position for storage within the housing 605. Thus, the dispensing valve 212 defines a closed position with the dispensing valve 212 pivoted inwardly with the dispensing valve 12 received within the box, and the upper cover 268 of the valve located substantially flush with the exterior surface of the box, as shown in FIGS. 21E and 22A; and an open position with the dispensing valve 212 pivoted outwardly such that the dispensing axis of the valve is oriented substantially vertical, and the cover is oriented substantially parallel to the horizontal, as shown in FIGS. 20 and 22D. In this embodiment, the pouch housing 610 preferably is made from a corrugated cardboard that also may be laminated. The dispensing valve and pump support insert 615 and the protective covering 620 preferably are made from a plastic material. However, the pouch housing 610, the support insert 615 and the protective covering 620 each may be made from cardboard, plastic or any other suitable material that is currently known or that later becomes known.

FIGS. 21A-E illustrate sequentially the exemplary steps for assembling the dispenser 600. As shown in FIG. 21A, the principal components of the dispenser 600 are the dispensing valve, pump and pouch assembly 210, the pouch housing 610, the dispensing valve and pump support insert 615, and the protective covering 620. First, the pouch 222 is filled with a desired substance, such as baby formula, dairy-based product, or other fluid to be stored and dispensed. In the case of a cardboard housing 605, bottom flaps of the pouch housing 610 are glued or otherwise fixedly secured to one another, such as by tape or staples. As shown in FIG. 21B, the support insert 615 is received within corresponding support surfaces defined by the pouch housing 610, and is fixedly secured thereto in any of numerous different ways that are currently known, or that later become known, such as by glue or other adhesive, tape, and/or fasteners. As shown in FIG. 21C, the dispensing valve 212 is folded or pivoted inwardly into the compact or closed position, and the dispensing valve, pump and pouch 222 are inserted into the housing 605 so that the pouch 222 is received within the pouch housing 610 and the dispensing valve 212 is disposed in a cavity formed by the support insert 615 and is supported thereon. As shown in FIG. 21D, top flaps of the pouch housing 610 are closed and sealed, such as by an adhesive, tape, staples and/or other suitable fasteners or fastening mechanism. Then, as shown in FIG. 21E, the protective covering 620 is mounted to the housing over the support insert 615 to enclose the dispensing valve in the storage position. In one embodiment, the protective covering is secured to the housing 605 by a removable mechanism, such as a shrink wrap, other wrapped covering, or a removable adhesive tape. Preferably, a removable tamper evident covering is placed on the protective covering, which can be removed by a user prior to use.

FIGS. 22A-22D illustrate sequentially the exemplary steps by which a user opens the dispenser 600 and prepares it for use. In FIG. 22A the dispenser is illustrated in the closed position ready for storage and/or transport. In FIG. 22B, the protective covering 620 has been removed, thereby exposing the dispensing valve 212 and pump 218 received within the housing in the closed position and supported on the support insert 615. Then, as shown in FIGS. 22C and 22D, in order to dispense fluid from the dispenser, the user manually engages and pivots the dispensing valve 212 outwardly into the open position. In order to dispense the fluid, the user manually engages the actuator 215 of the pump 218, such as with the palm or fingers of a hand, and presses inwardly to dispense substantially metered doses of fluid from the variable-volume storage chamber through the dispensing valve.

FIGS. 24-26D show an alternative embodiment of the dispenser 600 having the dispensing valve, pump and pouch assembly 10 of FIGS. 1-4 mounted therein. The dispenser 600 is a box-type dispenser substantially similar to the box described above with reference to FIGS. 20-22D. FIGS. 25A through 25E illustrate sequentially the steps involved in assembling the dispenser. As shown in FIG. 25A, the dispenser 600 includes three principal components, the dispensing valve, pump and pouch assembly 10, the pouch housing 610, and an integral pump and dispensing valve support insert 615 and protective covering 620. In the case of a cardboard housing, and as shown in FIG. 25A, the top flaps of the pouch housing 610 are fixedly secured to one another, such as by an adhesive, tape and/or fasteners. The integral valve support 615 and protective cover 620 are formed as a single piece, and inserted into a corresponding cutout or recess formed in the upper front corner of the box and fixedly secured thereto such as by an adhesive, tape and/or fasteners. As shown in FIG. 25C, the dispensing valve, pump and pouch assembly are then inserted into the interior of the box 605 through the open bottom panels. As shown in FIG. 25D, the bottom panels or flaps of the pouch housing 610 are then closed and fixedly secured to one another, such as by using an adhesive, tape and/or fasteners. As shown in FIG. 25F, the assembled dispenser includes the dispensing valve, pump and pouch fully enclosed within the box for transport and storage.

Figure 23:
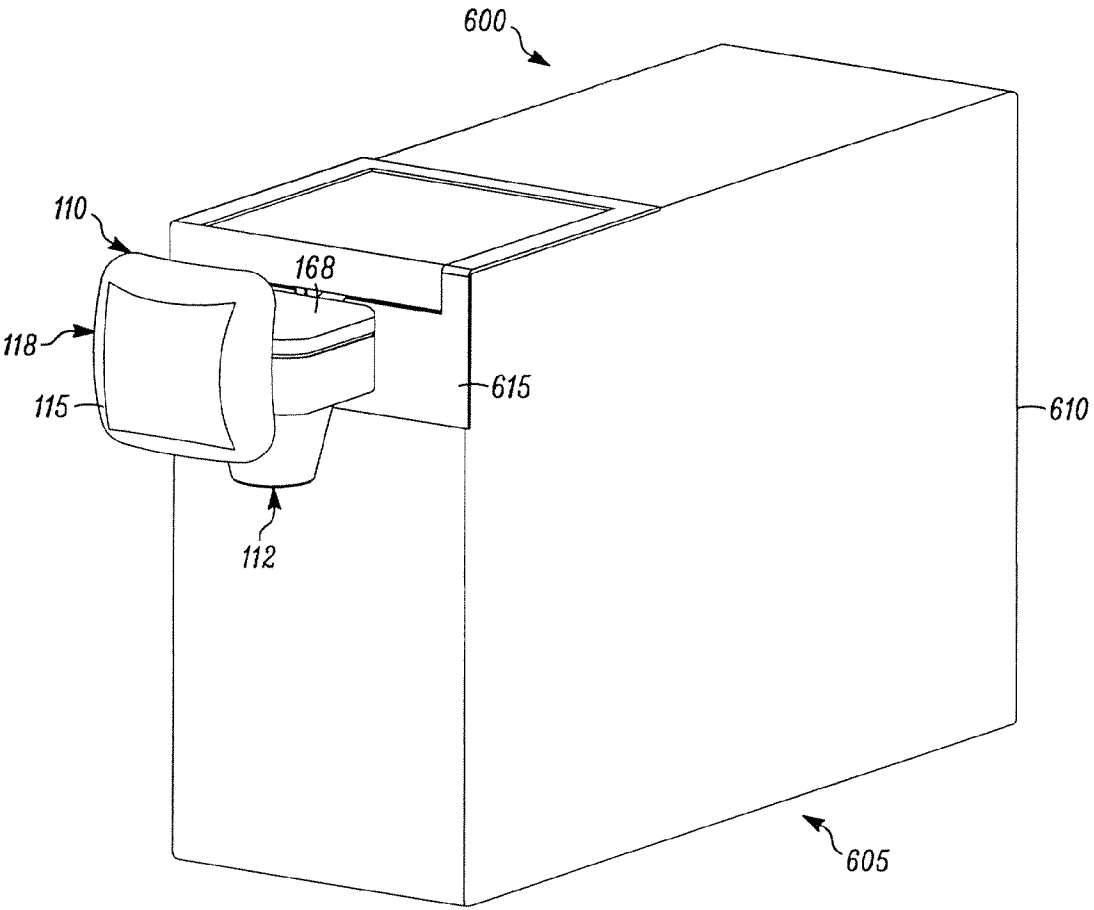
FIG. 23 is a perspective view of another embodiment of an apparatus for storing and dispensing multiple portions of fluids including a dispensing valve, pump and pouch of the type shown in FIGS. 5-8 mounted within a box.
Figure 24:
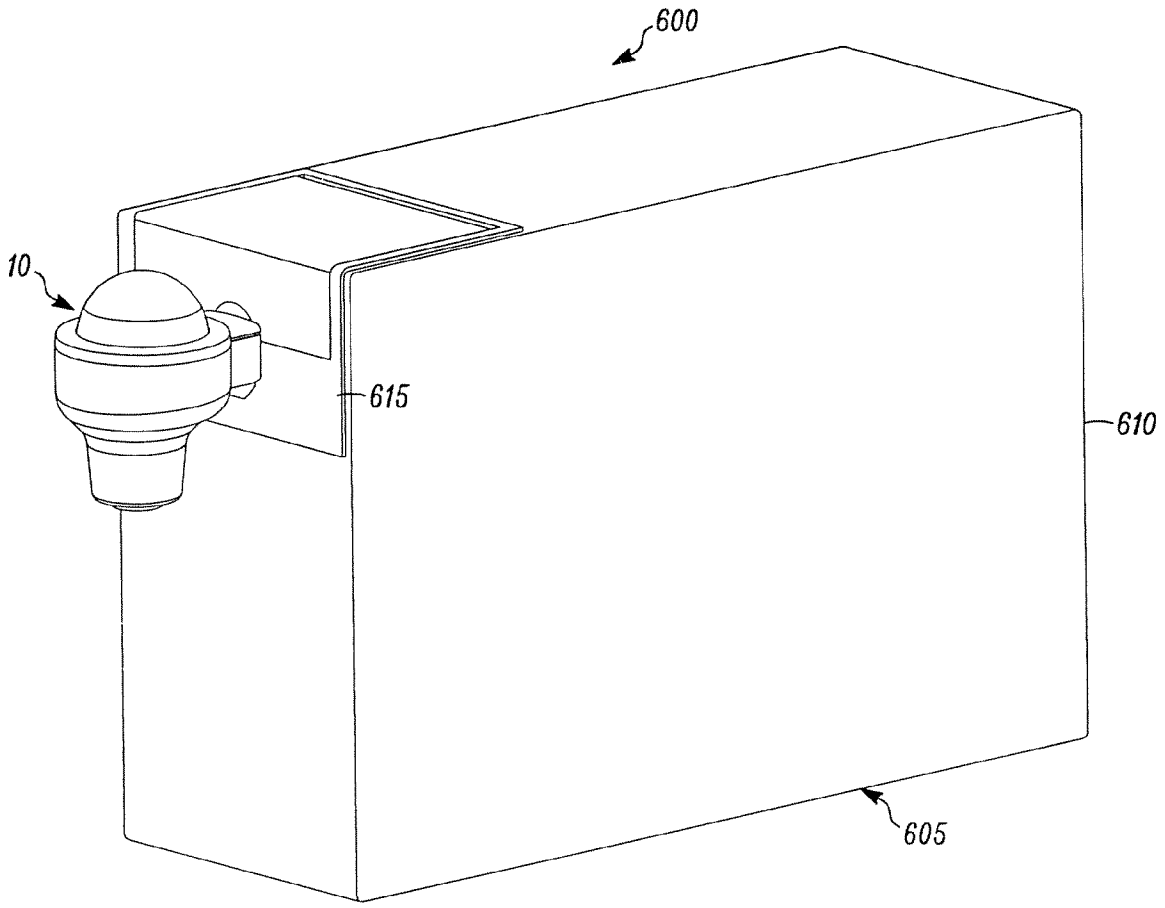
FIG. 24 is a perspective view of another embodiment of an apparatus for storing and dispensing multiple portions of fluids including a dispensing valve, pump and pouch of the type shown in FIGS. 1-4 mounted within a box.
Figure 25A:
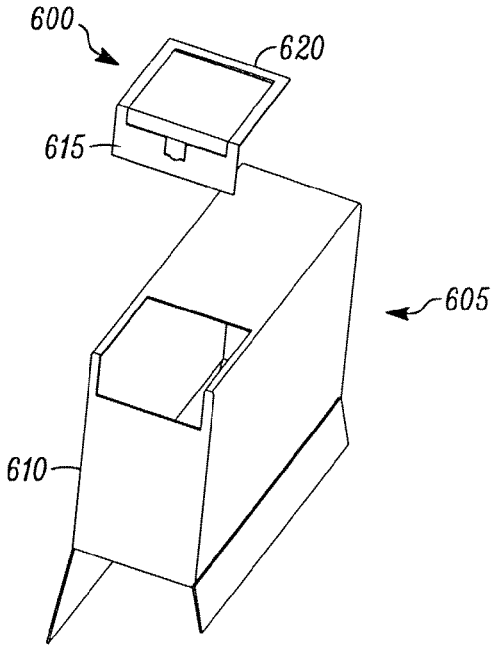
FIGS. 25A-25E are perspective views showing the assembly of the apparatus of FIG. 24.
Figure 25B:
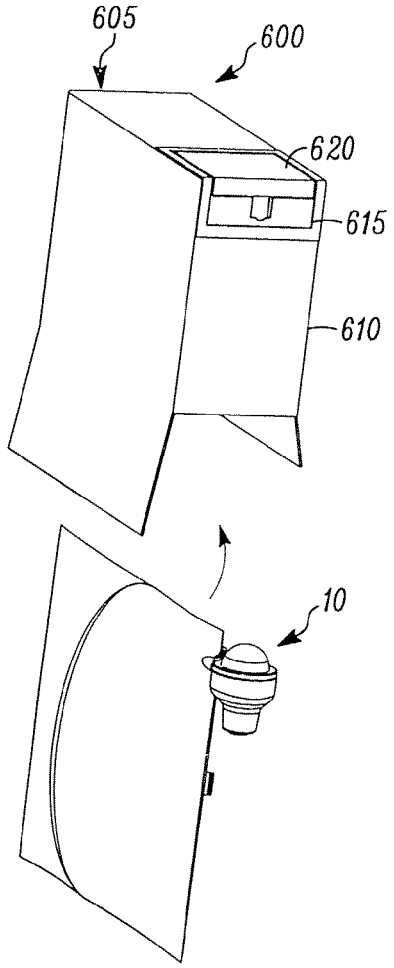
Figure 25C:
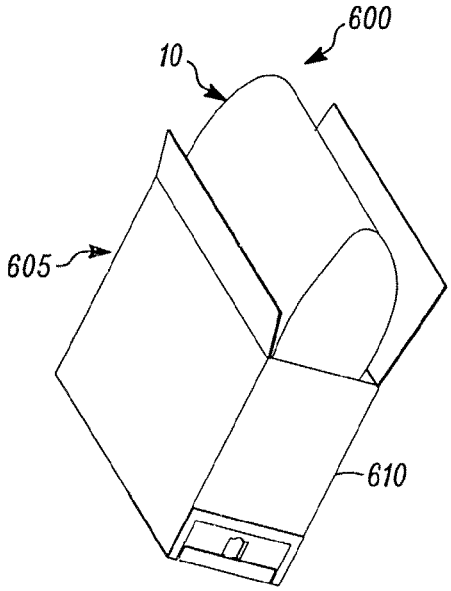
Figure 25D:
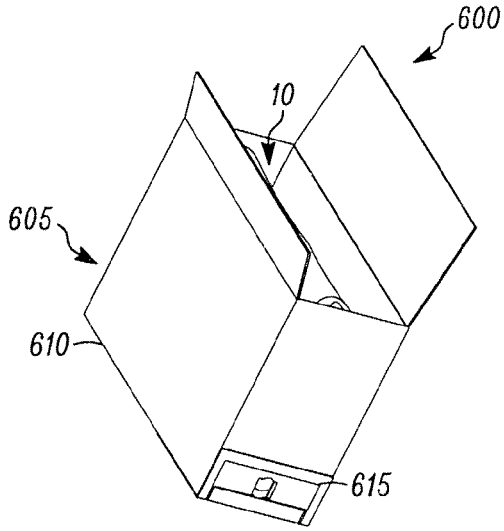
Figure 25E:
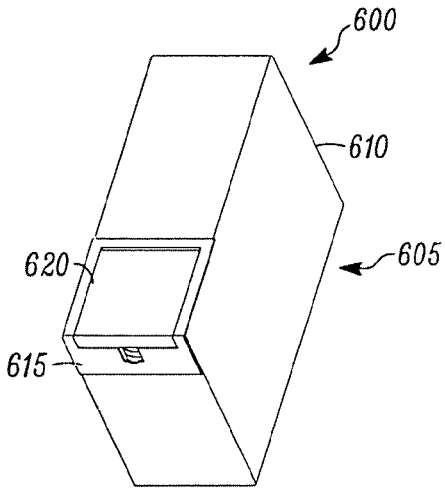
Figure 26A:
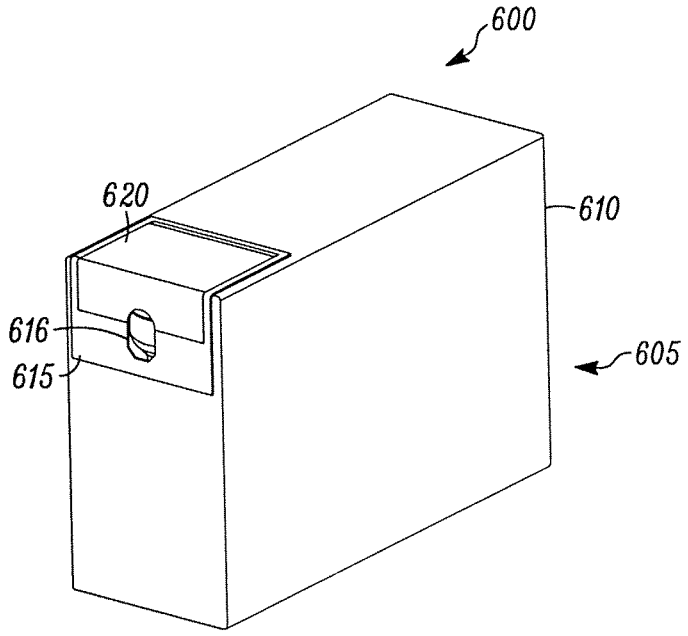
FIGS. 26A-26D are perspective views showing the opening of the assembled apparatus of FIG. 24.
Figure 26B:
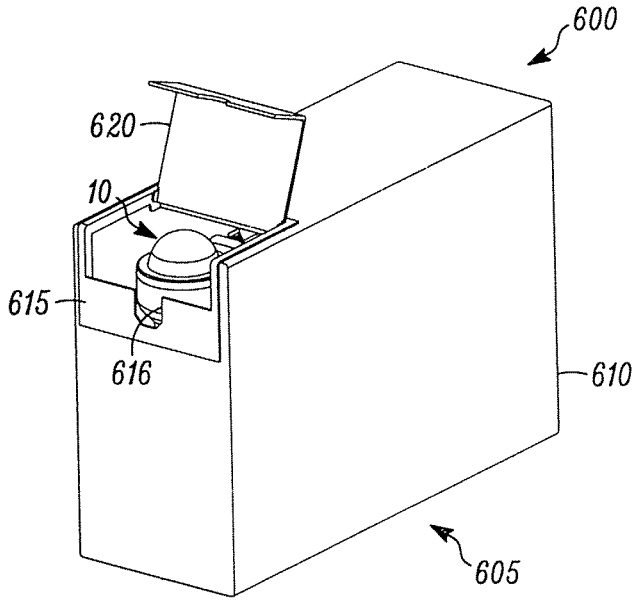
Figure 26C:
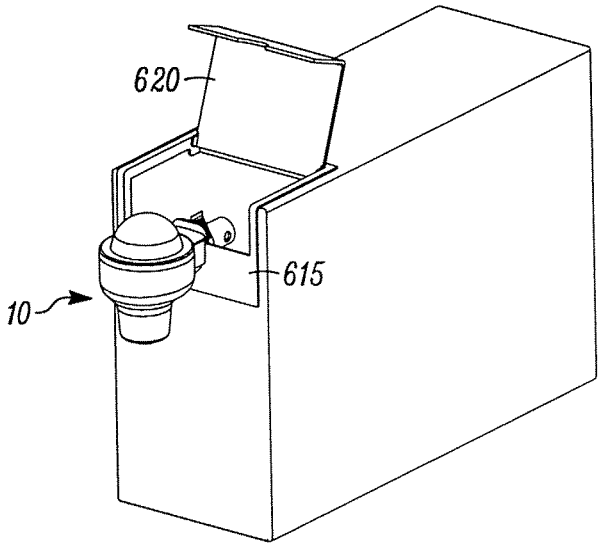
Figure 26D:
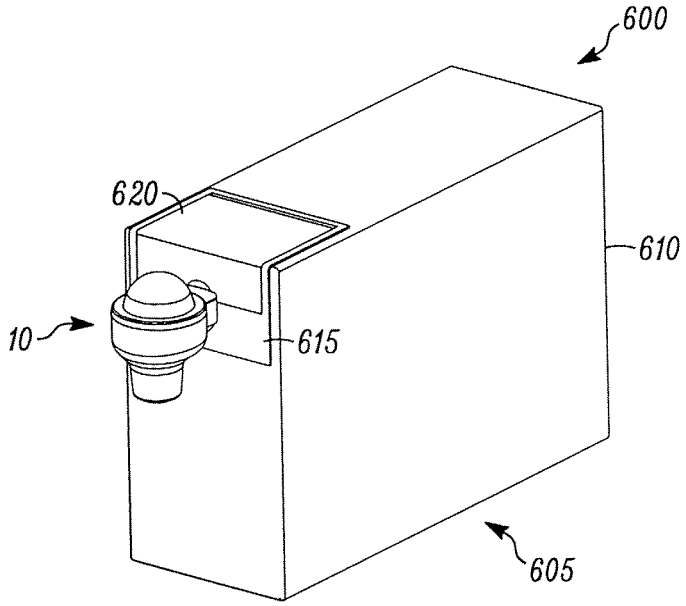

Turning to FIGS. 26A through 26D, the steps for opening and using the dispenser 600 are sequentially illustrated. As shown in FIG. 26B, the protective cover 620 can be pivoted upwardly away from the housing to expose the dispensing valve and pump through a resulting aperture 616. A user can then grip the dispensing valve and/or pump and pull it through the aperture 616, and can in turn mount the lower portion of the tube 214 (or other portion of the apparatus if desired) within the corresponding recess formed within the support portion 615 of the support insert to mount the dispensing valve and pump on the exterior of the housing. Then, as shown in FIG. 26D, the cover 620 is pivoted downwardly back into the closed position so that the recess in the cover is received over the upper portion of the tube 214 (or other portion of the apparatus if desired) to thereby secure the pump and dispensing valve in the exterior position and ready for use. As may be recognized by those of ordinary skill in the pertinent art based on the teachings herein, any of numerous different dispensing valve, pump and variable-volume storage chamber assemblies may be used with any of numerous different housings. For example, as shown in FIG. 23, the dispenser 600 is substantially the same as the dispenser illustrated in FIGS. 24 through 26D; however, the dispensing valve, pump and pouch assembly mounted therein is of the type 110 shown and described above in connection with FIGS. 5 through 8.

Figure 27:
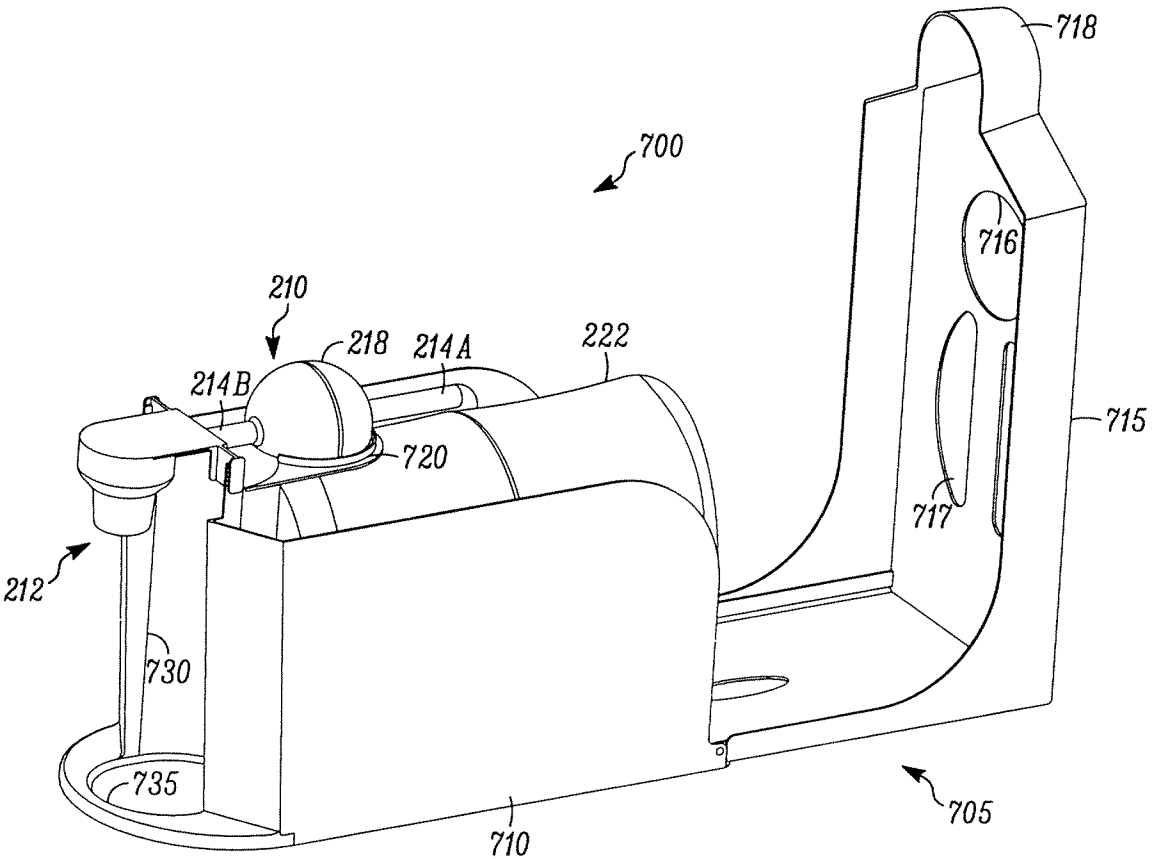
FIG. 27 is a perspective view of another embodiment of an apparatus for storing and dispensing multiple portions of fluids including a dispensing valve, pump and pouch of the type shown in FIGS. 9-12 mounted within a reusable housing having a pivotally mounted cover and base for receiving the pouch therein, and showing the cover in an open position.

In FIG. 27, a dispenser 700 includes a reusable housing 705 configured to receive therein the dispensing valve, pump and pouch assembly 210 described above in connection with FIGS. 9 through 12. The dispenser 700 is similar in many respects to the dispensers described above, and therefore like reference numerals preceded by the numeral "7" instead of the other respective numerals are used to indicate like elements. The dispenser 700 includes a housing 705 that has a housing body 710 and a housing cover 715. The housing cover 715 may be moved between at least one open position and a closed position, such as by being rotated about hinges provided on the housing body 710. The housing body 710 includes a support platform 720 formed as an integral part of the housing body 710, and designed to support thereon the pump 218 and actuator 215 when the dispensing, pump and pouch assembly are received within the housing. A substantially cylindrical recess 730 and a platform or container recess 735 are also formed on the housing body 710, and these components also may be similar to the recess 430 and container recess 435 of the dispenser 400 described above. The housing cover 715 also includes an actuator aperture 716 through which the actuator 215 extends when the housing 705 is closed. The housing cover includes handle apertures 717 that allow a user to grasp and transport the dispenser 700. The dispenser 700 is preferably molded from plastic material, and is, in one embodiment, reusable.

The dispenser 700 includes two principal components, the dispensing valve, pump and pouch assembly, and the housing 705 including the housing body 710 and integral housing cover 715 pivotally mounted thereto. In order to assemble the dispenser 700, the pouch 222 is filled with a desired substance prior to installing the pouch into the dispenser housing 705. Then, the filled dispensing valve, pump and pouch assembly is inserted into the housing 705 so that the pouch 222 is received within the housing body 710, the pump 218 is mounted on the support surface 720, and the dispensing valve extends outwardly from the upper front corner of the housing. As can be seen, the bottom cover 266 of the dispensing valve 212 extends to the exterior of the housing 705 and within the recess 730. In order to complete the assembly, the housing cover 715 is rotated and closed over the housing body 710. The housing cover 715 is shaped so that when the housing 705 is closed, a front portion 718 of the housing cover 715 extends over the top cover 268 and a substantial part of the bottom cover 266 to protect the dispensing valve 212. To use the dispenser 700, a user pumps the actuator 215 that extends through the top of the housing 705.

Figure 28B:
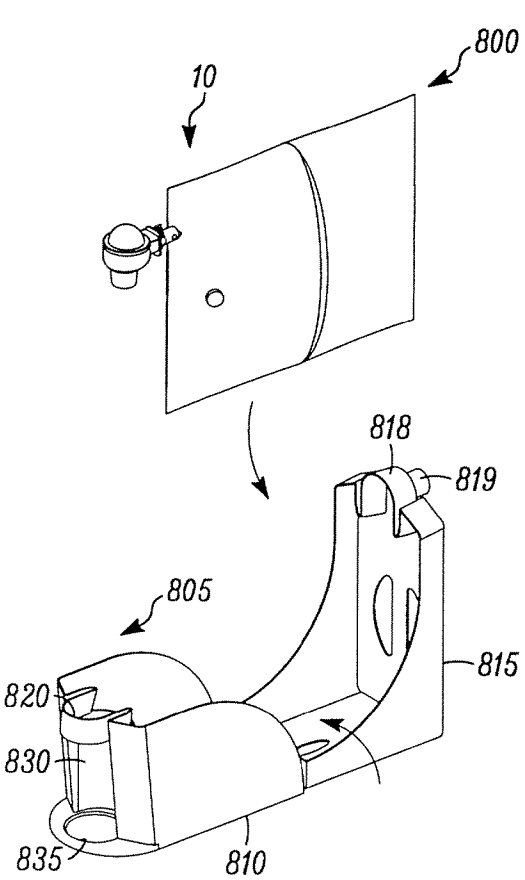
FIGS. 28A and 28B are perspective views of another embodiment of an apparatus for storing and dispensing multiple portions of fluids including a dispensing valve, pump and pouch of the type shown in FIGS. 1-4 mounted within a reusable housing having a pivotally mounted cover and base for receiving the pouch therein.
Figure 28A:
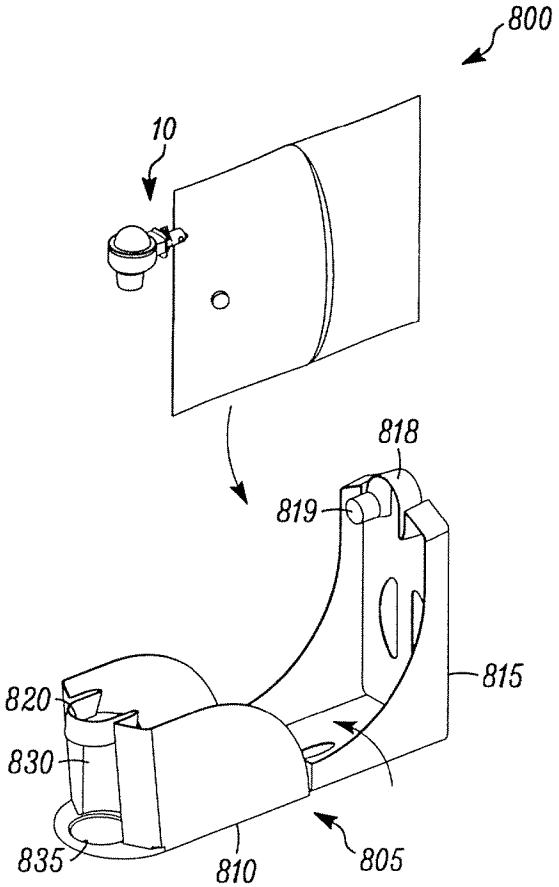

In FIGS. 28A and 28B another embodiment of a dispenser is indicated generally by the reference numeral 800. The dispenser 800 is similar in many respects to the dispenser 700 described above with reference to FIG. 27, and therefore like reference numerals preceded by the numeral "8" instead of the numeral "7" are used to indicate like elements. Dispenser 800 includes a housing 805 that has a housing body 810 and a housing cover 815. The dispenser 800 is configured to receive therein the dispensing valve, pump and pouch assembly 10 of FIGS. 1-4. As can be seen, the housing body 810 includes a support platform 820 that forms a support on which the dispensing valve and pump assembly rests and a ring through which bottom cover 66 of the dispensing valve extends. A substantially semi-cylindrical recess 830 and a platform 835 are formed as an integral part of the housing body 810 to provide a protective shroud for the dispensing valve and to receive therein a container (not shown) for dispensing fluids from the dispensing valve therein. The housing cover 815 includes handle apertures 817 that form a handle for gripping and transporting the dispenser. The housing cover includes an extended portion 818 defining an aperture for receiving therein the pump 18 and elastic dome-shaped actuator 15 thereof. The extended portion 818 includes an actuating button 819 slidably received within the aperture formed therein, and which engages the dome-shaped actuator 15 of the pump 18. As can be seen, a user depresses the actuating button 819 to actuate the pump 15. Upon releasing the actuating button 819, the energy stored within the dome-shaped actuator 15 is sufficient to drive the actuating button 819 to the up or ready position.

FIGS. 28A and 28B illustrate in part the sequential steps involved in assembling the dispenser 800. As shown in FIG. 28A, the dispenser 800 includes two principal components, the dispensing valve, pump and pouch assembly 10 (FIGS. 1-4), and the housing 805 including the housing base 810 and cover 815 pivotally mounted thereon. The pouch 22 is filled with a desired substance to be stored and dispensed. As shown in FIG. 28A, the actuating button 819 is inserted into the aperture of the extended portion 818 which, as described above, retains the actuating button 819 on the housing cover but allows the button to be depressed to actuate the pump. The actuating button 819 includes an annular protrusion or taper at the base of the button to retain the button within the extended portion 818 of the housing cover. A rim at the top of the button aperture formed in the extended portion 818 prevents the button from escaping through the aperture. As indicated by the arrow in FIG. 28B, the dispensing valve, pump and pouch assembly 10 is inserted into the housing body 810 with the dispensing valve and pump received on and supported by the housing platform 820. As indicated by the arrow in FIG. 28, the housing cover is pivoted forwardly into engagement with the housing base 810 to close the housing. A user dispenses fluid from the pouch 22 by depressing the actuating button 819 which, in turn, depresses the dome-shaped actuator 15 of the pump 18 and dispense a substantially metered dose of fluid through the dispensing valve 12.

Figure 29A:
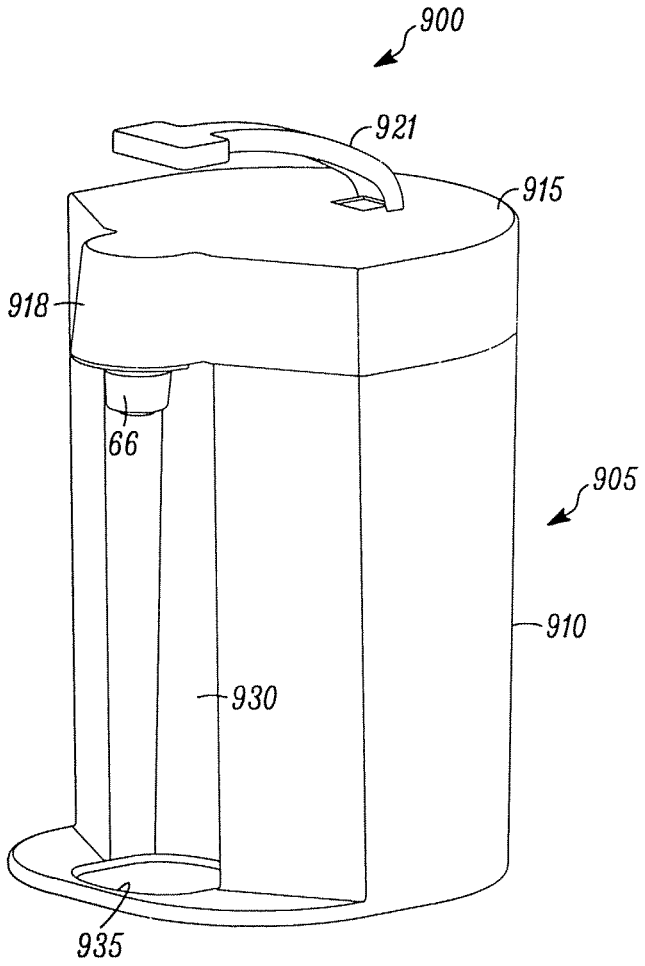
FIG. 29A is a perspective view of another embodiment of an apparatus for storing and dispensing multiple portions of fluids including a base for receiving a pouch, dispensing valve and pump similar to that shown in FIGS. 1-4, and a cover including a lever for actuating the pump and dispensing portions of fluid through the valve.
Figure 29B:
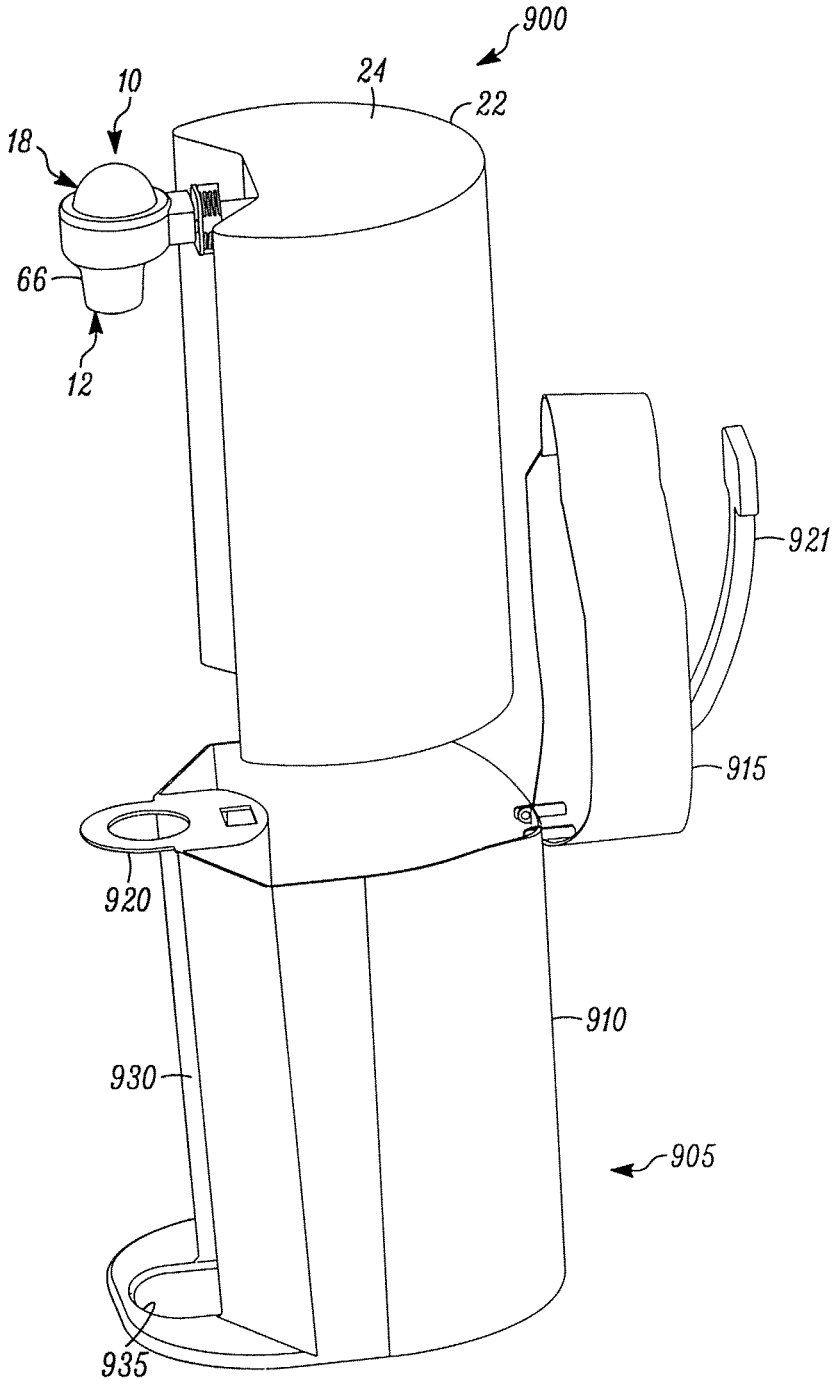
FIGS. 29B and 29C are perspective views showing the assembly of the apparatus of FIG. 29A.
Figure 29C:
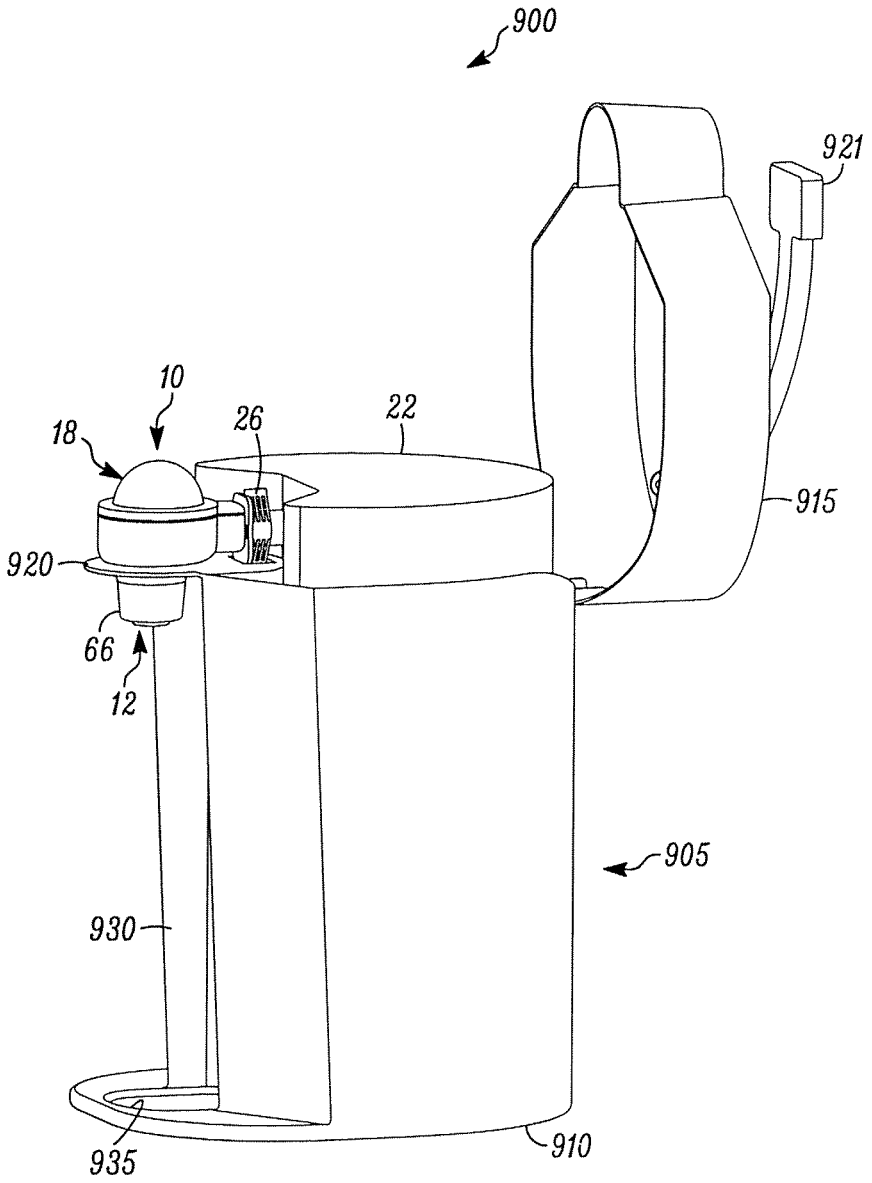

In FIGS. 29A through 29C another embodiment of a dispenser is indicated generally by the reference numeral 900. The dispenser 900 is similar in many respects to the dispenser 800 described above with reference to FIGS. 28A-28D, and therefore like reference numerals preceded by the numeral "9" instead of the numeral "8" are used to indicate like elements. The dispenser 900 is configured to receive therein a dispensing valve, pump and pouch assembly substantially similar to the dispensing valve, pump and pouch assembly 10 of FIGS. 1-4 with the primary difference being the shape of the pouch 24 for receipt within the housing of the dispenser 900. Dispenser 900 includes a housing 905 that has a housing body 910 and a housing cover 915 pivotally mounted on the housing body and movable between an open position, as shown typically in FIGS. 29B and 29C, and a closed position, as shown typically in FIG. 29A. As shown best in FIGS. 29B and 29C, the housing body 910 includes a support platform 920 that forms a support that receives and supports thereon the dispensing valve and pump assembly, and defining an aperture therein through which the bottom cover 66 of the dispensing valve extends. A substantially semi-cylindrical recess 930 and a platform 935 are formed as an integral part of the housing body 910 for receiving therein a container within which the fluids are dispensed. The housing cover 915 includes an extended portion 918 that covers the dome actuator 15, and a lever actuator 921 that is pivotally mounted on the cover 915 and is engageable with the dome-shaped actuator 15 of the pump 18 when the cover is in the closed position to actuate the pump. The lever actuator 921 can take the form of any of numerous different such lever actuators that are currently known, or that later become known, for purposes of manually engaging and actuating the pump. For example, the lever actuator 921 may include a second lever arm located on the inside of the cover that is fixedly connected on one end to the lever actuator 921 located on the outside of the cover and movable therewith, and is engageable on the opposite end with the dome-shaped actuator 15 to engage and depress the dome-shaped actuator with downward movement of the lever actuator 921. The energy stored within the elastic dome-shaped actuator 15 upon depressing the actuator and dispensing a dose of fluid is sufficient to drive the lever actuator 921 to the up or ready position for dispensing another dose. If desired, the lever actuator may include more sophisticated linkages, such as a multi-bar linkage (e.g., a four bar linkage) of a type known to those of ordinary skill in the pertinent art, for purposes of translating the motion of an external actuator to, in turn, engage and drive the pump.

Figure 30A:
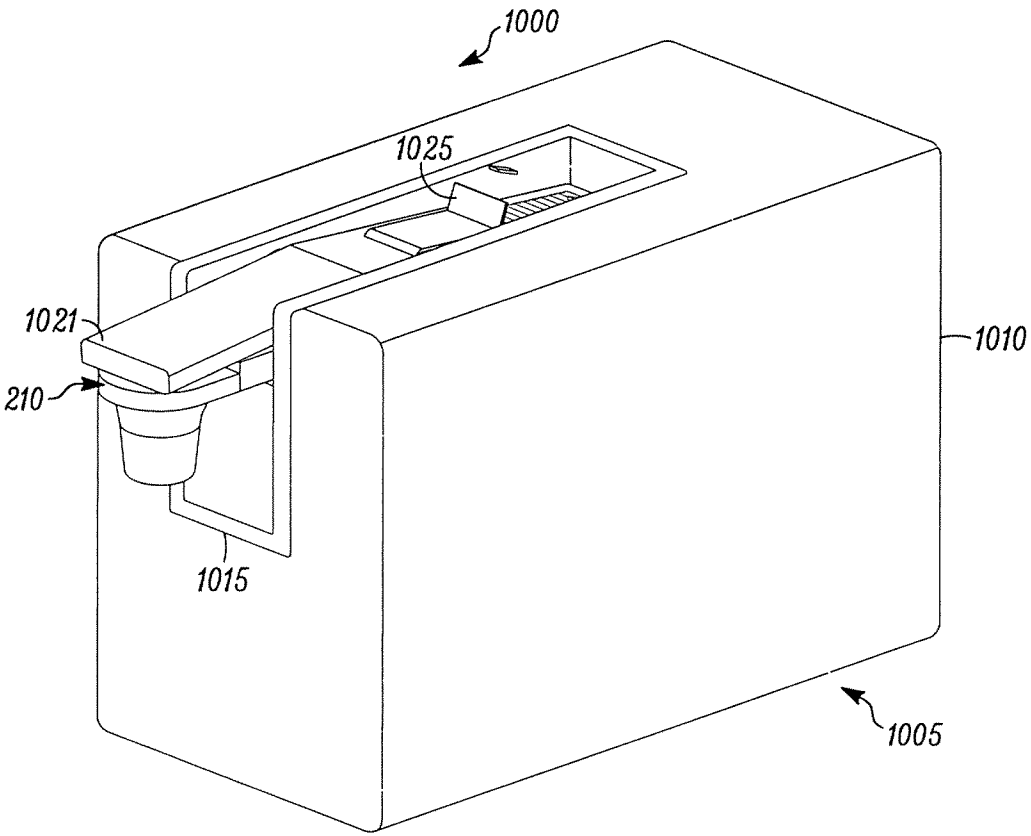
FIGS. 30A and 30B are perspective views of another embodiment of an apparatus for storing and dispensing multiple portions of fluids including a dispensing valve, pump and pouch of the type shown in FIGS. 9-12 and showing the manually engageable actuator and dispensing valve in the storage and dispensing positions, respectively.
Figure 30B:
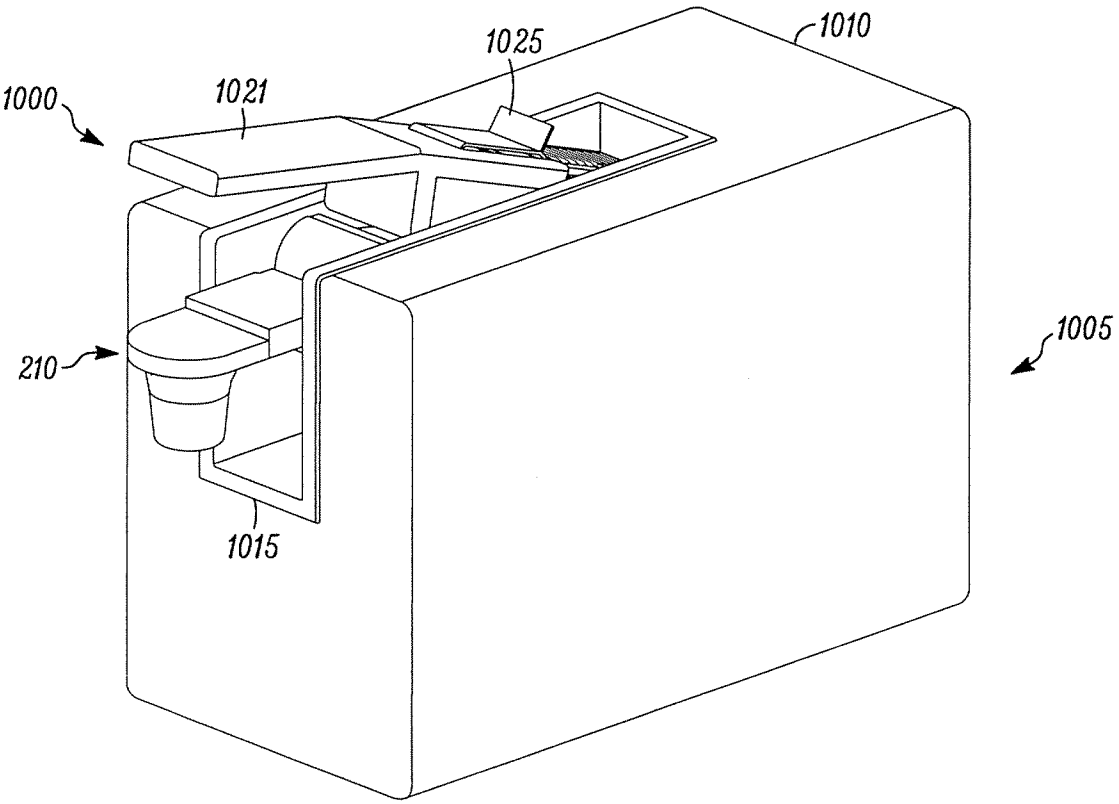

In FIGS. 30A through 31B another embodiment of a dispenser is indicated generally by the reference numeral 1000. The dispenser 1000 is configured to receive therein a dispensing valve, pump and pouch assembly of the type 210 described above in connection with FIGS. 9-12. The dispenser 2000 is similar in many respects to the dispenser 600 described above with reference to FIGS. 20-22D, and therefore like reference numerals preceded by the numeral "10" instead of the numeral "6" are used to indicate like elements. The dispenser 1000 includes a housing 1005 that has a box or pouch housing 1010, a dispensing valve and pump support insert 1015 mounted within the box 1010, and an actuating handle or lever 1021 pivotally mounted on the box and engageable with the pump 218 and elastic-dome shaped actuator 215 thereof to actuate the pump. The manually-engageable lever arm 1021 is disposed within the support insert 1015 when the dispenser 2000 is in a closed position. The lever arm 1021 is movable laterally along a portion of the length of the support insert 1015 between a retracted or closed position, as shown typically in FIG. 30A, and an open or use position, as shown typically in FIGS. 30B through 31B. As shown in FIG. 31A, the inner end of the lever actuator 1021 is slidably received through an aperture 1023 formed in the rearward wall of the support insert 1015, and the lever arm includes a raised flange 1025 spaced inwardly from the inner end of the arm that engages the rearward wall of the support insert 1015 to stop the lever arm against the inner wall in the closed or storage position (FIG. 30A). As shown in FIG. 31A, the lever arm 1021 includes on its inner end an expanded end portion 1027 that engages the aperture 1023 in the rearward wall of the support insert 1015 to stop the lever arm in the extended or use position. In order to use the dispenser, the user manually engages the outer end of the lever arm 1021 and pulls the lever arm outwardly of the housing to move the lever arm from the retracted position of FIG. 30A to the extended position of FIG. 31A. In the extended position, the expanded portion 1027 of the lever arm engages the aperture 1023 of the support insert 1015 to stop further outward movement of the lever arm in the extended position. In the extended position, an extension 1022 of the lever arm overlies and engages the dome-shaped actuator 215 of the pump 218 to engage and actuate the pump with pivotal movement of the lever arm. In the extended position, the lever arm 1021 pivots about the expanded portion 1027 at the aperture 1023 such that the expanded portion cooperates with the aperture to operate as a hinge. As described above, the dispensing valve 212 is pivotally mounted to the support insert 1015 by the pivot pins or hinge 270. Accordingly, the dispensing valve 212 is movable between a retracted or storage position with the dispensing valve received within the cavity of the support insert and the upper cover 268 thereof substantially flush with the forward box panel, as shown typically in FIG. 30A, and an open position with the dispensing valve pivoted outwardly into a dispensing position, as shown typically in FIGS. 30B through 31B. If desired, the dispensing valve and lever arm may be moved back into the retracted or storage positions for transport and/or storage of the dispenser.

Figure 31A:
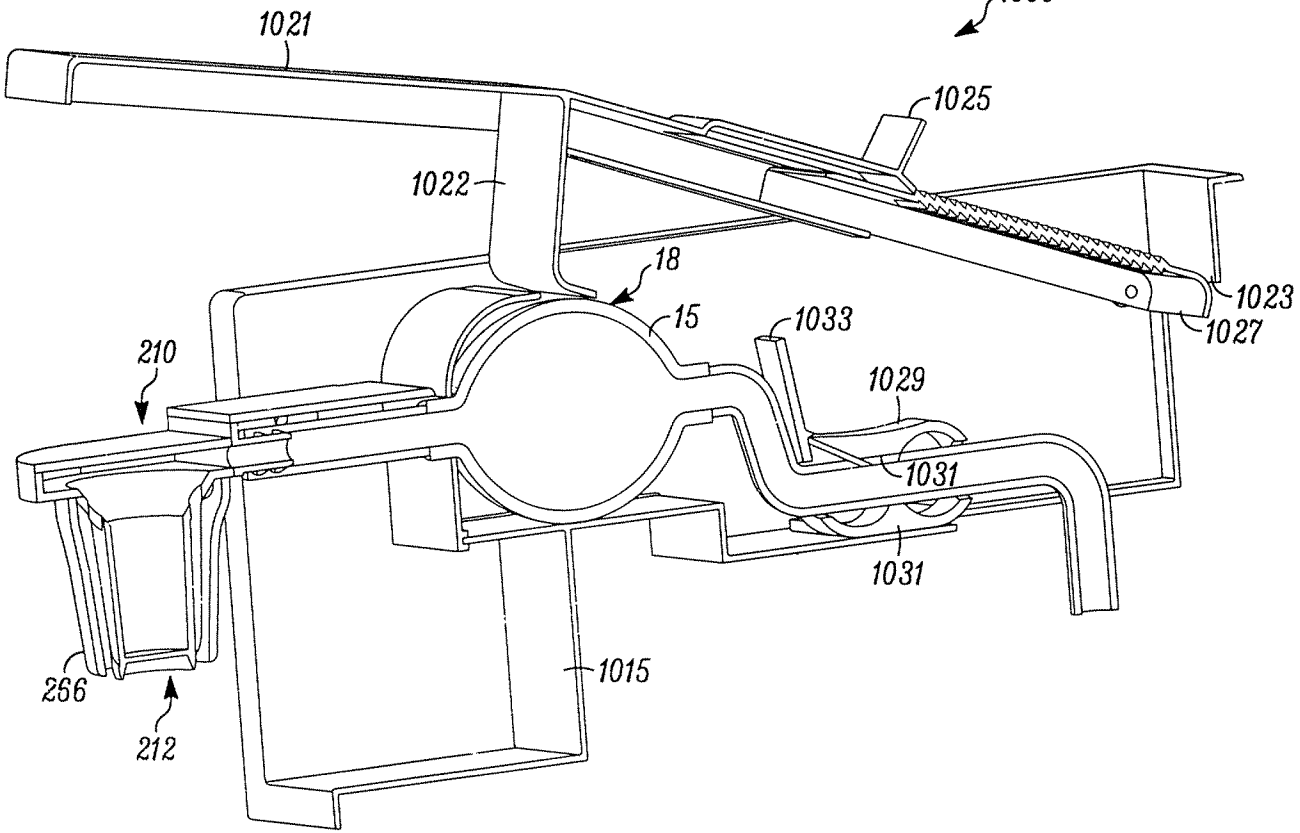
FIGS. 31A and 31B are partial, perspective, cross-sectional views of an insert for supporting within the box the manually engageable actuator, dispensing valve and pump of the apparatus of FIGS. 30A and 30B.
Figure 31B:
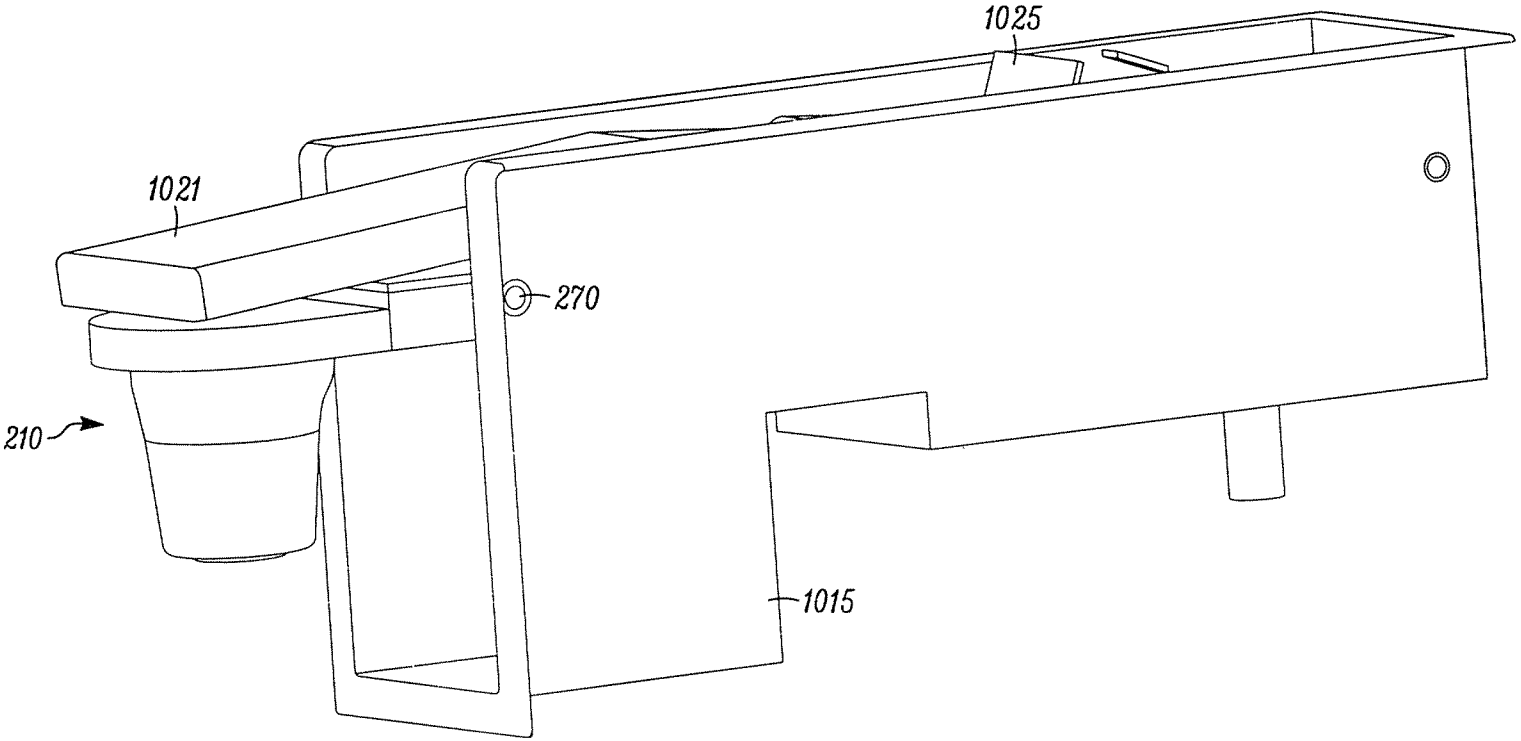

As shown in FIG. 31A, the dispenser 1000 further includes a pouch-pump engagement device in the form of a clip 1029 that engages the flexible tube 214 of the dispensing valve, pump and pouch assembly 210 at a point located between the pump and pouch to pinch the tube during storage and/or transport of the dispenser. When engaging the tube as shown in FIG. 31A, the clip cooperates with the tube to form a sealing surface that hermetically seals the pump 218 and dispensing valve 212 from the variable-volume storage chamber 224, and thus prevents fluid flow in the direction from the variable-volume storage chamber into the pump and valve. Accordingly, the clip 1029 prevents accidental dispensing of fluid through the dispensing valve during transport and/or storage by retaining the fluid in the variable-volume storage chamber and preventing fluid flow from the variable-volume storage chamber into the pump and/or dispensing valve. As shown in FIG. 31A, the clip 1029 includes opposing pincers or like tube-engaging surfaces 1031 that are normally biased inwardly toward each other, and thus into engagement with the tube to hermetically seal the tube. The clip 1029 further includes a manually-engageable tab 1033 that allows a user to grip the clip and pull it away from the tube to allow fluid communication between the variable-volume storage chamber and pump and dispensing valve.

The housings of the above-described dispensers may be made from any suitable material, including plastic, paper or laminated paper, cardboard, and aluminum or other metals.

The type of material may be chosen based on factors including portability, durability, disposability, and/or aesthetics. The examples provided herein of the dispensing valve, pump and pouch assemblies and housing combinations are only exemplary. Many variations of design of the dispensing valve, pump and variable-volume storage chamber, on the one hand, or of the housing, on the other hand, and of combinations of such are contemplated. For example, the housings provided in dispensers 700, 800 and 900 are preferably made from a plastic material having a durability to withstand repeated use and repeated re-filling or re-charging. Re-filling in this instance refers to removing and disposing of the dispensing valve, pump and pouch assembly from the housing after use, and inserting a new valve assembly and pouch into the housing. In another example, it may be advantageous to construct portions of a housing with disposable materials such as cardboard, to improve convenience. In addition, although each dispenser described above is discussed in conjunction with a particular dispensing valve, pump and pouch assembly, each dispenser may employ variations of, or dispensing valves, pumps and/or storage chambers, different from those described herein.

There is also provided various additional pouch-pump engagement devices that maintain a hermetic seal between the variable-volume storage chamber, on the one hand, and the pump and dispensing valve, on the other hand, during transport and/or storage of the apparatus, but that allow fluid flow between the variable-volume storage chamber, pump and valve when ready for use. As indicated above, one advantage of such pouch-pump engagement devices is that they facilitate the ability to ship or transport the dispensers without the risk of accidentally dispensing the stored fluid therefrom. It is therefore important that a hermetic seal be established between the dispensing valve and pump, on the one hand, and storage container, on the other hand, when the dispenser is assembled and not yet in use. In addition, it may be desirable that the connection, once engaged, cannot be disengaged, to maintain sterility of the desired substance.

Figure 32:
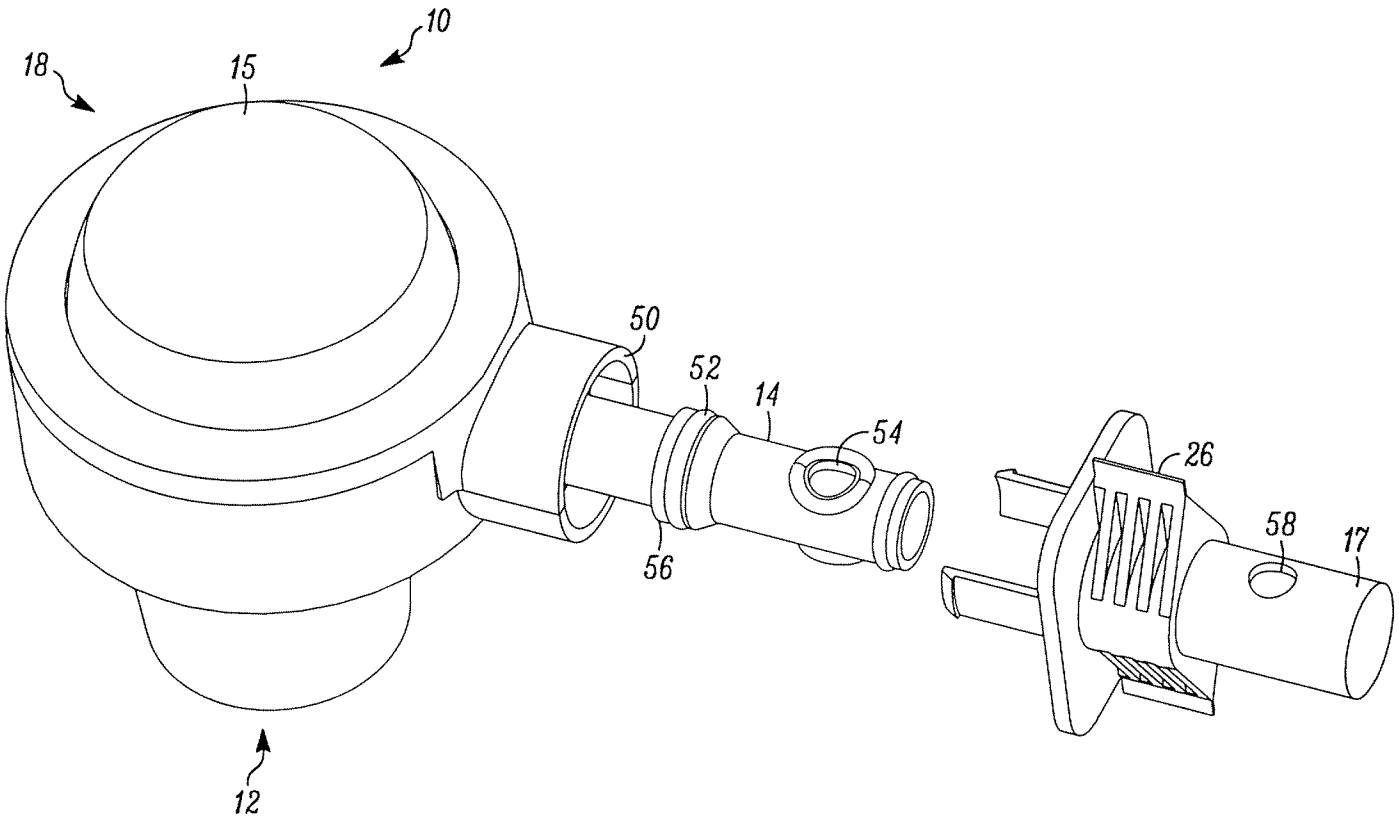
FIG. 32 is a perspective view of a pouch-pump engagement device employed with the dispensing valve, pump and pouch assembly of FIGS. 1-4 that maintains the pouch sealed with respect to the pump during transport and storage, and is rotatable to place the pump in fluid communication with the pouch during use.
Figure 33:
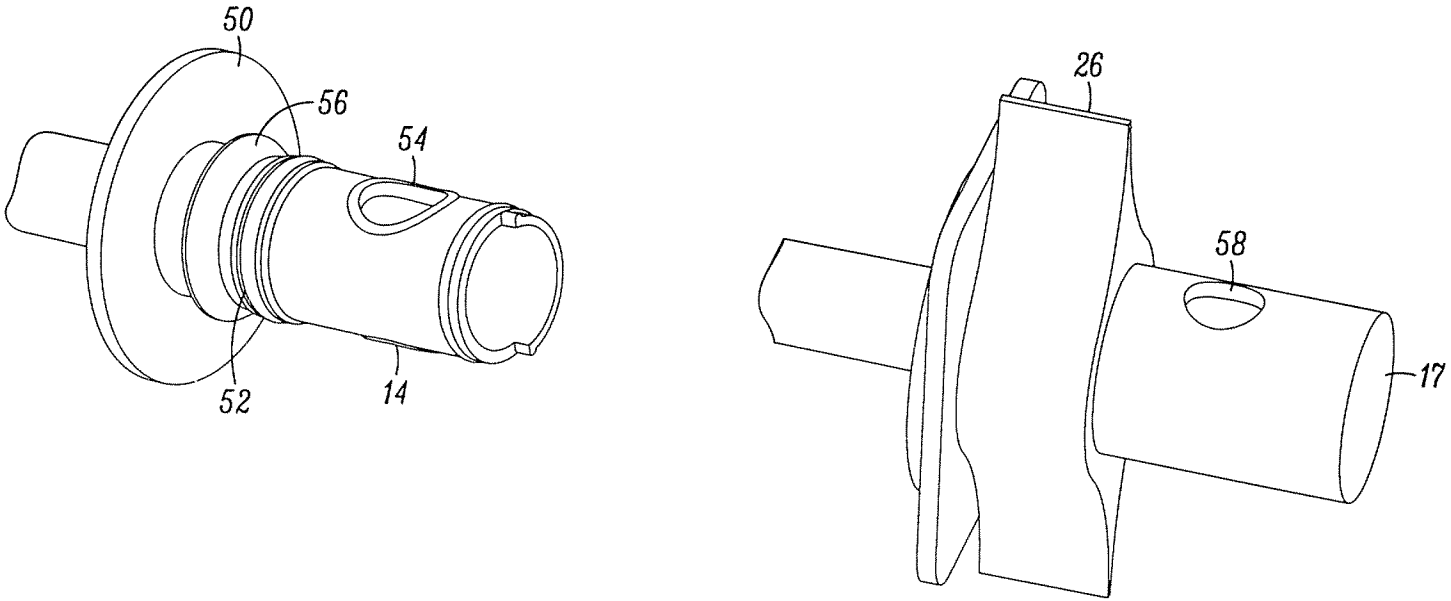
FIG. 33 is an exploded perspective view of the engagement device of FIG. 32.
Figure 34B:
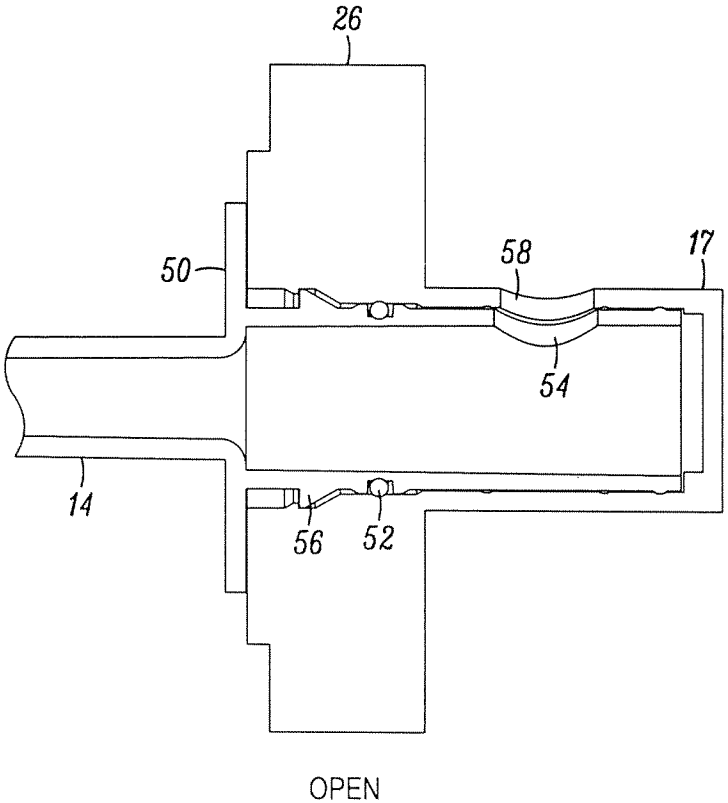
FIGS. 34A and 34B are cross-sectional views of the engagement device of FIG. 33.
Figure 34A:
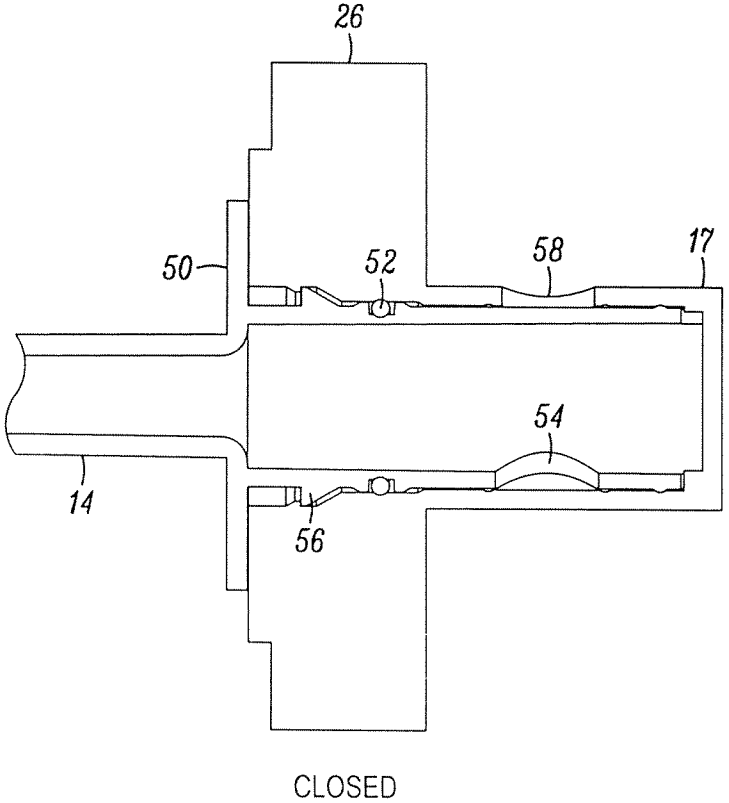
Figure 35A:
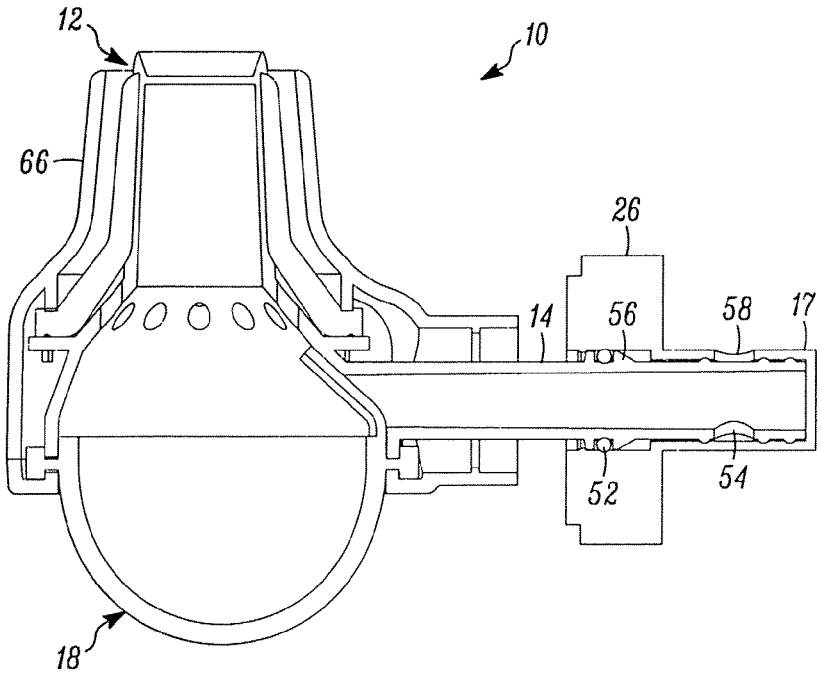
FIGS. 35A and 35B are cross-sectional views of the dispensing valve and pump of FIG. 40 in a closed position and an open position, respectively.
Figure 35B:
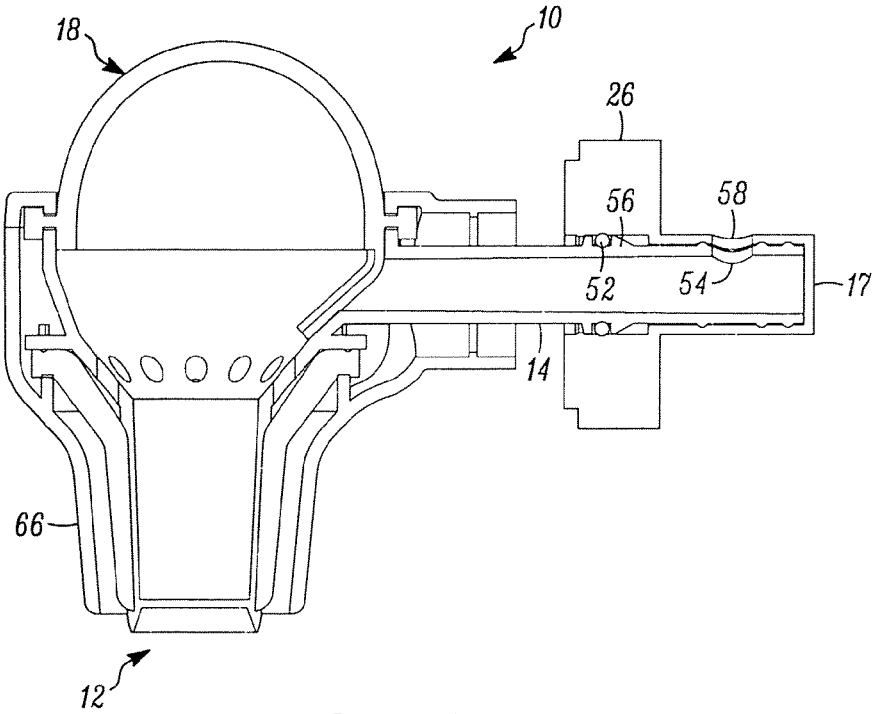

FIGS. 32 through 35B illustrate in further detail the pouch-pump engagement device employed with the dispensing valve, pump and pouch assembly 10 of FIGS. 1 through 4 above. As shown in FIGS. 32 and 33, the apparatus 10 includes the dispensing valve 12, the pump 18, the tube 14 coupled in fluid communication between the pump and variable-volume storage chamber 24, and the mounting flange 17 for mounting the tube to the storage chamber. The tube 14 includes an annular engagement flange 50, an o-ring 52 and a tube aperture 54. As shown in FIG. 34A, the mounting flange 17 includes a recess 56 and an engagement aperture 58. When the tube 14 is inserted into the mounting flange 17, the o-ring 52 seals the connection, and the engagement flange 50 is fixedly received within the recess 56 to prevent the tube 14 from being removed from the mounting flange 17. As shown in FIGS. 34A and 34B, the valve assembly 12 and the tube 14 may be rotated or twisted between a closed position, in which the tube aperture 54 does not line up with or overlap the engagement aperture 58, and an open position in which the tube aperture 54 at least partially lines up with or partially overlaps the engagement aperture 58 to thereby define a fluid path through the apertures between the variable-volume storage chamber 24 and tube 14. In the closed position, fluid cannot flow from the storage chamber 24 to the pump 18 or dispensing valve 12. In the open position, on the other hand, fluid communication is established between the storage chamber 24 and the pump 18 and dispensing valve 12. As shown in FIG. 35A, the valve assembly 12 is in a "nozzle up" configuration with the dispensing valve 12 and associated nozzle 43 facing upwardly when the pouch-pump engagement device is in the closed position. In order to open the pouch-pump engagement device and allow dispensing, the dispensing valve is rotated downwardly into a dispensing position, as shown in FIG. 35B, to align the apertures 54 and 58 and thereby place the pouch-pump engagement device in the open position.

Figure 36B:
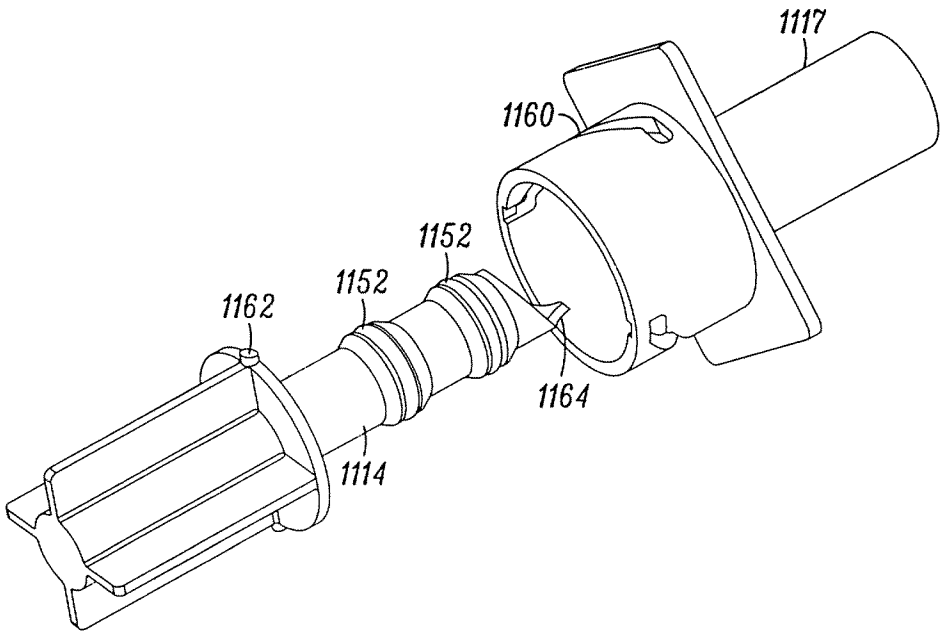
FIG. 36B is an exploded perspective view of the engagement device of FIG. 36A.
Figure 36A:
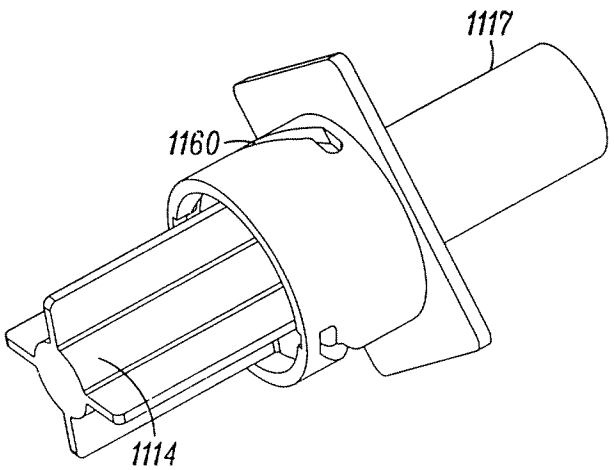
FIG. 36A is a perspective view of another embodiment of a pouch-pump engagement device in an open position.
Figure 37A:
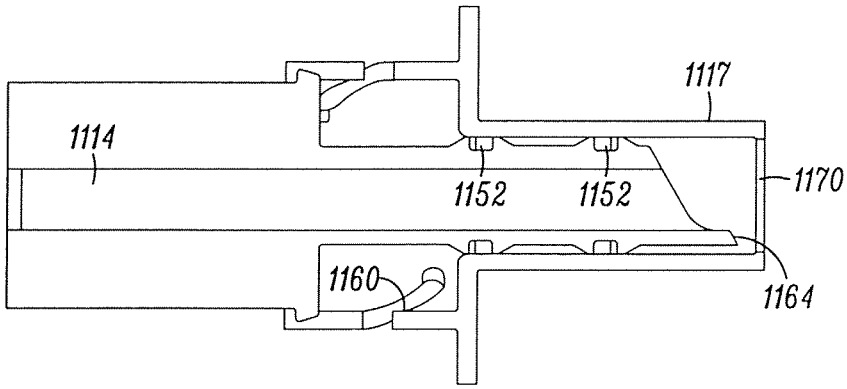
FIG. 37A is a cross-sectional view of the engagement device of FIGS. 36A and 36B in a closed position.
Figure 37B:
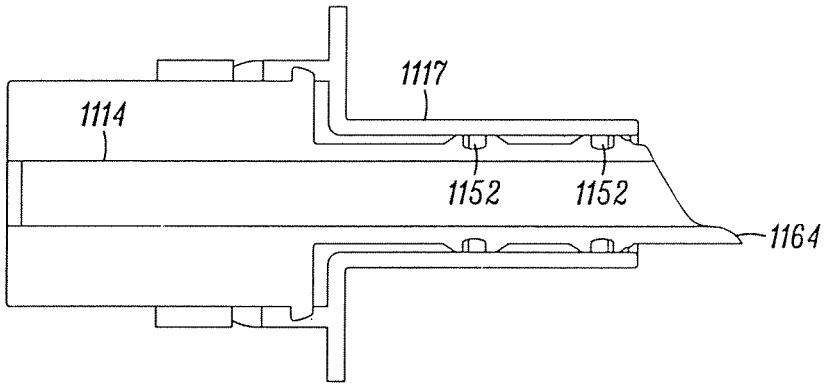
FIG. 37B is a cross-sectional view of the engagement device of FIGS. 36A and 36B in an open position.

In FIGS. 36A through 37B an alternative embodiment of a pouch-pump engagement device is illustrated that is twisted between the closed and open positions. The pouch-pump engagement device of FIGS. 36A through 37B is similar in many respects to the pouch-pump engagement device of FIGS. 32 through 35B, and therefore like references numerals preceded by the numeral "11" are used to indicate like elements. As shown in FIGS. 36A and 36B, the pouch-pump engagement device includes at least one spiral groove 1160 extending along a portion of an interior surface of the mounting flange 1117, and one or more engagement protrusions 1162 formed on an exterior surface of the tube 1114. The tube 1114 terminates in a point 1164 that pierces or partially removes a fluid-tight membrane 1170 at an end of the mounting flange 1117 to establish fluid communication between the storage chamber and the pump and dispensing valve. Twisting the tube 1114 causes the protrusions 1162 to follow the path of the spiral groove 1160, thus advancing the tube 1114 and the point 1164 toward the membrane. The membrane may be made from any suitable water-tight and/or air-tight material that is breakable or may be at least partially removed with a desired force, such as a thin plastic layer or a layer of laminated paper. FIGS. 36A and 37A show the tube 1114 in a closed position in which the membrane 1170 has not been pierced or otherwise at least partially removed from the mounting flange 1117. FIG. 37B shows the tube 1114 in an open position in which the membrane 1170 has been pierced or otherwise partially removed, and the seal between the membrane 1170 and the mounting flange 1117 has been broken, thereby establishing fluid communication between the mounting flange 1117 and the tube 1114.

Figure 38:
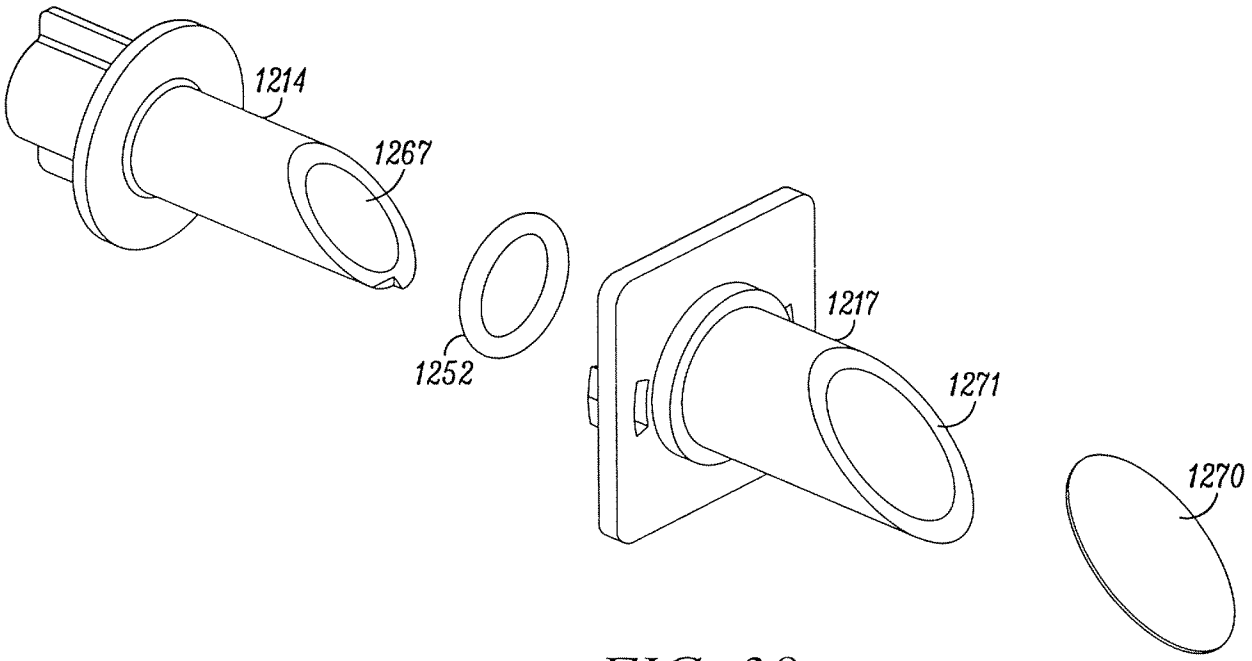
FIG. 38 is an exploded perspective view of another embodiment of a pouch-pump engagement device.
Figure 39A:
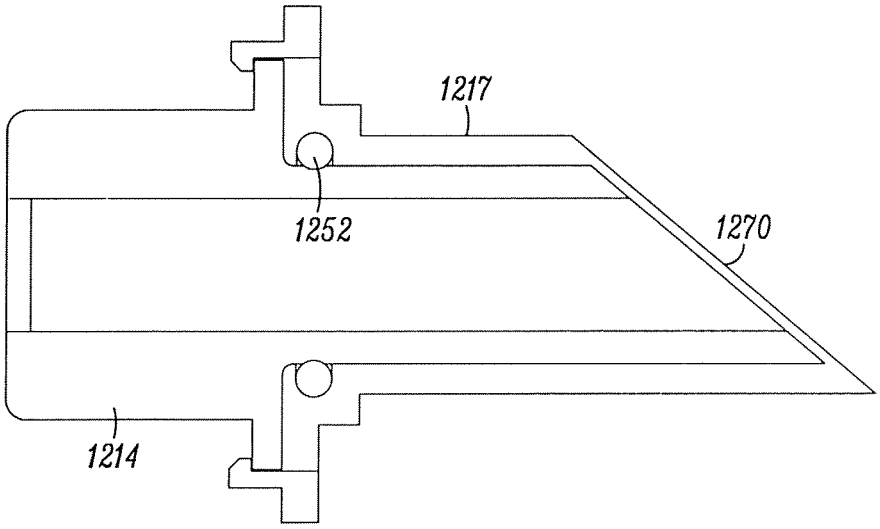
FIGS. 39A and 39B are cross-sectional views of the engagement device of FIG. 36 in a closed position and an open position, respectively.
Figure 39B:
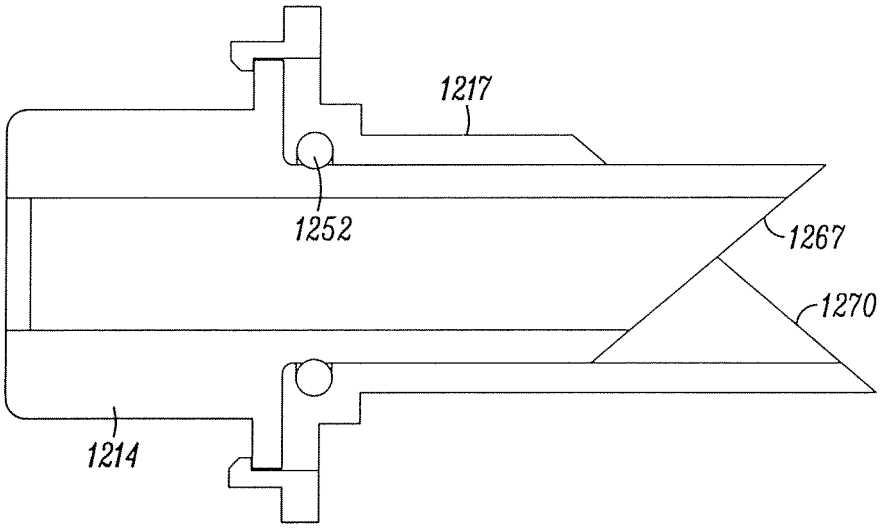

FIGS. 38 through 39B show another embodiment of the twist pouch/pump engagement device. The pouch-pump engagement device of FIGS. 38 through 39B is similar in many respects to the pouch-pump engagement device of FIGS. 36A-37B, and therefore like reference numerals preceded by the numeral "12" instead of the numeral "11" are used to indicate like elements. The tube 1214 has a beveled tube opening 1267 formed so that a plane formed by the tube opening 1267 is at an acute angle relative to an axis of rotation of the tube 1214. The mounting flange includes a beveled flange opening 1271 that is formed so that the plane formed by the flange opening 1271 is at an angle relative to the axis of rotation that is substantially similar to the angle of the tube opening 1267. The membrane 1270 is sealed across flange opening 1271, such as with an adhesive, to provide a hermetic seal.

FIG. 39A shows a closed position of the engagement feature, where both the tube 1214 and the mounting flange 1217 are located at substantially the same angular position about the axis of rotation. In the closed position, the planes of the tube opening 1267 and the flange opening 1271 are substantially parallel. FIG. 39B shows an open position, in which the membrane 1270 is pierced, broken and/or at least partially removed from the flange opening 1271 and fluid communication is established between the storage container and the pump and dispensing valve. As shown in FIG. 39B, rotating the tube 1214 causes the tube and the point 1264 to break the plane formed by the flange opening 1271 and, in turn, break the seal between the membrane 1270 and the mounting flange 1217.

Figure 40:
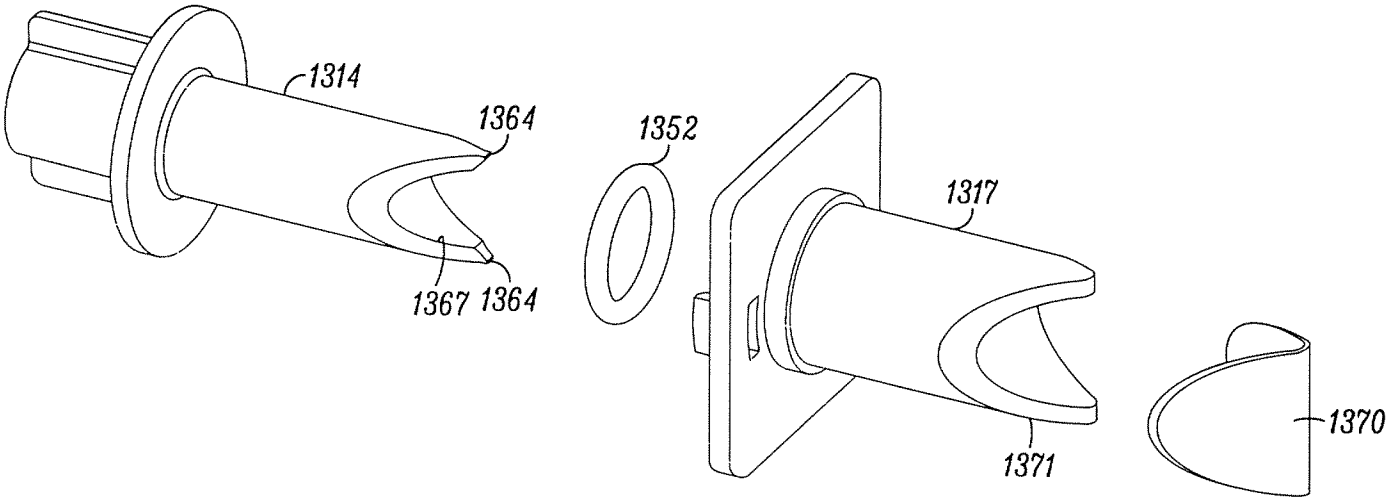
FIG. 40 is an exploded perspective view of another embodiment of pouch-pump engagement device.
Figure 41:
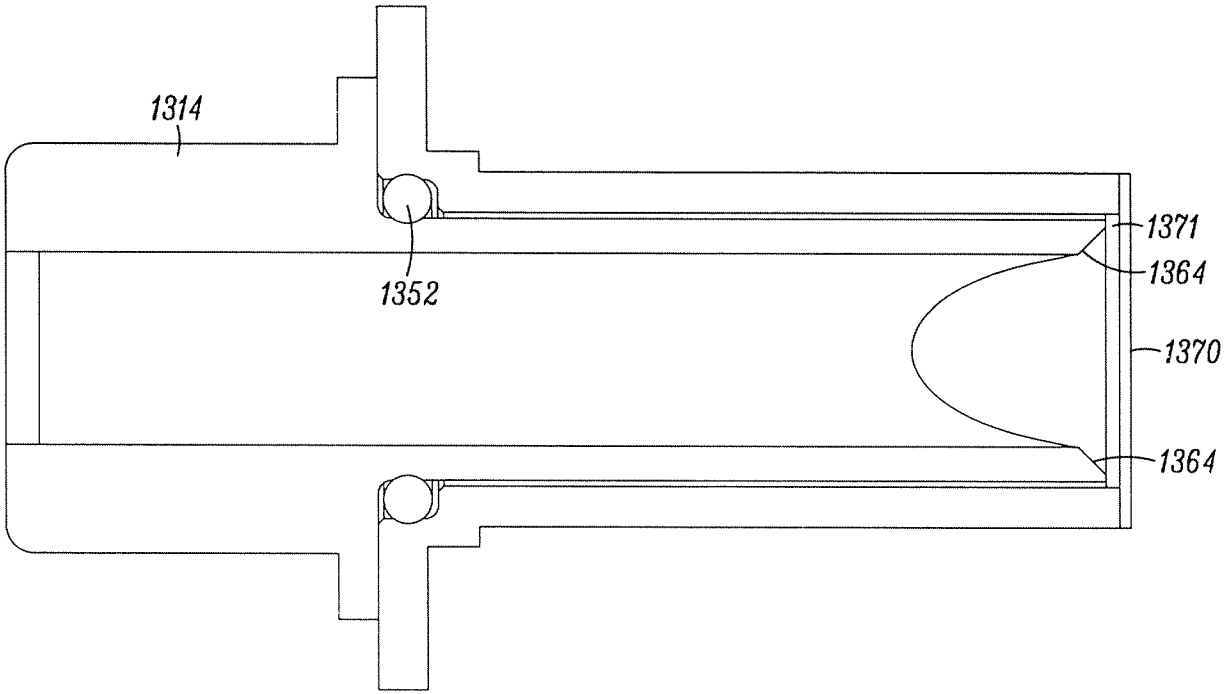
FIG. 41 is a cross-sectional view of the engagement device of FIG. 40.

FIGS. 40 and 41 illustrate one of many configurations that can be utilized based on the concept of breaking a membrane by rotating the tube relative to the mounting flange. The pouch-pump engagement device of FIGS. 40 and 41 is similar in many respects to the pouch-pump engagement device of FIGS. 38 through 39B, and therefore like references numerals preceded by the numeral "13" instead of the numeral "12" are used to indicate like elements. The tube opening 1367 and the flange opening 1371 form proportionally shaped openings, so that, in a closed position, the planes formed by the tube opening 1367 and the flange opening 1371 are substantially parallel. The membrane 1370 covers and is sealed to the flange opening 1371 to form a hermetic seal. When the tube 1314 is rotated relative to the mounting flange 1317, the point 1364 pierces or breaks the membrane or otherwise breaks the seal between the membrane 1370 and the flange opening 1371 to thereby place the variable-volume storage chamber in fluid communication with the tube, pump and dispensing valve.

Figure 42:
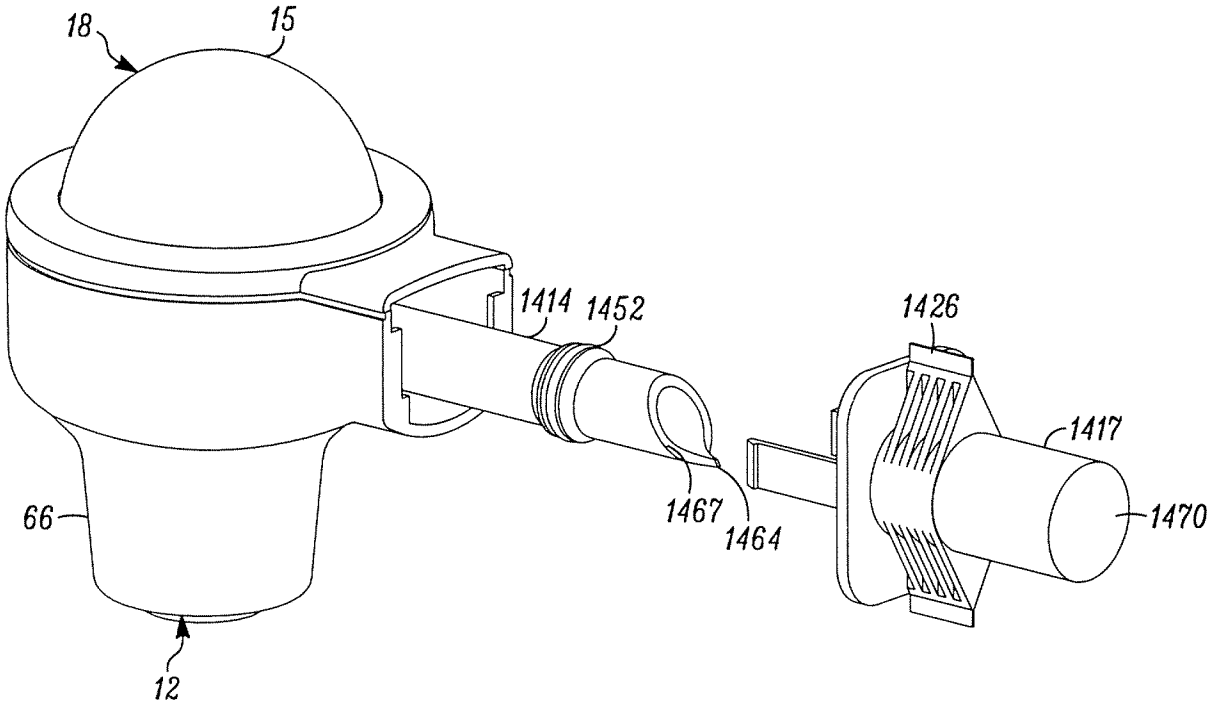
FIG. 42 is a perspective view of another embodiment of a pouch-pump engagement device.
Figure 43:
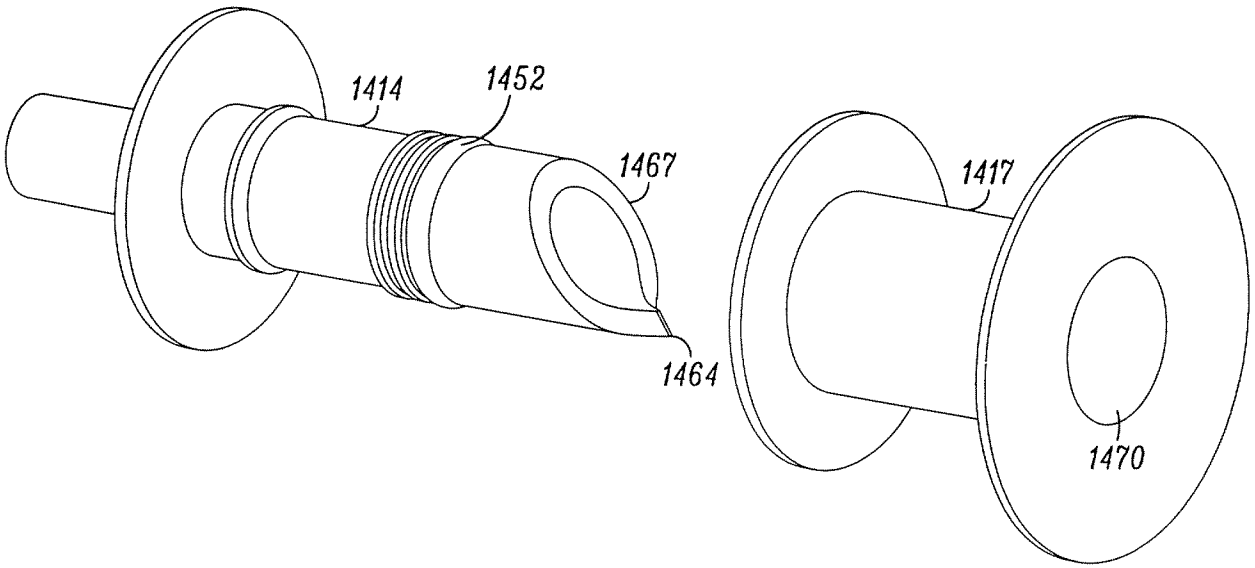
FIG. 43 is a perspective view of the engagement device of FIG. 42.
Figure 44A:
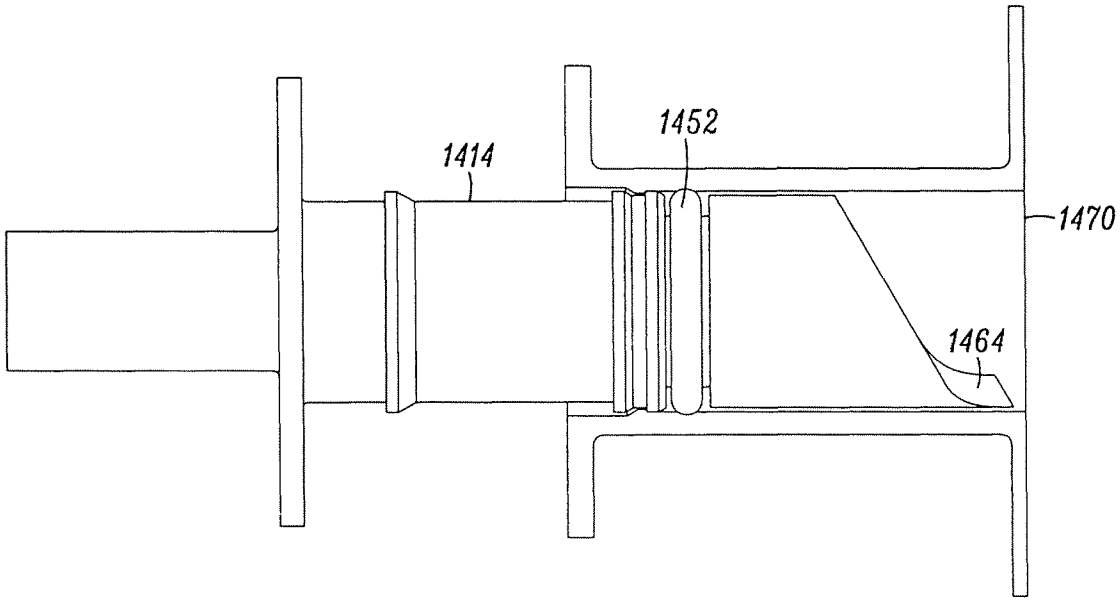
FIGS. 44A and 44B are cross-sectional views of the engagement device of FIG. 43 in a closed position and an open position, respectively.
Figure 44B:
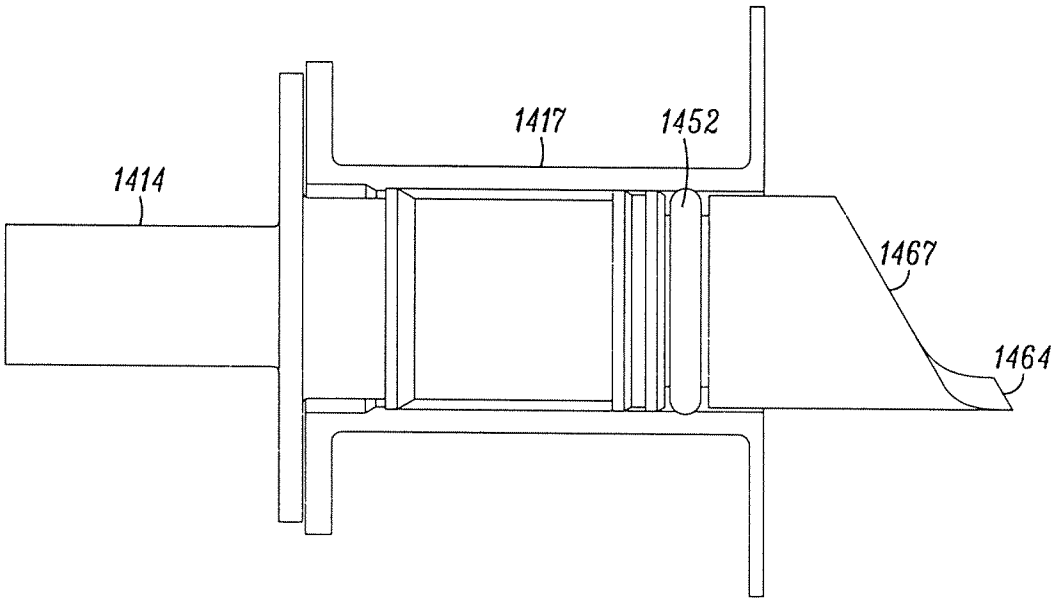
Figure 45A:
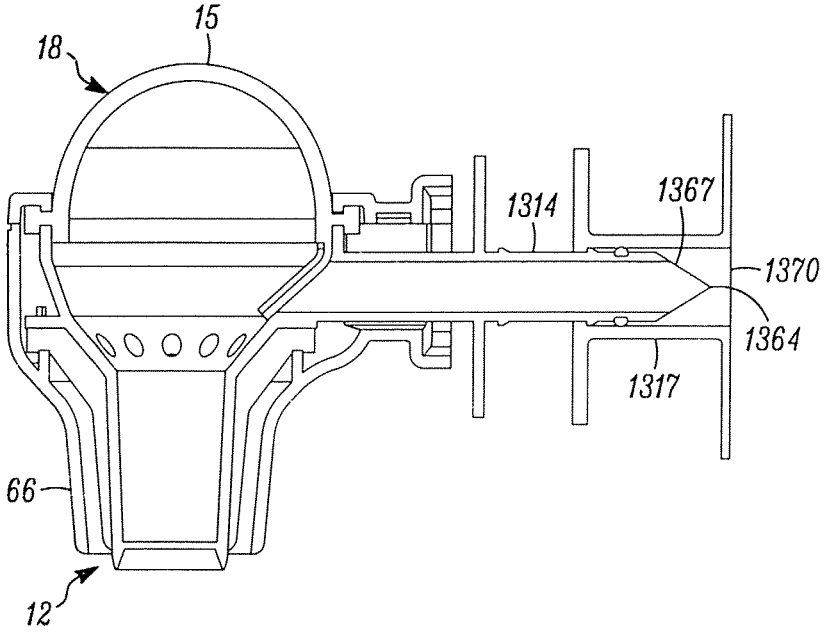
FIGS. 45A and 45B are cross-sectional views of the engagement device of FIG. 42 in a closed position and an open position, respectively.
Figure 45B:
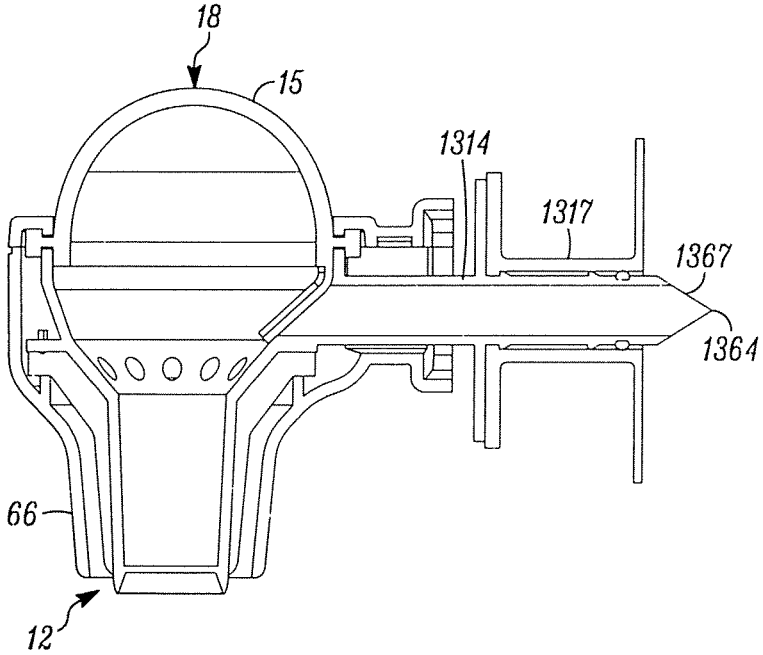

FIGS. 42 through 45B illustrate another embodiment of a pouch-pump engagement device that is opened by pushing the dispensing valve and pump assembly toward the variable-volume storage chamber. The pouch-pump engagement device of FIGS. 42 through 45B is similar in many respects to the pouch-pump engagement device described above with reference to FIGS. 40 and 41, and therefore like reference numerals preceded by the numeral "14" instead of the numeral "13" are used to indicate like elements. As shown in FIGS. 42 and 43, the dispensing valve and pump assembly includes a tube 1414 that is engageable with a mounting flange 1417 to form an engagement with the storage chamber. The tube 1414 includes an o-ring 1452 to aid in forming a seal between the tube 1414 and the mounting flange 1417, and terminates in a tube opening 1467 that forms a point 1464. As shown in FIGS. 44A and 45A, in the closed position of the pouch-pump engagement device, one end of the tube 1414 is disposed within the mounting flange 1417, but the point 1464 is spaced forwardly relative to, and does not break the sealed membrane 1470 located at the end of the mounting flange 1417. As shown in FIGS. 44B and 45B, in the open position, the tube 1414 has been pushed forwardly toward the variable-volume storage chamber to break the seal between the membrane 1470 and the mounting flange 1417 and, in turn, provide fluid communication between the storage chamber and the dispensing pump and valve assembly.

Figure 46:
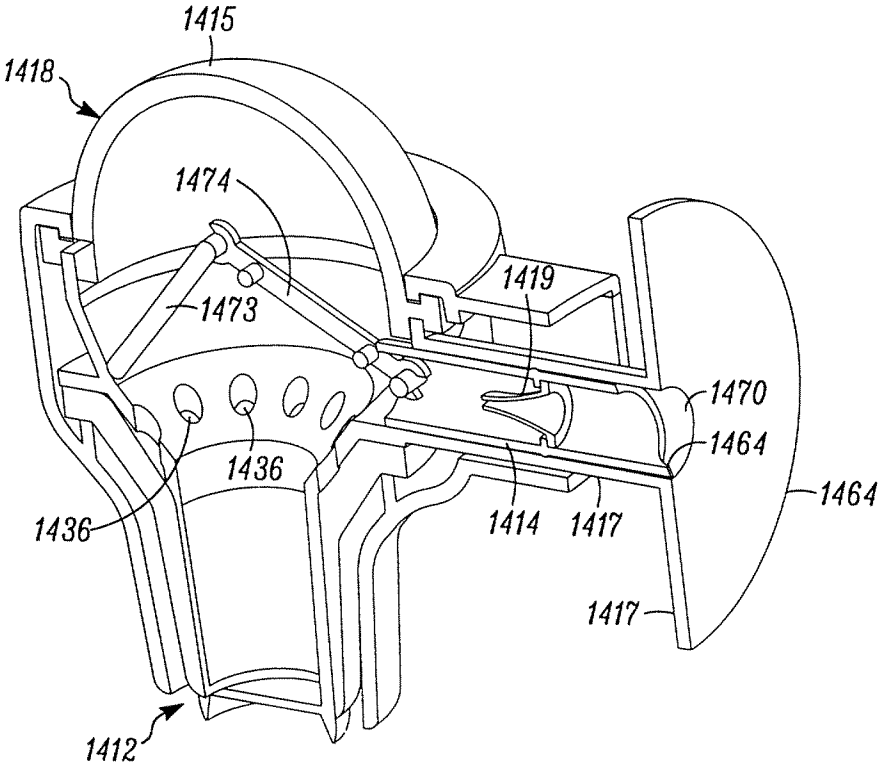
FIG. 46 is a perspective cross-sectional view of another embodiment of a pouch-pump engagement device.
Figure 47A:
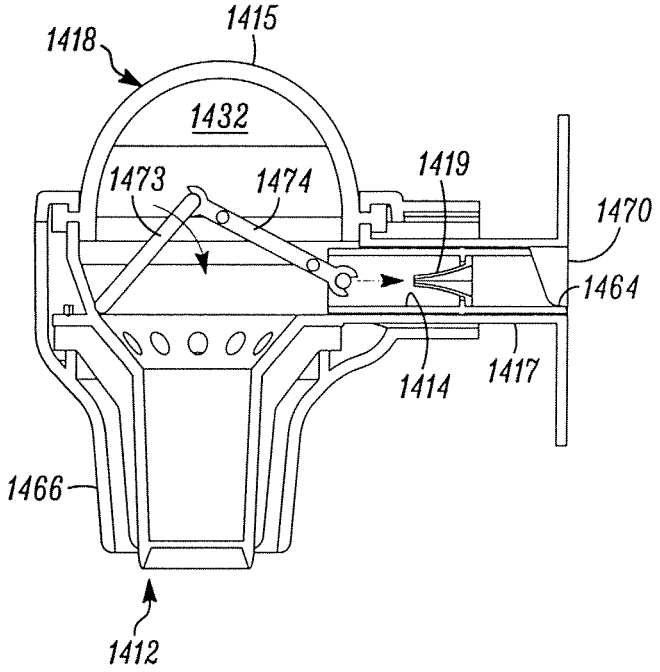
FIGS. 47A and 47B are cross-sectional views of the engagement device of FIG. 46 in a closed position and in an open position, respectively.
Figure 47B:
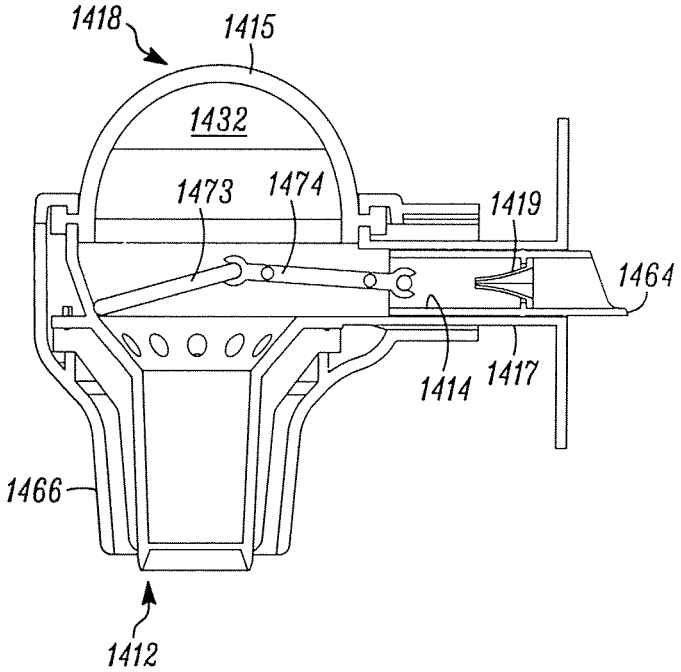

FIGS. 46, 47A and 47B illustrate another embodiment of a pouch-pump engagement device that is opened by actuating the pump. The pouch-pump engagement device of FIGS. 46, 47A and 47B is similar in many respects to the pouch-pump engagement device described above with reference to FIGS. 42 through 45B, and therefore like reference numerals preceded by the numeral "15" instead of the numeral "14" are used to indicate like elements. In this embodiment, the mounting flange 1517 engages directly with the valve body 1530, and the tube 1514 is movable along a passageway within the mounting flange 1517. The dispensing valve and pump assembly includes a hinged extension arm 1572 that is disposed within the compression chamber 1532. The extension arm 1572 is pivotally connected at a first end to an interior surface of a valve body 1530, and is pivotally connected at a second end to the tube 1514. The extension arm includes a first arm 1573 that is pivotally connected to the interior surface of the valve body 1530, and a second arm 1574 that is pivotally connected on one end to the first arm 1573, and is pivotally connected on the other end to the tube 1514. In order to open the pouch-pump engagement device, the dome-shaped actuator 1515 is depressed, thus forcing the first and second arms 1573 and 1574, respectively, downwardly. As a result, the tube 1514 is driven rearwardly away from the compression chamber 1532. When the extension arm 1572 is sufficiently extended, the point 1564 on the end of the tube 1514 extends beyond the plane of the seal 1570 and breaks the seal to thereby place the variable-volume storage chamber in fluid communication with the compression chamber.

Figure 48:
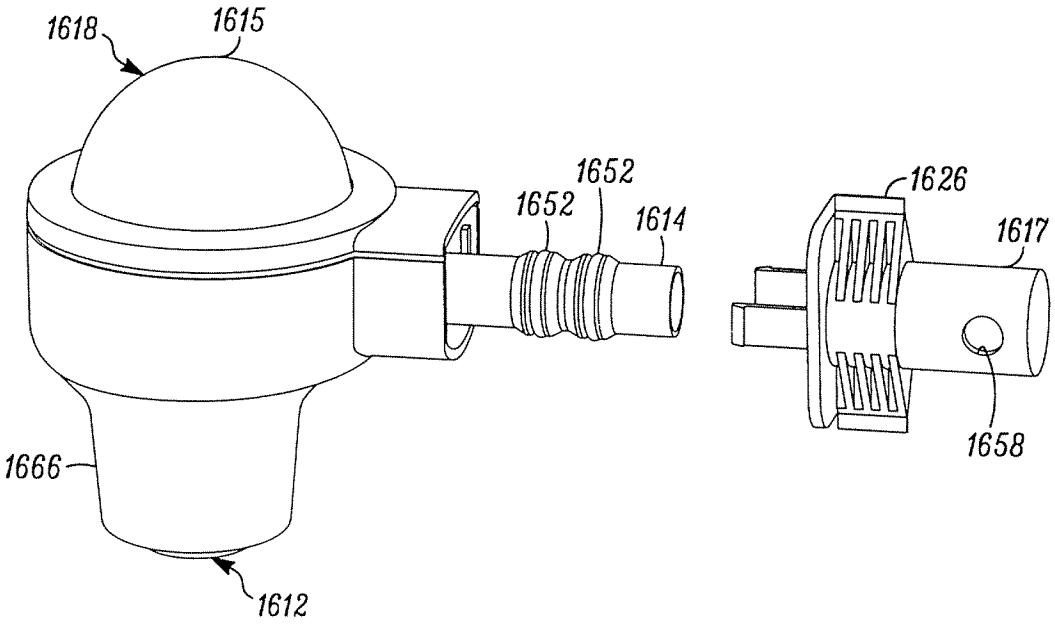
FIG. 48 is a perspective view of another embodiment of a pouch-pump engagement device.
Figure 49:
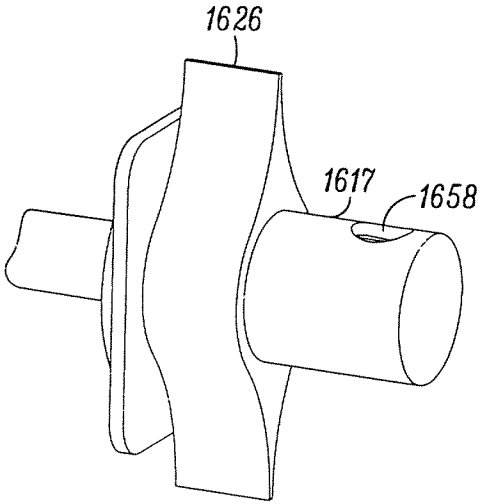
FIG. 49 is an exploded perspective view of the engagement device of FIG. 48.
Figure 49:
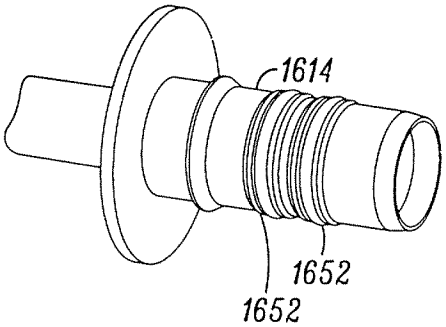
Figure 50A:
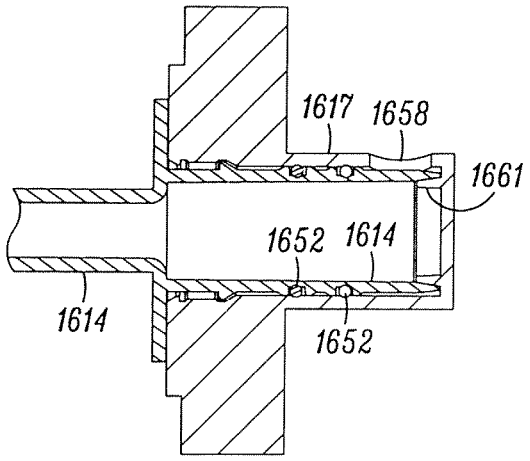
FIGS. 50A and 50B are cross-sectional views of the engagement device of FIG. 49 in a closed position and an open position, respectively.
Figure 50B:
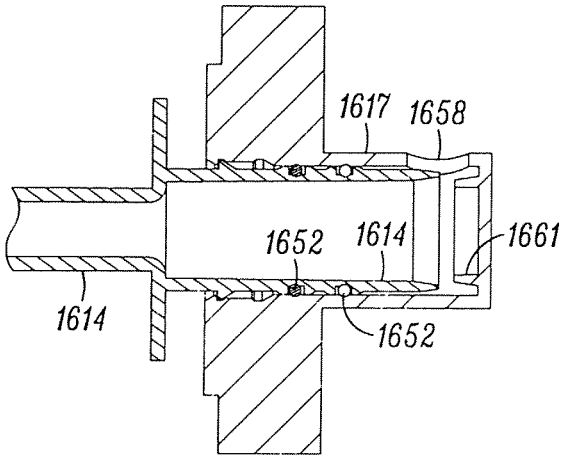
Figure 51A:
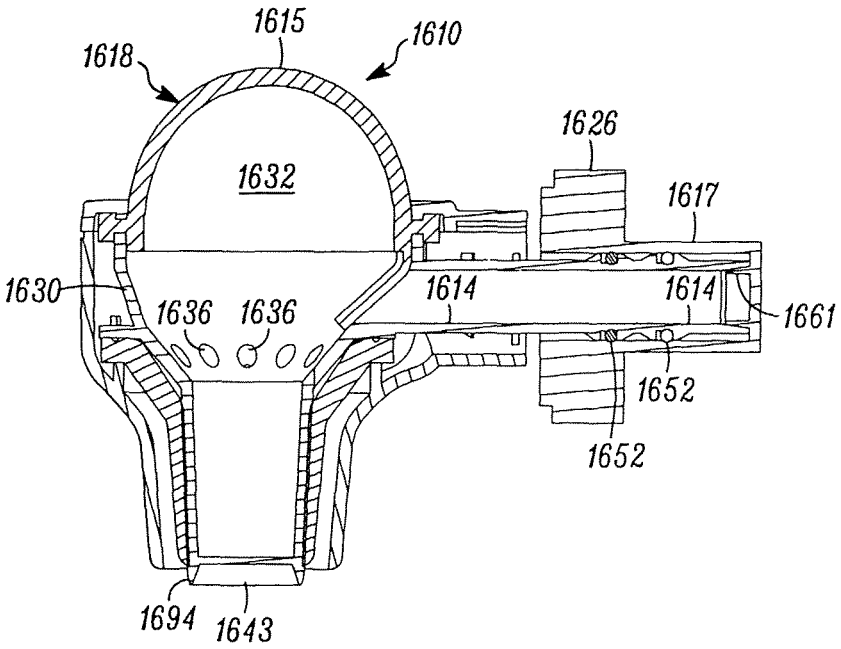
FIGS. 51A and 51B are cross-sectional views of the engagement device of FIG. 48 in a closed position and an open position, respectively.
Figure 51B:
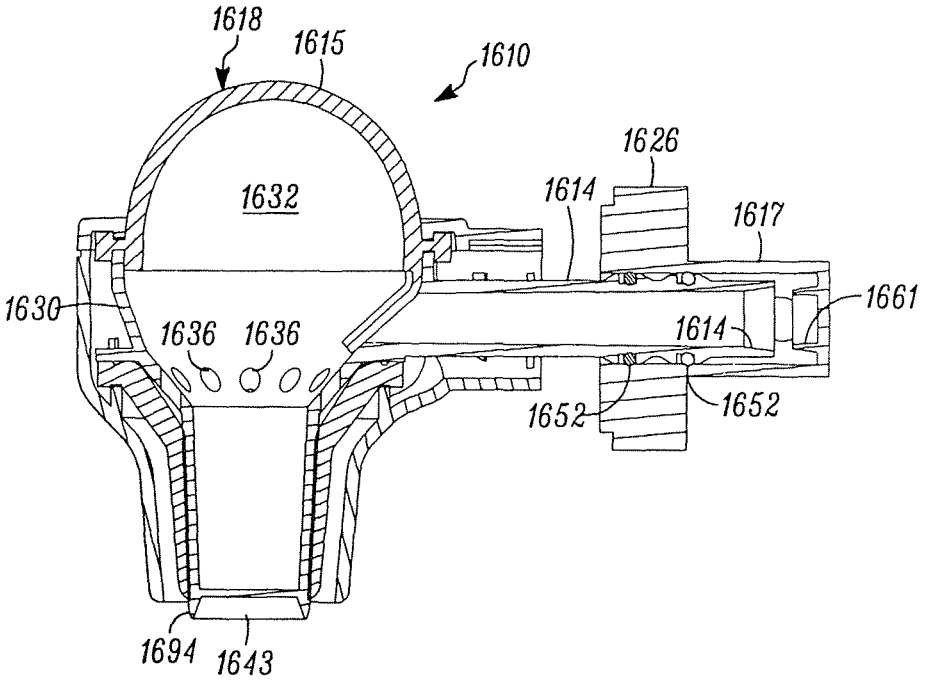

FIGS. 48 through 51B illustrate another embodiment of a pouch-pump engagement device that is opened by pulling the dispensing valve and pump assembly forwardly away from the variable-volume storage chamber. The pouch-pump engagement device of FIGS. 48 through 5113 is similar in many respects to the pouch-pump engagement device described above with reference to 46, 47A and 47B, and therefore like reference numerals preceded by the numeral "16" instead of the numeral "15" are used to indicate like elements. As shown in FIGS. 48 and 49, the dispensing valve and pump assembly includes a tube 1614 that is engageable with a mounting flange 1617 to form an engagement between the storage chamber and the pump and dispensing valve assembly. The tube 1614 has mounted on the inner end thereof a pair of axially-spaced o-rings 1652 to form a hermetic seal between the tube 1614 and the mounting flange 1617. The mounting flange 1617 includes an engagement aperture 1658 that allows fluid communication between the storage chamber and the dispensing valve and pump assembly. As shown in FIGS. 50A and 51A, in the closed position of the pouch-pump engagement device, one end of the tube 1614 is fully inserted into the mounting flange 1617 such that the open end of the tube 1614 abuts the inner end of the mounting flange 1617 and receives therein a sealing plug or flange 1661 to thereby form a hermetic seal between the tube 1614 and the engagement aperture 1658. As shown in FIGS. 50B and 51B, in order to open the pouch-pump engagement device, the dispensing valve and pump are pulled outwardly away from the variable-volume storage chamber to thereby move the tube 1614 away from the inner end and sealing plug 1661 of the mounting flange to thereby place the tube 1614 in fluid communication with the engagement aperture 1658.

As may be recognized by those of ordinary skill in the pertinent art based on the teachings herein, the illustrated pouch-pump engagement devices are only exemplary, and may take any of numerous different configurations that are currently known, or that later become known. For example, in the above twist, pull, and push embodiments, the engagement openings are not restricted to planes or other shapes ending in a point. Any opening shapes such as an opening forming a semicircular plane, or any shape suitable to open or break a membrane or other sealing surface may be utilized.

Figure 52:
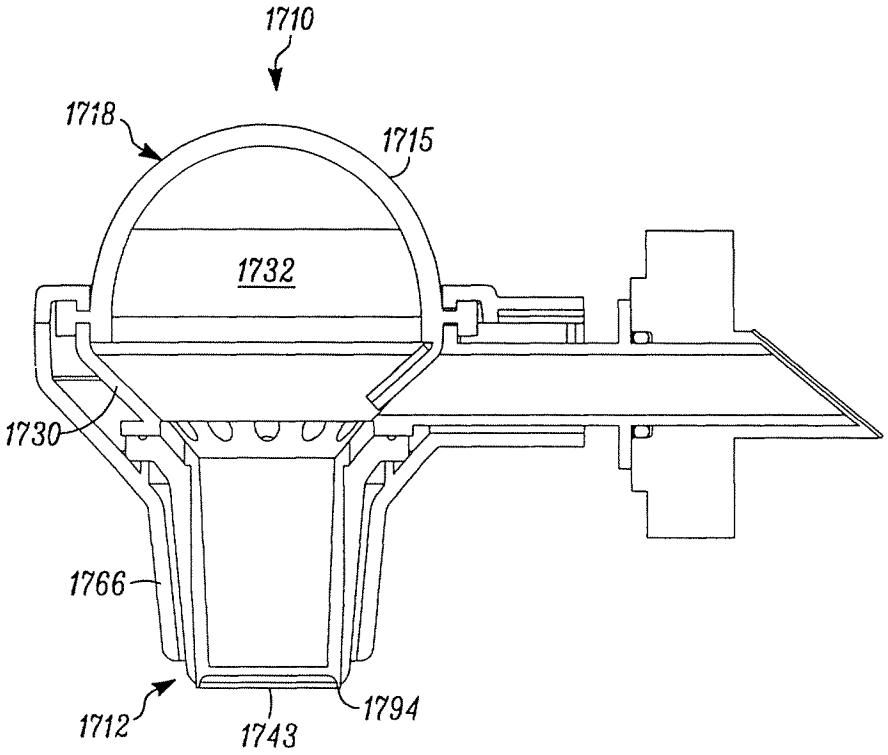
FIG. 52 is a cross-sectional view of the dispensing valve and pump of FIGS. 1-4 in combination with the pouch-pump engagement device of FIGS. 39A and 39B.
Figure 53:
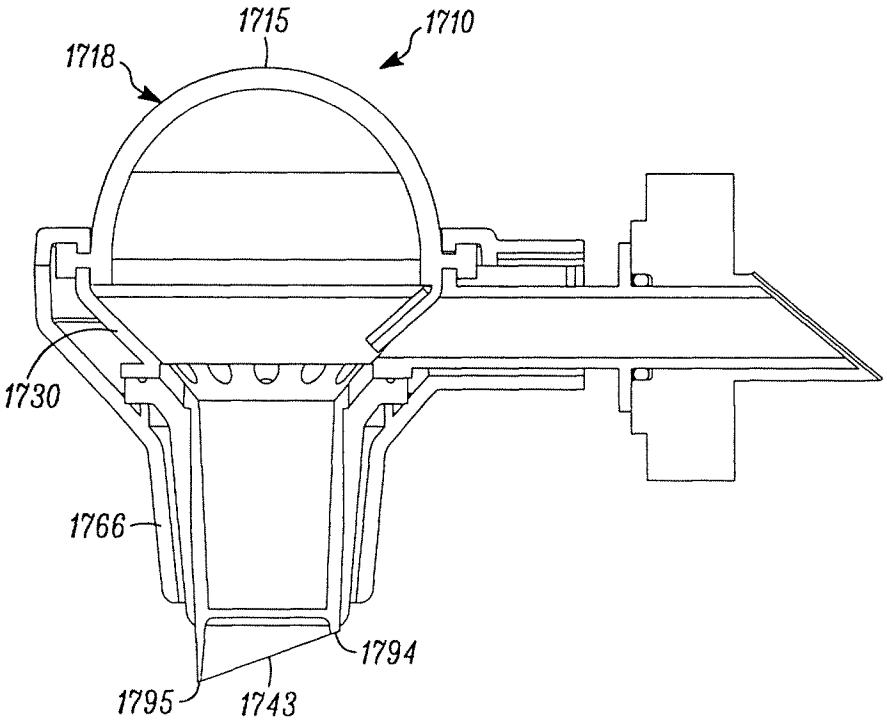
FIG. 53 is a cross-sectional view of the dispensing valve, pump and engagement device of FIG. 52 including a valve outlet surface oriented at an acute angle relative to the dispensing axis to substantially prevent the collection of residual dispensed fluid thereon.

In FIGS. 52 and 53 additional embodiments of a dispensing valve and pump assembly are indicated generally by the reference numeral 1710. The apparatus 1710 is substantially similar to the apparatus 10 described above with reference to FIGS. 1 through 4, and therefore like reference numerals preceded by the numeral "17" are used to indicate like elements. As shown in FIG. 52, the nozzle 1743 has a chamfered edge 1794 that extends downwardly from the valve body 1730 and is significantly shorter relative to the width of the valve body 1730, leaving less surface area for the residual substance from the storage chamber to collect and dry on the edges of the nozzle 1743. In addition, like the dispensing valve 12 described above with reference to FIGS. 1 through 4, the chamfered edge 1794 has a radial width that is very thin and terminates in a sharp edge, i.e., a knife edge. The range of the radial width may, in one embodiment, be within the range of about 5 mm to about 25 mm. The thin annular edge 1794 that terminates in a sharp edge substantially prevents any substance from collecting at the dispensing tip after being dispensed from the valve. In FIG. 53 the nozzle has an oblique shape so that the annular edge 1794 terminates at substantially a single discrete point 1795. As can be seen, the dispensing tip of the nozzle is oriented at an oblique angle (or an acute angle) with respect to the horizontal, or with respect to the dispensing axis (i.e., the direction at which the fluid is dispensed). Orienting the dispensing tip at an oblique angle allows any residual dispensed fluid to collect about a substantially single lowermost point 1795, thus minimizing the surface upon which the substance may collect, and further preventing residual dispensed fluid from collecting thereon.

One advantage of the currently preferred embodiments of the present invention is that the same product may remain shelf-stable in the variable-volume storage, whether refrigerated or not, throughout the shelf life and usage of the pouch. Accordingly, the currently preferred embodiments of the present invention are particularly suitable for storing and dispensing ready-to-drink products, including non-acid products, such as those that are generally difficult to preserve upon opening of the package, including without limitation, drinks such as wine, milk-containing drinks, cocoa-based drinks, malt based drinks, tea, coffee, coffee concentrate, tea concentrate, other concentrates for making beverage or food products, sauces, such as cheese and milk, or meat-based sauces, gravies, soups, and nutritional drink supplements, meal replacements, baby formulas, milks, growing-up milks, etc. Accordingly, a significant advantage of the currently preferred embodiments of the present invention is that they allow the above-mentioned and any of numerous other products to be distributed and stored at an ambient temperature and allow the product to remain shelf-stable even after dispensing product from the variable-volume storage chamber, whether refrigerated or not. However, for certain products it may be desirable to refrigerate the product to provide a better taste, to provide the product at a desired or customary temperature, or for any of numerous reasons that are currently known or that later become known.

As may be recognized by those of ordinary skill in the pertinent art based on the teachings herein, numerous changes and modifications may be made to the above-described and other embodiments of the present invention without departing from the spirit of the invention as defined in the claims. For example, the components of the apparatus may be made of any of numerous different materials that are currently known, or that later become known for performing the function(s) of each such component. Similarly, the components of the apparatus may take any of numerous different shapes and/or configurations, additional components may be added, components may be combined, and one or more components or features may be removed.

In addition, the apparatus may be used to dispense any of numerous different types of fluids or other substances for any of numerous different applications, including, for example, nutritional, food, beverage, hospital, biopharmaceutical, bioprocessing and pharmaceutical applications. A significant advantage of the currently preferred embodiments is that the one-way valve substantially prevents any micro-organisms from entering into the reservoir that may contain a milk-based product, and further, permits the milk-based product to be dispensed at ambient temperature without requiring refrigeration of the container. In addition, the one-way valve, tube and pouch assemblies may be used to store any of numerous different products for dispensing, such as milk-based products, including milk concentrate, half-and-half, and other creamers, baby food or formulas, growing-up milks, other liquid nutrition products, coffee, coffee concentrate, tea, tea concentrate, syrup, such as chocolate syrup for hot chocolate, cappuccino syrups, or other drink mixes or syrups, coffee aroma for dispensing a "fresh" coffee aroma at the time of, or substantially the same time of, dispensing coffee, or other dairy products such as yogurt and ice cream, or non-dairy products, such as juices, soy-based products, nutritional supplement drinks, functional food products, drink mixes, or meal replacement drinks.

Further, the filling machines used to fill the reservoirs used with the apparatus of the present invention may take any of numerous different configurations that are currently known, or that later become known for filling the reservoirs, pouches or dispensers. For example, the filling machines may have any of numerous different mechanisms for sterilizing, feeding, evacuating and/or filling the one-way valve, tube and pouch assemblies, or otherwise for filling the reservoirs. Still further, the pump and/or dispensing valve each may take a configuration that is different than that disclosed herein. For example, the pump may take the form of any of numerous different pumps that are currently known, or that later become known. For example, the pump may include a piston that is movable within a piston chamber connectable in fluid communication with the tube and/or variable-volume storage chamber, and a manually engageable portion that is manually engageable to move the piston and, in turn, pump the substance from the variable volume storage chamber through the one-way valve. Alternatively, instead of a dome-shaped member, the pump may define an elastic squeeze bulb that is manually squeezed to dispense a substantially metered volume of fluid from the variable-volume storage chamber and through the one-way valve, or may define a different type of manually engageable actuator and a different type of spring, such as a coil spring, or an elastic spring, that creates sufficient spring force on a downward stroke of the manually engageable actuator to return the actuator to its ready position when released by the user. Alternatively, the pump may include a different type of lever coupled to a piston or to a dome-shaped member for dispensing fluids through the valve, or may include another type of manually engageable member or pedal that is currently known, or that later becomes known. Other features may also be incorporated into the apparatus of the present invention, such as heating or cooling elements to regulate the temperature of the substance in the storage chamber. For example, such elements could be disposed in any of the dispenser housings described above. The dispensing valve, pump, and variable-volume storage chamber may be mounted within any of numerous different containers or dispensers, and may be used in combination with any of numerous different pumps, such as electrically-actuated, manually-actuated, or pedal actuated pumps, or may be used with dispensers that employ pressurized air or other gas to pump the fluid through the valve, that are currently known, or that later become known. Accordingly, this detailed description of currently preferred embodiments is to be taken in an illustrative, as opposed to a limiting sense.

What is claimed is:

1. An apparatus for storing fluid and dispensing multiple portions of the stored fluid therefrom, comprising:

a container defining a variable-volume storage chamber for receiving therein the fluid;

a one-way dispensing valve including a valve inlet coupled in fluid communication with the variable volume storage chamber, a valve member in fluid communication with the valve inlet and defining a normally-closed valve opening, wherein the valve member is responsive to fluid at the valve inlet exceeding a valve opening pressure to move between (i) a normally closed position, and (ii) an open position permitting fluid flow through the valve opening, and wherein the one-way dispensing valve defines a dispensing axis defining a direction substantially along which fluid is dispensed from the one-way dispensing valve, and the valve further includes an outlet surface over which dispensed fluid that has exited the valve opening flows oriented at an acute angle relative to the dispensing axis, wherein the outlet surface further defines a lower edge, and the lower edge has a substantially single lowermost portion of the lower edge, configured to prevent collection of residual dispensed fluid on the outlet surface; and a pump coupled between the variable-volume storage chamber and one-way dispensing valve for pumping fluid from the variable-volume storage chamber through the one-way dispensing valve.

2. An apparatus as defined in claim 1, further comprising a check valve coupled in fluid communication between the pump and the variable-volume storage chamber and allowing the flow of fluid therethrough in the direction from the variable-volume storage chamber into the pump.

3. An apparatus as defined in claim 1, wherein the pump includes a compressible member defining a compression chamber coupled in fluid communication with the variable-volume storage chamber and the one-way dispensing valve and movable between (i) a first position wherein the compression chamber defines a first volume, and (ii) a second position wherein the compression chamber defines a second volume less than the first volume, wherein movement of the compressible member from the first position to the second position pressurizes fluid in the compression chamber above the valve opening pressure and moves the valve member to the open position to dispense fluid therethrough.

4. An apparatus as defined in claim 3, wherein the compressible member stores sufficient energy when moving from the first position to the second position to drive the compressible member from the second position back to the first position.

5. An apparatus as defined in claim 3, further comprising a pump inlet tube coupled in fluid communication between the variable-volume storage chamber and the compression chamber and a pump outlet tube coupled in fluid communication between the compression chamber and the one-way dispensing valve.

6. An apparatus as defined in claim 1, further comprising a housing receiving therein the variable-volume storage chamber.

7. An apparatus as defined in claim 6, wherein the one-way dispensing valve is disposable outside of the housing.

8. An apparatus as defined claim 6, wherein the one-way dispensing valve is movable between (i) a storage position located at least partially within the housing, and (ii) a dispensing position located at least partially outside of the housing.

9. An apparatus as defined in claim 3, further comprising a manually engageable actuator mounted on a housing, drivingly coupled to the compressible member, and movable with the compressible member between the first and second positions.

10. An apparatus as defined in claim 1, wherein the one-way dispensing valve includes a valve body defining a valve seat and at least one flow aperture extending through at least one of the valve body and valve seat; and wherein the valve member overlies the valve seat, and is movable radially between the normally closed position with the valve member engaging the valve seat, and the open position with at least a segment of the valve member spaced radially away from the valve seat to connect the valve opening in fluid communication with the at least one flow aperture and thereby allow the passage of fluid from the at least one flow aperture through the valve opening.

11. An apparatus as defined in claim 10, wherein the valve body defines the outlet surface orientated at an acute angle relative to the dispensing axis.

12. An apparatus as defined in claim 1, further comprising a sterile fluid received within the storage chamber, and wherein the variable-volume storage chamber and one-way dispensing valve maintain the fluid within the storage chamber sterile and hermetically sealed with respect to ambient atmosphere throughout storage and dispensing of fluid through the one-way dispensing valve.

13. An apparatus as defined in claim 12, wherein the fluid is at least one of a milk-containing fluid, soy-containing fluid, non-dairy creamer, baby formula, low-acid fluid, and dairy-based fluid.

14. An apparatus as defined in claim 1, further comprising a manually engageable actuator operatively coupled to the pump for manually actuating the pump and pumping fluid through the one-way dispensing valve.

15. An apparatus as defined in claim 1, wherein the one-way dispensing valve further includes a dispensing tip defining the single lowermost portion of the lower edge of the outlet surface.

16. An apparatus for storing fluid and dispensing multiple portions of the stored fluid therefrom, comprising:

first means defining a variable-volume storage chamber for receiving therein the fluid;

second means for controlling the flow of fluid dispensed from the first means, wherein the second means includes an inlet coupled in fluid communication with the variable volume storage chamber, third means in fluid communication with the inlet and defining a normally-closed opening, wherein the third means is responsive to fluid at the valve inlet exceeding an opening pressure to move between (i) a normally closed position, and (ii) an open position permitting fluid flow through the third means, and wherein the second means defines a dispensing axis defining a direction substantially along which fluid is dispensed from the second means, and the second means further includes fourth means over which dispensed fluid that has exited the opening flows oriented at an acute angle relative to the dispensing axis, wherein the fourth means defines a lower edge, and the lower edge has a substantially single lowermost portion of the lower edge, configured to prevent collection of residual dispensed fluid on the fourth means; and fifth means coupled between the variable-volume storage chamber and the second means for moving fluid from the variable volume storage chamber through the second means.

17. An apparatus as defined in claim 16, further comprising sixth means for operatively engaging the fifth means, wherein the fifth means includes a compressible member defining a compression chamber coupled in fluid communication with the variable-volume storage chamber and the second means and movable in response to movement of the sixth means between (i) a first position wherein the compression chamber defines a first volume, and (ii) a second position wherein the compression chamber defines a second volume less than the first volume, wherein movement of the compressible member from the first position to the second position pressurizes fluid in the compression chamber above the opening pressure and moves the third means to the open position to dispense fluid therethrough.

18. An apparatus as defined in claim 17, wherein the first means is a container, the second means is a one-way valve, the third means is an elastic valve member, the fourth means is an outlet surface of the one-way valve over which dispensed fluid flows, the fifth means is a pump, and the sixth means is a manually engageable actuator.

19. An apparatus as defined in claim 16, further comprising a sterile fluid received within the variable-volume storage chamber that is at least one of a milk-containing fluid, soy-containing fluid, non-dairy creamer, baby formula, low-acid fluid, and dairy-based fluid, and wherein the variable-volume storage chamber and the second means maintain the fluid within the storage chamber sterile and hermetically sealed with respect to ambient atmosphere throughout storage and dispensing of fluid through the second means.

20. An apparatus as defined in claim 19, wherein the first means is a container, the second means is a one-way valve, the third means is an elastic valve member, the fourth means is an outlet surface of the one-way valve over which dispensed fluid flows and the fifth means is a pump.

21. An apparatus as defined in claim 1, wherein the outlet surface forms an exterior surface of the one-way dispensing valve.

22. An apparatus as defined in claim 16, wherein the first means is a container, the second means is a one-way valve, the third means is an elastic valve member, the fourth means is an outlet surface of the one-way valve over which dispensed fluid flows, and the fifth means is a pump.

23. An apparatus as defined in claim 16, wherein the fourth means forms an exterior surface of the second means.

24. An apparatus as defined in claim 1, wherein the variable-volume storage chamber is sealed with respect to the ambient atmosphere.

25. An apparatus as defined in claim 16, wherein the first means is sealed with respect to the ambient atmosphere.

26. An apparatus for storing fluid and dispensing multiple portions of the stored fluid therefrom, comprising:

a container defining a variable-volume storage chamber for receiving therein the fluid;

a one-way dispensing valve including a valve body defining a valve inlet coupled in fluid communication with the variable volume storage chamber, a valve seat, and at least one flow aperture extending through at least one of the valve body and valve seat, and a valve member in fluid communication with the valve inlet and defining a normally-closed valve opening, wherein the valve member is responsive to fluid at the valve inlet exceeding a valve opening pressure to move between (i) a normally closed position, and (ii) an open position connecting the valve opening in fluid communication with the at least one flow aperture and thereby permitting fluid flow from the at least one flow aperture through the valve opening, and wherein the one-way dispensing valve defines a dispensing axis defining a direction substantially along which fluid is dispensed from the one-way dispensing valve, and the valve further includes an outlet surface over which dispensed fluid that has exited the valve opening flows oriented at an acute angle relative to the dispensing axis, wherein the outlet surface further defines a substantially single lowermost portion thereof, configured to prevent collection of residual dispensed fluid on the outlet surface; and a pump coupled between the variable-volume storage chamber and one-way dispensing valve for pumping fluid from the variable-volume storage chamber through the one-way dispensing valve.

* * * * *

UNITED STATES PATENT AND TRADEMARK OFFICE

CERTIFICATE OF CORRECTION

PATENT NO. : 8,550,308 B2
APPLICATION NO. : 11/949104
DATED : October 8, 2013
INVENTOR(S) : Daniel Py et al.

It is certified that error appears in the above-identified patent and that said Letters Patent is hereby corrected as shown below:

In the claims:

Claim 1, column 31, line 13, "further defines a lower edge" should be changed to --defines a lower edge--

Signed and Sealed this
Tenth Day of December, 2013

Margaret A. Focarino

Margaret A. Focarino
*Commissioner for Patents of the United States Patent and Trademark Office*